US007591518B2

(12) United States Patent
Murai et al.

(10) Patent No.: US 7,591,518 B2
(45) Date of Patent: Sep. 22, 2009

(54) IMAGE FORMING APPARATUS

(75) Inventors: Shunji Murai, Toukai (JP); Masatoshi Yamada, Nakashima-gun (JP); Kenji Samoto, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 988 days.

(21) Appl. No.: 10/486,990

(22) PCT Filed: Aug. 22, 2002

(86) PCT No.: PCT/JP02/08483

§ 371 (c)(1),
(2), (4) Date: May 19, 2004

(87) PCT Pub. No.: WO03/018322

PCT Pub. Date: Mar. 6, 2003

(65) Prior Publication Data

US 2004/0246284 A1 Dec. 9, 2004

(30) Foreign Application Priority Data

Aug. 22, 2001 (JP) ..... 2001-251633
Aug. 22, 2001 (JP) ..... 2001-251635
Aug. 29, 2001 (JP) ..... 2001-259701

(51) Int. Cl.
*B41J 29/38* (2006.01)

(52) U.S. Cl. ..... 347/8; 347/5; 347/37

(58) Field of Classification Search ..... 347/5, 347/8–9, 19, 37; 400/56, 59
See application file for complete search history.

(56) References Cited

U.S. PATENT DOCUMENTS 5,092,693 A 3/1992 Uchimura (Continued)

FOREIGN PATENT DOCUMENTS

CN 1106339 A 8/1995

(Continued)

*Primary Examiner*—Lam S Nguyen
(74) *Attorney, Agent, or Firm*—Oliff & Berridge, PLC

(57) ABSTRACT

At a predetermined position during the lateral movement of a carriage 10, a gap switching mechanism 30 for switching a gap between a recording head 15 and a recording medium is provided. The recording head 15 is mounted facing downward on the carriage 10. A part close to one side on a lower end of the carriage is slidably and pivotably supported by a guide shaft 11 of a round shaft shape. A switching block member 13 provided with several abutment portions 52 and 53 with different heights, which are positioned so as to be opposed to a slide portion 12*a* at an upper end of a frame 12 extending in a vertical direction along a back of the carriage. The A switching block member 13 is pivotably supported by the carriage. A first pushing portion 56 is located at a left end of the frame so as to abut against the switching block member 13. A pivotal posture of the first pushing portion is changed due to the abutment to bring the abutment portion 53 into a slide contact relationship with the frame 12, so that a small gap is provided. A second pushing portion 57 is located at a right end of the frame so as to abut against the switching block member 13, a pivotal posture of the first pushing portion is changed according to the abutment to bring the abutment portion 52 into a slide contact relationship with the frame 12, so that a large gap is provided.

34 Claims, 29 Drawing Sheets

U.S. PATENT DOCUMENTS

| | | | |
|---|---|---|---|
| 5,241,325 | A | 8/1993 | Nguyen |
| 5,433,541 | A | 7/1995 | Hieda et al. |
| 5,474,391 | A | 12/1995 | Andou et al. |
| 5,488,397 | A | 1/1996 | Nguyen et al. |
| 5,678,936 | A | 10/1997 | Hino |
| 5,861,899 | A | 1/1999 | Nguyen et al. |
| 5,880,757 | A | 3/1999 | Ta |
| 5,975,666 | A | 11/1999 | Kawaguchi |
| 6,076,911 | A | 6/2000 | Watanabe |
| 6,168,260 | B1 | 1/2001 | Yanagi et al. |
| 6,190,010 | B1 | 2/2001 | Tanaka |

FOREIGN PATENT DOCUMENTS

| | | | |
|---|---|---|---|
| EP | 0 846 560 | A2 | 6/1998 |
| EP | 0 941 864 | A2 | 9/1999 |
| EP | 0 983 862 | A2 | 8/2000 |
| EP | 1 088 674 | A1 | 4/2001 |
| EP | 1 093 929 | A2 | 4/2001 |
| JP | U 61-2945 | | 1/1986 |
| JP | A 62-256676 | | 11/1987 |
| JP | A 10-157162 | | 6/1988 |
| JP | A 5-104817 | | 4/1993 |
| JP | A 05-220951 | | 8/1993 |
| JP | 06-227085 | | 8/1994 |
| JP | 06-262819 | | 9/1994 |
| JP | A 7-9729 | | 1/1995 |
| JP | A 8-300768 | | 11/1996 |
| JP | B2 2619078 | | 3/1997 |
| JP | A 10-235888 | | 9/1998 |
| JP | A 10-250184 | | 9/1998 |
| JP | A 10-286971 | | 10/1998 |
| JP | A 10-309842 | | 11/1998 |
| JP | A 11-348373 | | 12/1999 |
| JP | A 2000-036659 | | 2/2000 |
| JP | A 2000-218893 | | 8/2000 |
| JP | A 2000-272117 | | 10/2000 |
| JP | A 2001-18416 | | 1/2001 |
| JP | B2 3166998 | | 3/2001 |

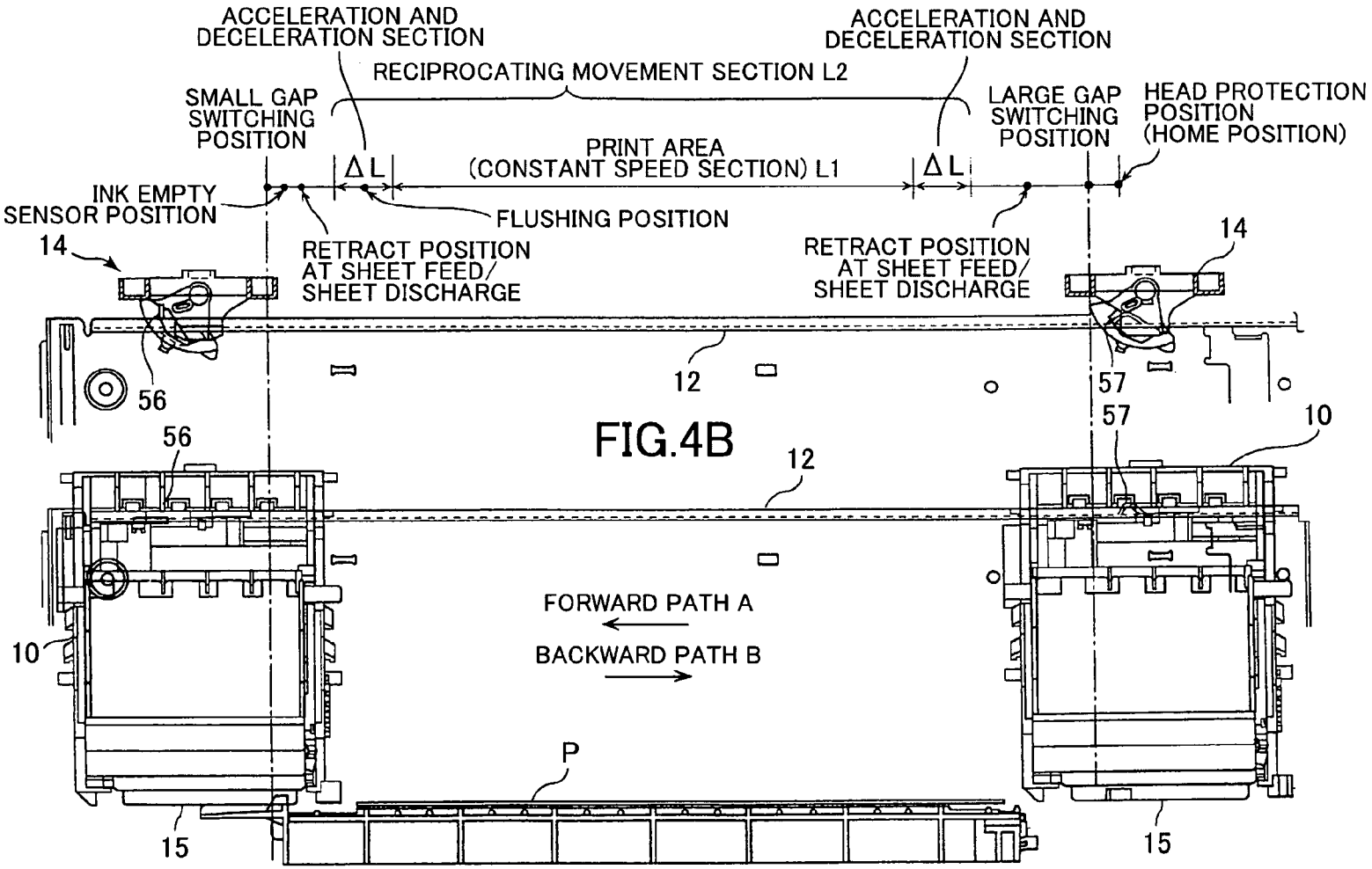
FIG.4A
HEAD PROTECTION POSITION (HOME POSITION)
LARGE GAP SWITCHING POSITION
ACCELERATION AND DECELERATION SECTION
ΔL
RETRACT POSITION AT SHEET FEED/ SHEET DISCHARGE
RECIPROCATING MOVEMENT SECTION L2
PRINT AREA (CONSTANT SPEED SECTION) L1
FLUSHING POSITION
ACCELERATION AND DECELERATION SECTION
ΔL
RETRACT POSITION AT SHEET FEED/ SHEET DISCHARGE
SMALL GAP SWITCHING POSITION
INK EMPTY SENSOR POSITION
14
57
57
56
56
14
10
10
12
12
15
15
FIG.4B
FORWARD PATH A
BACKWARD PATH B
P

IMAGE FORMING APPARATUS

TECHNICAL FIELD

The present invention relates to an image forming apparatus such as a printer, a facsimile apparatus, a copying machine, or a multifunction machine having all functions of the above apparatuses. More particularly, the present invention relates to an image forming apparatus which can adjust a gap between a face of a recording head and a sheet according to a thickness of the sheet, and can mount a recording head unit on a carriage with ease and accuracy. The present invention also relates to a computer program for controlling a print operation of the image forming apparatus.

BACKGROUND ART

Up to now, in some of image forming apparatuses such as a facsimile apparatus and a copying machine, a dot-like image is formed on a sheet by placing an ink ribbon on a surface of the sheet and striking the ink ribbon with dot pins of a recording head, or an image is formed on a sheet by discharging ink drops to the sheet from a nozzle of an ink jet head as in an ink jet type image forming apparatus. In these image forming apparatuses, since a gap between a face of a recording head and a sheet significantly affects print quality, there have been devised various image forming apparatuses each of which is provided with a mechanism capable of adjusting the gap between the face of the recording head and the sheet according to a thickness of the sheet.

For example, in JP 5-104817A, an image forming apparatus is disclosed in which: a carriage mounted with a dot pin type recording head is attached on a guide shaft positioned in parallel with a platen and laterally slidably; and an eccentric shaft decentered with respect to an axis of this guide shaft is pivoted by a contact and separation mechanism, thereby making it possible to adjust a distance (gap) between a head face of the recording head and a sheet.

In addition, in JP 11-348373A, an image forming apparatus is disclosed in which a gap adjustment member is positioned displaceably in a position opposed to an ink jet type recording head across a sheet conveying path.

With these image forming apparatuses, for example, an operator executes gap adjustment by selecting and inputting a sheet type to be used with an input unit of a computer or the like according to a thickness of a sheet on which an image is to be printed and actuating a drive motor of the contact and separation mechanism (gap adjustment member) in response to an input signal from the input unit, or the operator executes manual adjustment by actuating the contact and separation mechanism (gap adjustment member) with a manual lever. In the above-related arts, the carriage or the gap adjustment member is actuated such that the face of the recording head moves away from or close to the surface of the sheet in a parallel manner.

On the other hand, in image forming apparatuses disclosed in JP 8-300768A and JP 10-250184A, one end of a carriage mounted with a recording head is slidably and pivotably attached to a guide shaft with a round shaft shape, a lever provided on the other end side of the carriage is attached to a guide plate, which guides the other end side of the carriage, pivotably around a spindle, an eccentric cam is provided around the spindle, and a projection is provided in a hold portion of the lever. Further, the guide plate is nipped by the eccentric cam and the projection vertically. According to selection of a pivotal position of the lever, in a state in which the guide plate is nipped by a major diameter portion of the eccentric cam and the projection, a gap between a face of the recording head and a sheet is set to be large as the carriage pivots around the spindle. On the contrary, in a state in which the guide plate is nipped by a minor diameter of the eccentric cam and the projection, the gap is set to be small. The lever is manually operated by an operator.

However, in order to select and input a sheet type to be used with the input unit of the computer or the like to adjust a gap to a predetermined amount as described above, a complicated electric mechanism member is required. In addition, in the image forming apparatus in which the lever is operated manually, unless a user knows that the lever is manually operated, the user cannot perform gap adjustment and an image is formed with an inappropriate gap with respect to a thickness of a sheet, which provides inconveniences such as a waste of sheets and a waste of time.

In addition, in the case of the ink jet type image forming apparatus, there are provided a chip type in which a recording head is directly attached to a carriage which is reciprocatingly movable in a direction crossing a conveying direction of a recording medium, and another type in which a recording head unit is detachably mounted on a carriage and an ink cartridge (ink tank) is further detachably mounted thereon. In both the types, positioning of the recording head (recording head unit) to the carriage significantly affects print quality.

For example, in JP 2001-18416A, a carriage is provided with a receiving portion including four side plates and a bottom plate to provide upper open end, and a covering portion is provided on one side of the open end. While one end of the recording head unit is inserted below the covering portion, the other end thereof is pivoted downward to be dropped into the receiving portion, and the other end side of the recording head unit is pressed by a pressing lever provided in the other side plate of the carriage for positioning the recording head.

However, in the related art described in JP 2001-18416A, a nozzle portion in the recording head unit is faced with a nozzle placing portion which is constituted by the side plate having a cut away portion and vertically provided in a direction perpendicular to the pair of parallel side plates. Therefore, there is a problem in that a pressing force of the pressing lever does not act on the positioning of the nozzle portion at all and the recording head unit tends to be unsteady with respect to the receiving portion of the carriage and also tends to positionally deviate.

Besides, since the recording head unit is inserted obliquely downward with respect to the receiving portion as described above, there is also a problem in that mounting work thereof is not easy.

Moreover, as a flow of a basic operation of an ink jet printer of this type, first, after moving the carriage to a retract position at the time of sheet feeding, a sheet is fed so as to reach a position directly below a position to which the recording head is moved. Thereafter, movement of the carriage and conveyance of sheets are alternately performed according to a print command or a paper feed command. Thereafter, when the ink jet printer receives a paper supply command following the paper feed command without receiving the print command, after the carriage is moved to the retract position at the time of sheet feeding, feeding of a sheet is performed according to the paper feed command, and sheet discharge is performed such that the sheet is guided to a sheet discharge portion through the position directly below the position of the movement of the recording head. In addition, after printing of one page is finished, in order to detect ink empty, it is necessary to move the carriage to a position where an ink empty detection sensor is positioned. Alternatively, after printing of all pages is finished, it is necessary to move the carriage to a head protection position.

Consequently, in the above-mentioned image forming apparatus, many positioning operations are performed for moving and stopping the carriage, supplying and discharging sheets, and the like. Thus, there is a waste of movements in operations related to printing which are performed from supply to discharge of sheets, and speeding-up of printing cannot be realized easily.

For example, a reference for determination on stop of the carriage for reversing the carriage from deceleration to acceleration during printing is substantially fixed without any change from a reference for moving the carriage to a retract position at the time of sheet feeding and discharge, a head protection position, a flushing position, or the like to determine that the carriage stops. Thus, a time required for an entire reciprocal movement of the carriage is never shortened.

In addition, prior to discharge of a sheet according to a sheet discharge command, it is necessary to move the carriage to the retract position for sheet feeding or discharge. Thus, time is wasted by an amount of time required for moving the carriage from a print end position to the retract position at the time of sheet feeding and discharge, and sheet discharge cannot be performed promptly.

The present invention has been established in order to solve these problems, and it is an object of the present invention to provide an image forming apparatus which makes it possible to adjust a size of a gap between a recording head and a recording medium by a simple operation of only moving a carriage in a reciprocating scanning direction.

Another object of the present invention is to provide an image forming apparatus which can, with a simple structure, realize accurate positioning of a recording head unit to a carriage and make the recording head unit detachably attachable.

Still another object of the present invention is to provide an image forming apparatus which can perform high speed printing, and to provide a computer program for realizing operations of such an apparatus.

DISCLOSURE OF THE INVENTION

In order to attain the above-mentioned objects, the present invention provides an image forming apparatus which includes: a frame extending in a direction crossing a conveying direction of a recording medium; a guide shaft positioned in parallel with the frame; a carriage provided to reciprocate along the guide shaft and is mounted with a recording head; and a gap adjustment mechanism which adjusts a gap between the recording head and the recording medium. The gap adjustment mechanism is provided with abutment portions which come into slide contact with the frame and move in parallel with the frame together with the carriage. The abutment portions have different heights. The heights of the abutment portions are switched during the movement of the carriage to a predetermined position in one direction parallel with the frame and movement of the carriage to a predetermined position in the other direction. Accordingly, the gap between the recording head and the recording medium can be adjusted.

According to such a structure, since the abutment portion having a desired height is selected by moving the carriage to the predetermined positions laterally along the frame. Therefore, the abutment portion comes into slide contact with a slide contact portion of the frame, so that the gap between the recording head and the recording medium can be automatically changed. And a trouble can be eliminated for an operator to manually change the gap between the recording head and the recording medium every time an image is formed.

Here, in the gap adjustment mechanism, a switching portion for selecting and switching any one of the abutment portions, and pushing means for pushing and actuating the switching portion are further provided independently from the carriage. The pushing means pushes the switching portion during the movement of the carriage in one direction parallel with the frame and during the movement of the carriage in the other direction, so that any one of the abutment portions is selected and the gap between the recording head and the recording medium is adjusted.

According to such a structure, since the pushing means provided separately from the switching portion pushes the switching portion during the movement of the carriage, switching of the abutment portions is performed reliably, and timing for switching can be easily taken.

In addition, the pushing means include first pushing means for pushing the switching portion in one direction, and second pushing means for pushing the switching portion in the other direction. The first pushing means pushes the switching portion in one direction during the movement of the carriage in the direction parallel with the frame. The second pushing means pushes the switching portion in the other direction during the movement of the carriage in the other direction, so that any one of the abutment portions is selected, and the gap between the recording head and the recording medium can be adjusted.

Since the pushing means are provided in several forms including the first pushing means and the second pushing means in accordance with the lateral movements of the carriage, precise control becomes possible.

In addition, the pushing means are provided in the frame, the heights of the abutment portions are switched by the pushing means between the movement of the carriage in one direction and the movement thereof in the other direction. And the abutment portions with the different heights come into slide contact with the frame selectively, so that the gap between the recording head and the recording medium can be adjusted. Further, the pushing means are positioned at substantial terminal ends of the movement paths of the carriage in one direction and the other direction, respectively.

By providing the pushing means in the frame, the abutment portions provided in the carriage which comes into slide contact with the frame and laterally moves can be switched reliably. Accordingly, the structure can be simplified without providing a complicated pushing mechanism anew.

The present invention further provides an image forming apparatus which includes: a frame extending in a direction crossing a conveying direction of a recording medium, the frame being provided with a horizontal portion having a sliding surface; a guide shaft positioned in parallel with the horizontal portion of the frame; a carriage provided to reciprocate along the guide shaft and mounted with a recording head; and a switching block member provided in the carriage. The switching block member can be changed in posture between the movement of the carriage in one direction parallel with the horizontal portion of the frame and the movement of the carriage in the other direction. The switching block member is provided with several abutment portions with different heights which come into slide contact with the sliding surface of the frame according to the posture change. Pushing means is provided in the frame to switch the posture of the switching block member during the movement of the switching block member. The abutment portions with different heights selectively come into slide contact with the frame to adjust a gap between the recording head and the recording medium.

The switching block member provided with the plural abutment portions to come into slide contact with the frame is utilized as a switching mechanism of the abutment portion. Accordingly, it becomes possible to switch the abutment portions by simply pushing the switching block member with the pushing means. And the switching mechanism with a reduced space and a simple structure can be realized.

Here, it is preferable that the carriage is constituted pivotably about an axis of the guide shaft, and a portion where the abutment portions of the switching block member abut against a slide contact portion of the frame is positioned on the opposite side of the recording head across the guide shaft.

The slide contact portion of the switching block member with respect to the frame is positioned on the opposite side of the recording head across the guide shaft, so that it becomes possible to adjust the gap between the recording head and the recording medium simply through adjustment of the carriage to pivot around the guide shaft. The adjustment accuracy is improved.

In addition, it is preferable that the recording head is mounted on the carriage such that a print side thereof faces downward. A portion close to one side of a lower end of the carriage is slidably supported by the guide shaft. The frame has a vertical portion which extends in a vertical direction along a back of the carriage and is in a position higher than the guide shaft. The switching block member is positioned so as to face the sliding surface on the opposite side of the side, where the carriage is located, of the vertical portion of the frame, and is made pivotal with respect to the carriage via a horizontal axis perpendicular to a moving direction of the carriage and to the vertical portion of the frame.

The slide contact portion of the switching block member with respect to the frame is placed in an upper portion of an opposite surface of a surface, where the carriage is located, of the vertical portion of the frame on the back of the carriage. Accordingly, the existing frame can be utilized, and inspection and maintenance such as attachment. And replacement work of the switching block member can be performed easily.

In addition, biasing means for holding the posture changed at the time when the switching block member crosses a dead center of pivoting is connected to the switching block member.

When the biasing means crosses the dead center, since the switching block member can hold a posture, the switched abutment portion is never switched unnecessarily and is held reliably.

In addition, the pushing means are provided in positions where the pushing means can abut against the block member during the movement of the carriage in one direction and during the movement of the carriage in the other direction. Further, the pushing means includes first pushing means positioned on one end side of a moving range of the carriage for switching the plural abutment portions with different heights at the time of movement of the carriage to the one side. The pushing means has second pushing means positioned on the other end side of the moving range of the carriage for switching the plural abutment portions with different heights during the movement of the carriage to the other end side.

Since the switching block can engage with the frame to change its posture during the movement of the carriage, switching failure is less likely to occur.

The present invention further provides an image forming apparatus which includes: a frame extending in a direction crossing a conveying direction of a recording medium; a guide shaft positioned in parallel with the frame; a carriage provided to be reciprocatingly movable to the guide shaft and is mounted with a recording head; and a gap adjustment mechanism adjusting a gap between the recording head and the recording medium adjustable. The gap adjustment mechanism includes a first abutment portion adhered to the carriage, a second abutment portion which projects to or retracts in the carriage during the movement in one direction parallel with the frame and during the movement in the other direction. The second abutment portion has a height different from that of the first abutment portion. And pushing means performs switching between the projection and the retraction of the second abutment portion during the movement of the carriage in one direction and during the movement of the carriage in the other direction. During the movement of the carriage, the first or second abutment portion comes into slide contact with the frame selectively, so that the gap between the recording head and the recording medium can be adjusted.

According to such a structure, the first abutment portion is fixed to the carriage, the second abutment portion having a height different from that of the first abutment portion is caused to retract or project by the pushing means. And the first abutment portion or the second abutment portion selectively comes into slide contact with the frame. Therefore, the structure is simple, and it becomes possible to realize remarkable improvement of accuracy with which at least the first abutment portion comes into slide contact with the frame.

Here, the pushing means are preferably constituted by left and right side plates of the frame.

The left and right side plates of the image forming apparatus are utilized as the pushing means, so that new components and mechanisms are not required. Thus, it becomes possible to improve dimensional accuracy of the pushing means as well.

In addition, the carriage is provided pivotably around an axis of the guide shaft, and a portion where the first and second abutment portions with different heights selectively come into slide contact with the frame is positioned on the recording head side across the guide shaft.

The slide contact portion of these first and second abutment portions with respect to the frame is positioned on the recording head side across the guide shaft, so that it becomes possible to adjust the gap between the recording head and the recording medium simply through adjustment of the carriage to pivot about the guide shaft. And adjustment accuracy is improved.

In addition, the recording head is mounted on the carriage such that a print side thereof faces downward. A portion close to one side of a lower end of the carriage is slidably supported by the guide shaft. The frame has a vertical portion which extends in a vertical direction to above the carriage along a back of the carriage at a position higher than the guide shaft. An upper part of the vertical portion is bent vertically downward and a lower end of a bent portion is positioned to be adjacent to an upper surface of the carriage. The first and second abutment portions are positioned so as to slide facing a vertical surface of the bent portion of the frame, which is a surface on the opposite side of the side where the carriage is located.

Simply by bending the upper part of the frame on the back of the carriage and bringing an edge portion of the vertical surface of the frame close to the upper surface of the carriage from above the carriage, the existing frame can be utilized as a slide contact portion. The solid frame is utilized as the slide contact portion, so that adjustment accuracy can be improved.

In addition, the second abutment portion comes into slide contact with the frame when it projects. The first abutment portion comes into slide contact with the frame when the second abutment portion retracts.

The present invention further provides an image forming apparatus which includes: a frame extending in a direction crossing a conveying direction of a recording medium; a guide shaft positioned in parallel with the frame; a carriage provided to reciprocate along the guide shaft and mounted with a recording head; a switching portion provided in the carriage; and pushing means which are in an abutment relationship with the switching portion in relation to movement of the carriage. The switching portion including a first abutment portion which is adhered to the carriage and selectively comes into slide contact with the frame, and a movable second abutment portion which projects higher than the first abutment portion and is received lower than the first abutment portion. The pushing means including first pushing means which is positioned at substantial one terminal end of a moving range of the carriage in one direction, and causes the second abutment portion to retract by pushing the switching portion in one direction. The pushing means further includes second pushing means which is positioned at the substantial other terminal end of the moving range of the carriage in the other direction and causes the second abutment portion to project by pushing the switching portion in the other direction. The first abutment portion comes into slide contact with the frame in parallel thereto by moving the carriage to the substantial one terminal end to receive the second abutment portion. The second abutment portion comes into slide contact with the frame in parallel thereto by moving the carriage to the substantial other terminal end to cause the second abutment portion to project. Thus, a gap between the recording head and the recording medium can be adjusted.

In the above-mentioned structure, the pushing means are preferably positioned within the moving range of the carriage and outside a printable range.

In addition, it is preferable that the first pushing means changes the abutment portions with different heights so as to reduce the gap between the recording head and the recording medium. The second pushing means changes the abutment portions with different heights so as to increase the gap between the recording head and the recording medium.

The pushing means for switching projection and retraction of the second abutment portion are provided in the substantial terminal ends of the moving ranges in one direction and in the other direction of the carriage. The pushing means are positioned outside the print range, so that printing can be executed without the pushing means affecting a print operation.

In addition, it is preferable that the recording head is an ink jet head for discharging ink to perform recording. The recording head is provided with a cap mechanism for performing capping with respect to the recording head at substantially the same position as or on an outer side of a position where the second pushing means completes an operation at the time of movement of the carriage.

According to such a structure, the second abutment portion is retracted by the first pushing means of the pushing means. The first abutment portion comes into slide contact with the frame to reduce the gap between the recording head and the recording medium. The second abutment portion is projected by the second pushing means, and the second abutment portion comes into slide contact with the frame to adjust the gap between the recording head and the recording medium to be large. In this structure, a capping position is positioned at the same position as or on an outer side of the position where the second pushing means completes an operation. That is, the recording head is capped reliably in a state in which the gap between the recording head and the recording medium is large. Accordingly, it is unlikely that ink drops leaked from a nozzle portion of the recording head to the outside at the time of replacement of an ink cartridge are rubbed against a wall of the capping mechanism to soil the capping mechanism.

In addition, the first pushing means is positioned on an outer side of a printable range in reducing the gap between the recording head and the recording medium to perform a print operation. Alternatively, the first pushing means is positioned on an outer side of a printable range in reducing the gap between the recording head and the recording medium to perform a print operation and in an outside position at least of a portion which is required for accelerating or decelerating the carriage.

The first pushing means is positioned on an outer side of the print range in reducing the gap between the recording head and the recording medium to perform a print operation. Alternatively, the first pushing means is positioned more outside than a position made by adding the acceleration and deceleration portion of the carriage to the print range. Therefore, when the gap is reduced to perform a print operation, it becomes possible to perform a continuous print operation with high accuracy at a constant carriage speed while keeping a predetermined gap.

In addition, the recording head is an ink jet head for discharging ink to perform recording. A flushing mechanism for performing preliminary discharge at substantially the same position as or on an inner side of a position where the first pushing means completes an operation.

The second abutment portion is retracted by the first pushing means of the pushing means. The first abutment portion comes into slide contact with the frame to narrow the gap between the recording head and the recording medium. The second abutment portion is projected by the second pushing means. The second abutment portion comes into slide contact with the frame to widen the gap between the recording head and the recording medium. In this structure, since the flushing position is positioned at the same position as or on an inner side of the position where the first pushing means complete an operation, during printing in a state in which the gap is small, it becomes possible to perform flushing in the state of the gap.

In addition, the second pushing means is positioned on an outer side of a print range in increasing the gap between the recording head and the recording medium to perform a print operation. Alternatively, the second pushing means is positioned on an outer side of a print range in increasing the gap between the recording head and the recording medium to perform a print operation and in an outside position at least of a portion which is required for accelerating or decelerating the carriage.

The second pushing means is positioned on an outer side of the print range in increasing the gap between the recording head and the recording medium to perform a print operation. Alternatively, the second pushing means is positioned on an outer side of a position made by adding the acceleration and deceleration portion of the carriage to the print range. Therefore, when the gap is increased to perform a print operation, it becomes possible to perform a continuous print operation with high accuracy at a constant carriage speed while keeping a predetermined gap.

In addition, switching of the abutment portions with different heights by the pushing means is executed before a print operation on the recording medium is started based upon an instruction from a host computer connected to the image forming apparatus.

At this point, a changing operation of the abutment portions with different heights by the pushing means is executed so as to increase the gap based upon an instruction from the host computer indicating that an envelope has been selected as the recording medium. Alternatively, a changing operation of the abutment portions with different heights by the pushing means is executed so as to reduce the gap based upon an instruction from the host computer indicating that a plain paper has been selected as the recording medium.

When the host computer is used, since the switching of the abutment portions (gap between the recording head and the recording medium) by the pushing means is performed before a print operation is started according to an instruction of sheet type selection, it becomes possible to perform printing with a gap suitable for a sheet.

The present invention further provides an image forming apparatus which includes: a carriage reciprocates in a direction crossing a feeding direction of a recording medium; and a recording head unit which is detachably mounted to the carriage. In the carriage, portions being pressed are provided to project on both left and right sides of the recording head unit. An upward opening head receiving portion, which receives the recording head unit and has left and right side plates engaging with the portions to be pressed, is formed in the carriage. The left and right side plates are provided with elastic pressing members for pressing the portions to be pressed and locking portions for locking the elastic pressing members.

According to such a structure, the recording head unit can be easily attached to and detached from the upward opening head receiving portion. And the recording head unit can be pressed uniformly on the portions to be pressed on both the left and right sides thereof with the pair of left and right elastic pressing members from the carriage side.

Here, it is preferable that the head receiving portion of the carriage is provided with a bottom supporting portion and a back supporting portion, both of which respectively support a bottom and a back other than a nozzle portion of the recording head unit. The recording head unit is biased against the bottom supporting portion and the back supporting portion by the elastic pressing members.

According to such a structure, an upper space on the opposite side of the back can be secured wide, so that it becomes easy to insert/take out the recording head unit with respect to the head receiving portion. In addition, the recording head unit can be efficiently pressed only to the respective supporting portions of the bottom and the back of the carriage by the respective elastic pressing members. And positioning of the recording head unit with respect to the receiving portion of the carriage can be performed accurately.

In addition, it is preferable that the portions being pressed are pressed obliquely downward by the elastic pressing members, such that a pressing force of the elastic pressing members to the back supporting portion becomes larger than a pressing force thereof to the bottom supporting portion.

According to such a structure, it is unnecessary to increase strength (rigidity) of the bottom supporting portion compared with strength (rigidity) of the back supporting portion in the carriage, and the carriage never becomes bulky.

In addition, it is preferable that the elastic pressing members are constituted by wire springs. Ends of the wire springs are pivotably mounted on external surfaces of the left and right side plates of the carriage. And the locking portions include first locking portions provided on the external surfaces of the left and right side plates of the carriage for pressing and locking longitudinal middle portions of the wire springs obliquely downward, and second locking portions for locking free ends of the wire springs not to allow the free ends to be unlocked in an external direction of the side plates.

According to such a structure, since attaching and detaching operations of the wire springs can be performed outside the carriage, the operations can be performed easily. Further, a method of applying a load of a pressing force through the wire springs to the portions being pressed of the recording head unit is set in the first locking portions. Posture holding of the wire springs can be executed in the second locking portions. Accordingly, handling work of the wire springs becomes easy.

In addition, it is preferable that the recording head unit has an upward opening ink cartridge receiving portion for detachably receiving an ink cartridge. And the carriage is provided with a pressing lever for pressing the ink cartridge against the recording head unit.

According to such a structure, since the ink cartridge is pressed against the recording head unit through the pressing lever under a state in which the recording head unit is fixed to the carriage and does not deviate positionally, mounting work of respective components of the recording head unit and the ink cartridge can be performed reliably and easily.

In addition, it is preferable that a pressing force of the pressing lever is set such that the ink cartridge is directed toward a bottom of the recording head unit.

Consequently, adhesion of the recording head unit and the ink cartridge is improved, and leakage of ink from a connecting portion between both the members can be avoided.

The present invention further provides an image forming apparatus which includes: a carriage reciprocating substantially perpendicular to a feeding direction of a sheet; a recording head mounted on the carriage for performing printing on the sheet; reciprocating movement means which moves the carriage repeatedly and reciprocatingly by accelerating the carriage in one direction into a constant speed state, decelerating the carriage after the constant speed state of a short time, and decelerating the carriage after accelerating it in the opposite direction into the constant speed state again. First determining means determines that the carriage is stopped when decelerated to a speed equal to or lower than a first speed if the carriage moved by the reciprocating movement means stops at a predetermined position. Second determining means determines that the carriage is stopped when decelerated to a speed equal to or lower than a second speed higher than the first speed if the carriage moved by the reciprocating movement means performs printing.

According to such an image forming apparatus, criteria for determination on stop of the carriage reciprocatingly moving at the print time can be varied according to an operation state. When printing is performed, time required for the entire reciprocating movement is reduced by partially making the determination on stop earlier. And high-speed printing can be performed easily.

Here, it is preferable that an encoder for detecting a moving speed of the carriage is provided. And as to the carriage under deceleration, when a detection signal is not obtained from the encoder for a first time, the first determining means determines that the carriage has stopped at that point. When a detection signal is not obtained from the encoder for a second time shorter than the first time, the second determining means determines that the carriage has stopped at that point.

According to such an image forming apparatus, a stop determination point for determining that the carriage has stopped can be varied in terms of timing according to a detection signal from the encoder.

In addition, it is preferable that the recording head is an ink jet head according to an ink jet system. And the first determining means determines stop of the carriage according to the first speed at the time of movement to a head protection position, a retract position, or a flushing position.

According to such an image forming apparatus, unlike the case in which the carriage is moved to the head protection position, the retract position, and the flushing position, determination on stop of the carriage can be made earlier when the carriage is reciprocatingly moved for printing.

The present invention further provides an image forming apparatus which includes: a carriage reciprocating substantially perpendicular to a feeding direction of a sheet; a recording head mounted on the carriage for performing printing on the sheet; reciprocating movement means which reciprocates the carriage substantially perpendicular to the feeding direction of a sheet to apply printing to the sheet with the recording head, and on the other hand. When the carriage reverses for reciprocating movement, the apparatus performs feeding of the sheet in association therewith. And carriage movement control means controls movement of the carriage, in which the reciprocating movement means accelerates the carriage in one direction into a constant speed state, decelerates the carriage after it undergoes the constant speed state of a short time, and decelerates the carriage after it is accelerated in the opposite direction into the constant speed state again, thereby repeatedly reversing the carriage to move it reciprocatingly. When discharge of a sheet is performed, the apparatus retracts the carriage to the outside of a reciprocating movement portion of the carriage. The carriage movement control means brings the carriage into the constant speed state with the reciprocating movement means according to the print command, when it receives a sheet discharge command indicating that discharge of a sheet is to be performed together with a paper feed command indicating that feeding of a sheet is to be performed without any other print command following a print command indicating that printing is to be performed by the recording head. The carriage movement control means retracts the carriage to the outside of the reciprocating movement portion continuously with the reciprocating movement means according to the sheet discharge command immediately after the printing ends.

According to such an image forming apparatus, feeding of a sheet is never performed even if a paper feed command is received immediately before a sheet discharge command prior to discharge of the sheet according to the sheet discharge command, and the carriage is retracted to the outside of the reciprocating movement portion immediately after last printing. Therefore, sheet discharge can be performed promptly following a print operation according to a last print command. And high-speed printing can be performed easily.

The present invention further provides an image forming apparatus which includes: a carriage reciprocating substantially perpendicular to a feeding direction of a sheet; a recording head mounted on the carriage for performing printing on the sheet; a gap adjustment mechanism which automatically switches a gap between the sheet and the recording head at a gap switching position located outside a reciprocating movement portion of the carriage. Reciprocating movement means accelerates the carriage in one direction into a constant speed state, decelerates the carriage after the constant speed state of a short time, and decelerates the carriage after it is accelerated in the opposite direction into the constant speed state again, thereby repeatedly reversing the carriage to move it reciprocatingly. The reciprocating movement means moves the carriage to the gap switching position. Carriage movement control means moves the carriage to the gap switching position with the reciprocating movement means during feeding of a sheet.

According to such an image forming apparatus, in automatically switching a gap, since the carriage is moved to the gap switching position at the time of feeding a sheet, the sheet feeding is not delayed due to the gap switching. And high-speed printing can be performed easily.

The present invention further provides a computer program for controlling an image forming apparatus which reciprocatingly moves a carriage substantially perpendicular to a feeding direction of a sheet and performs printing to the sheet with a recording head mounted on the carriage. The computer program including: a reciprocating movement program for accelerating the carriage in one direction into a constant speed state, decelerating the carriage after the constant speed state of a short time, and decelerating the carriage after accelerating it in the opposite direction into the constant speed state again, so that the carriage can repeatedly reciprocates. A first determination program determines that the carriage is stopped when decelerated to a speed equal to or lower than a first speed, if the carriage moved based upon the reciprocating movement program is stopped at a predetermined position. A second determination program determines that the carriage is stopped when decelerated to a speed equal to or lower than a second speed higher than the first speed if the carriage is reciprocatingly moved based upon the reciprocating movement program to perform printing.

According to such a computer program, by operating a CPU based on the computer program, criteria for determination on stop of the carriage reciprocatingly moving at the print time can be varied according to an operation state. When printing is performed, time required for the entire reciprocating movement is reduced by partially making the determination on stop of the carriage earlier. And high-speed printing can be performed easily.

The present invention further provides a computer program for controlling an image forming apparatus which reciprocatingly moves a carriage substantially perpendicular to a feeding direction of a sheet to perform printing to the sheet with a recording head mounted on the carriage. When the carriage is reversed for reciprocating movement, the apparatus performs feeding of the sheet. The computer program including: a reciprocating movement program for accelerating the carriage in one direction into a constant speed state, decelerating the carriage after the constant speed state of a short time, and decelerating the carriage after accelerating it in the opposite direction into the constant speed state again, thereby repeatedly reciprocating the carriage. When discharge of a sheet is performed, the apparatus retracts the carriage to the outside of a reciprocating movement portion of the carriage. And a carriage movement control program brings the carriage into the constant speed state based upon the reciprocating movement program according to the print command, when a sheet discharge command indicating that discharge of a sheet is to be performed is received together with a paper feed command indicating that feeding of a sheet is to be performed without any other print command following a print command indicating that printing is to be performed by the recording head mounted on the carriage. The apparatus retracts the carriage to the outside of the reciprocating movement portion continuously based upon the reciprocating movement program according to the sheet discharge command immediately after the printing ends.

According to such a computer program, by operating the CPU based upon the computer program, feeding of a sheet is never performed even if a paper feed command is received immediately before a sheet discharge command prior to discharge of the sheet according to the sheet discharge command. The carriage is retracted to the outside of the reciprocating movement portion immediately after last printing. Therefore, sheet discharge can be performed promptly following a print operation according to a last print command. And high-speed printing can be performed easily.

The present invention further provides a computer program for controlling an image forming apparatus which reciprocatingly moves a carriage substantially perpendicular to a feeding direction of a sheet to perform printing to the sheet with a recording head mounted on the carriage. The apparatus is provided with a gap adjustment mechanism for automatically switching a gap between the sheet and the recording head. The computer program includes a reciprocating movement program for accelerating the carriage in one direction into a constant speed state, decelerating the carriage after the constant speed state of a short time, and decelerating the carriage after accelerating it in the opposite direction into the constant speed state again, thereby repeatedly reversing and reciprocating the carriage. The program moves the carriage to a switching position of the gap located outside a reciprocating movement portion of the carriage. A carriage movement control program moves the carriage to the switching position of the gap based upon the reciprocating movement program during feeding of a sheet.

According to such a computer program, by operating the CPU based upon the computer program, the carriage is moved to the switching position of the gap at the time of feeding of a sheet in order to automatically switch the gap. Therefore, sheet feeding is not delayed due to the switching of the gap. And high-speed printing can be performed easily.

BRIEF DESCRIPTION OF THE DRAWINGS

FIG. 4A is a schematic plan view showing various stop points and the lateral movement area of the carriage in the first embodiment.

FIG. 4B is a schematic front view showing the various stop points and the lateral movement area of the carriage in the first embodiment.

BEST MODE FOR CARRYING OUT THE INVENTION

Next, an image forming apparatus according to a first embodiment of the present invention will be described based upon FIGS. 1 to 26. This image forming apparatus is a multifunction facsimile/printer apparatus.

Outline of the Multifunction Facsimile/Printer Apparatus

Figure 1:
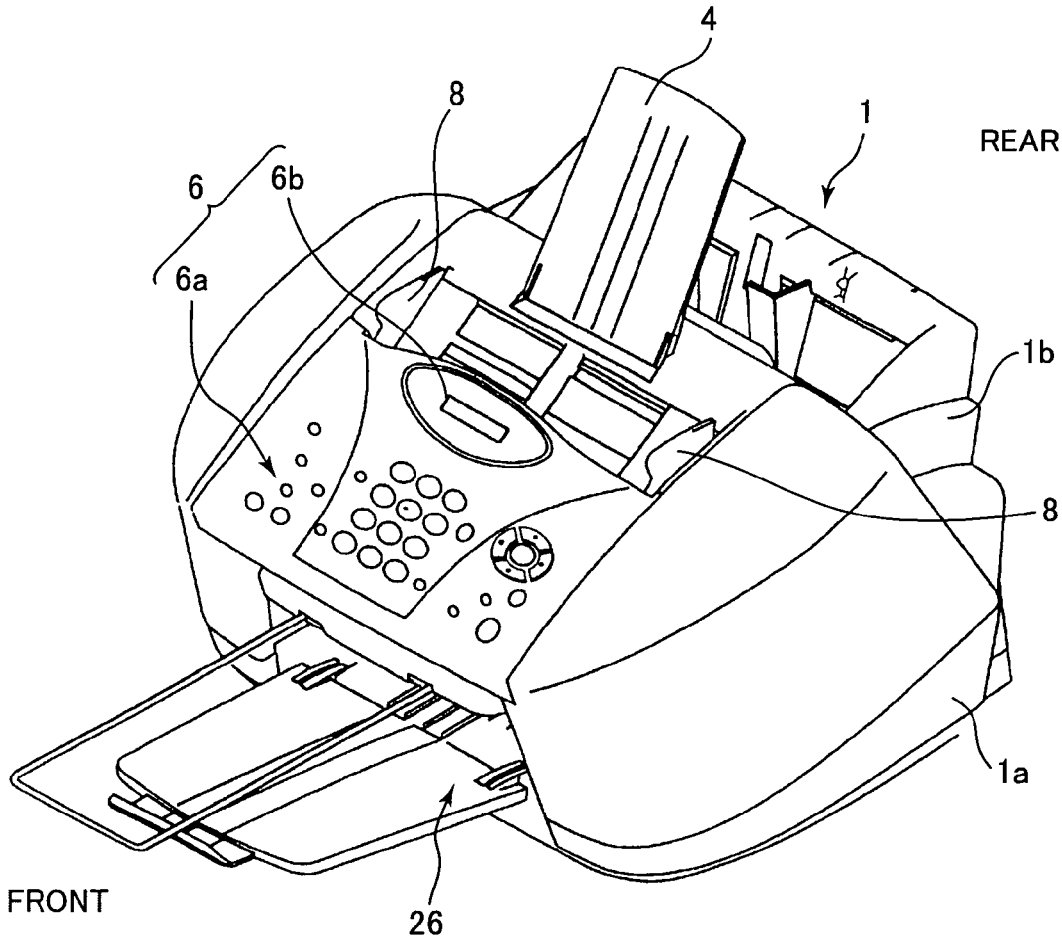
FIG. 1 is an external perspective view showing a multifunction facsimile/printer apparatus according to a first embodiment of the present invention.

As shown in FIG. 1, in the multifunction facsimile/printer apparatus, a main body case 1 is constituted by a main lower case 1*a* made of synthetic resin and an upper case 1*b* made of synthetic resin covering an upper side of the main lower case 1*a*. The main lower case 1*a* receives an ink jet recording portion 2 (FIG. 2) and is provided with a sheet supply tray 3 (FIG. 2) for supplying a sheet P on which an image is formed. The tray 3 is inclined and positioned at a rear upper side of the main lower case 1*a*. An original mounting portion 4 is positioned in a part close to the rear of the upper case 1*b*. In that part, a pair of left and right original guide plates 8 are mounted which laterally slides in accordance with a width of an original to guide both the left and right side edges of the original to be conveyed. In addition, an operation panel portion 6 is provided on a front side of the original mounting portion 4 in the upper case 1*b*. The operation panel portion 6 is provided with an operation key portion 6*a* including various function keys, ten keys, and the like, and a display portion 6*b* such as a liquid crystal panel on which a value inputted by the operation key portion 6*a* and various characters and numbers for operations can be displayed. A sheet discharge tray 26 for receiving a printed sheet is provided on a front side of the main body case 1.

Figure 2:
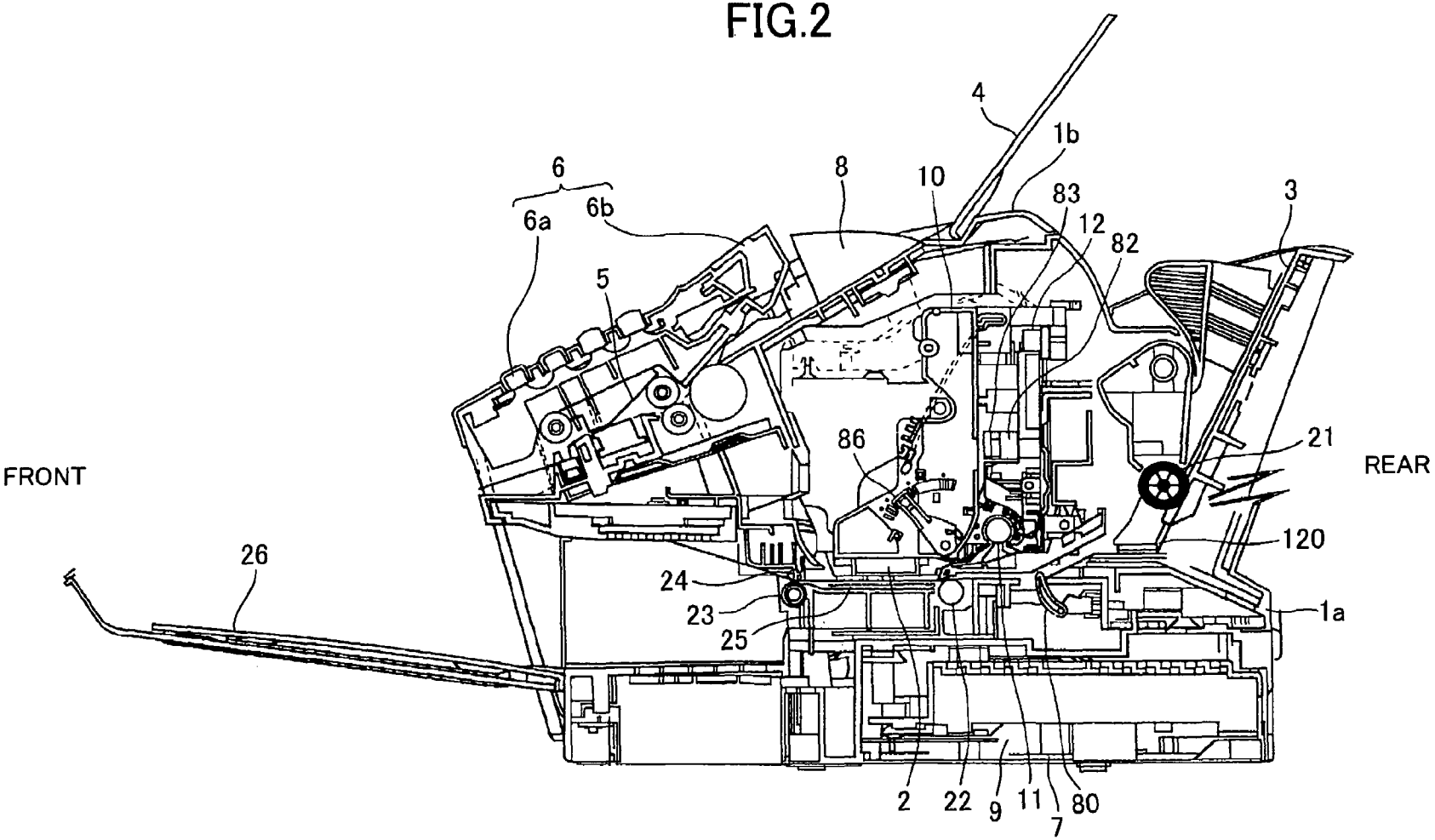
FIG. 2 is a schematic side sectional view showing an inside of the printer apparatus.

In FIG. 2, an original reading unit (reading portion) 5 serving as an original reading portion is mounted below the operation panel portion 6. A bottom surface of the main lower case 1*a* is blocked by a bottom cover plate 7 made of a metal plate or the like. In an internal space of the main lower case 1*a*, there is positioned a control portion 9 (FIG. 24) for a control substrate, a power supply substrate, and a Network Control Unit (NCU) substrate for allowing conversation or transmission and reception of facsimile data with other telephone sets or facsimile apparatuses via a telephone line, which are not illustrated.

Moreover, although not illustrated, a transmitter/receiver (handset) for performing conversation with other telephone sets is mounted on a cradle protrudingly provided outward so as to protrude from a side of the main lower case 1*a*. In addition, speakers for call-out and monitor are fixed to a rear side or the like of a right side in the main lower case 1*a*.

An ink jet printer is roughly divided into a mechanism for conveying a sheet (not shown) and a mechanism for performing printing on the sheet. The sheet conveying mechanism is constituted by the sheet supply tray 3 serving as a sheet set portion, a sheet supply roller 21, a sheet separation piece 120, a sheet sensor 80, a registration roller 22, conveying rollers 23 and 24, and a sheet discharge tray 26 which are positioned along a sheet conveying path, as well as a not-shown feed motor for driving the respective rollers 21, 22, and 23. The printing mechanism is constituted by a carriage 10 reciprocatingly moving substantially perpendicular to a feeding direction of a sheet, a recording head 15 provided below the carriage 10, a platen 25 positioned to be opposed to the recording head 15, a guide shaft 11 and a frame 12 which support the carriage 10, a linear encoder 82 and an encoder slit 83 for detecting a moving position of the carriage, as well as a DC motor for reciprocatingly moving the carriage 10, an ink tank mounted on the carriage 10, and the like, which are not illustrated.

On the sheet supply tray 3, a large number of sheets are stacked and are brought into a standby state for being fed in a posture in which a leading edge of each sheet abuts against the sheet separation piece 120. When the sheet supply roller 21 rotates in the clockwise direction, one sheet contacting the sheet supply roller 21 is separated from the sheet separation piece 120 and fed into the printer and a leading edge of the sheet abuts against the sheet sensor 80 before long, whereby a position of the sheet is detected. Then, when the sheet is fed by a predetermined amount, a leading edge of the sheet reaches the registration roller 22 and a direction of the sheet is adjusted. When the sheet further moves, it is brought into a state in which it is nipped between the registration roller 22 and the conveying roller 23, whereby the sheet supplying operation ends.

Thereafter, printing is performed on the sheet nipped by the registration roller 22 and the conveying roller 23 via the recording head 15. At the time of the print operation, the sheet is fed by a fixed width via the registration roller 22 and the conveying roller 23 every time printing of the fixed width is finished. When a trailing edge of the sheet reaches a predetermined position, a sheet discharge operation is started and the entire sheet finally reaches the sheet discharge tray 26 via the conveying roller 23, whereby the sheet discharge operation ends.

Figures 3A, 3B:
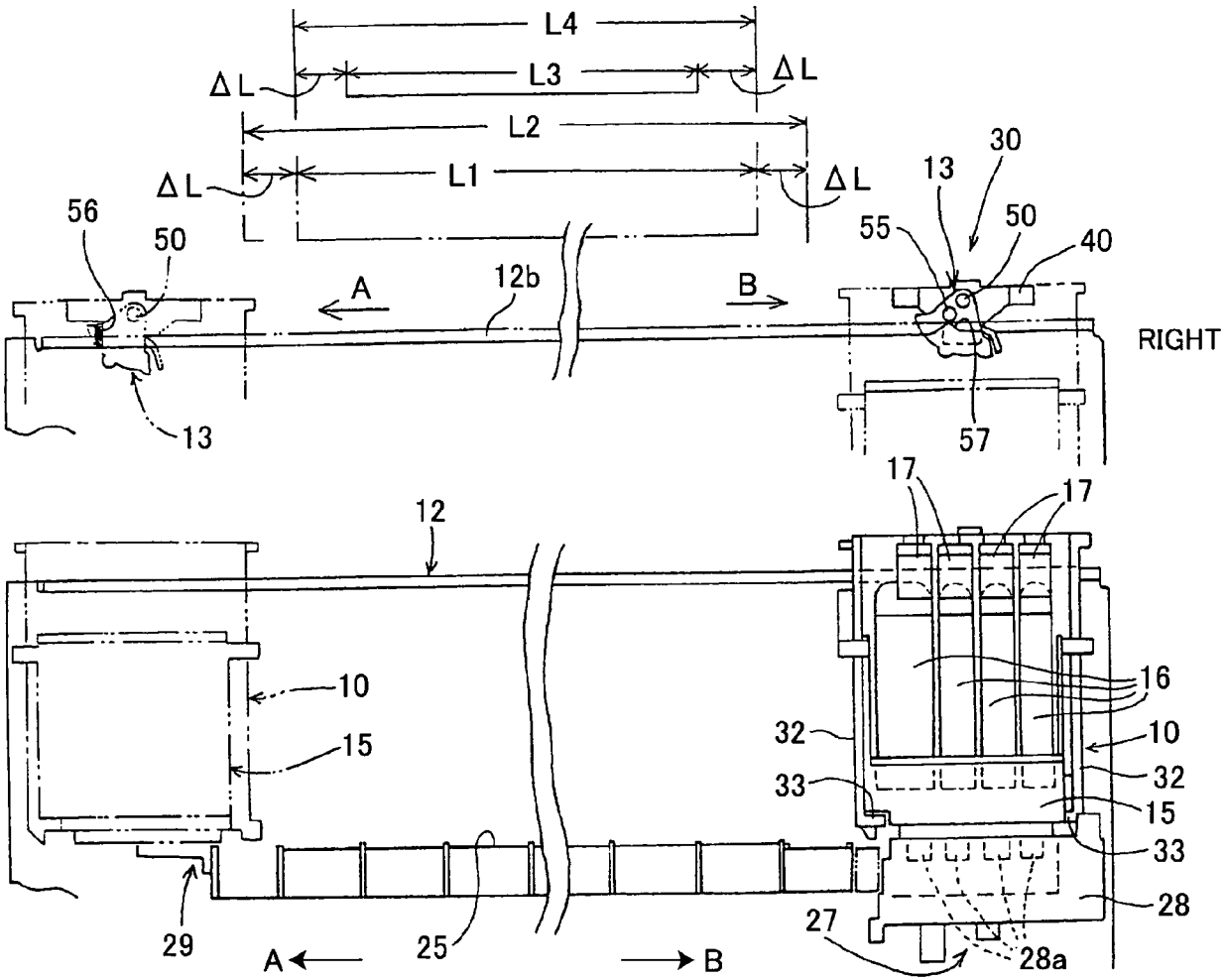
FIG. 3A is a schematic plan view showing a lateral movement area of a carriage with respect to a frame in the first embodiment.
FIG. 3B is a schematic front view showing the lateral movement area of the carriage with respect to the frame in the first embodiment.
Figure 6:
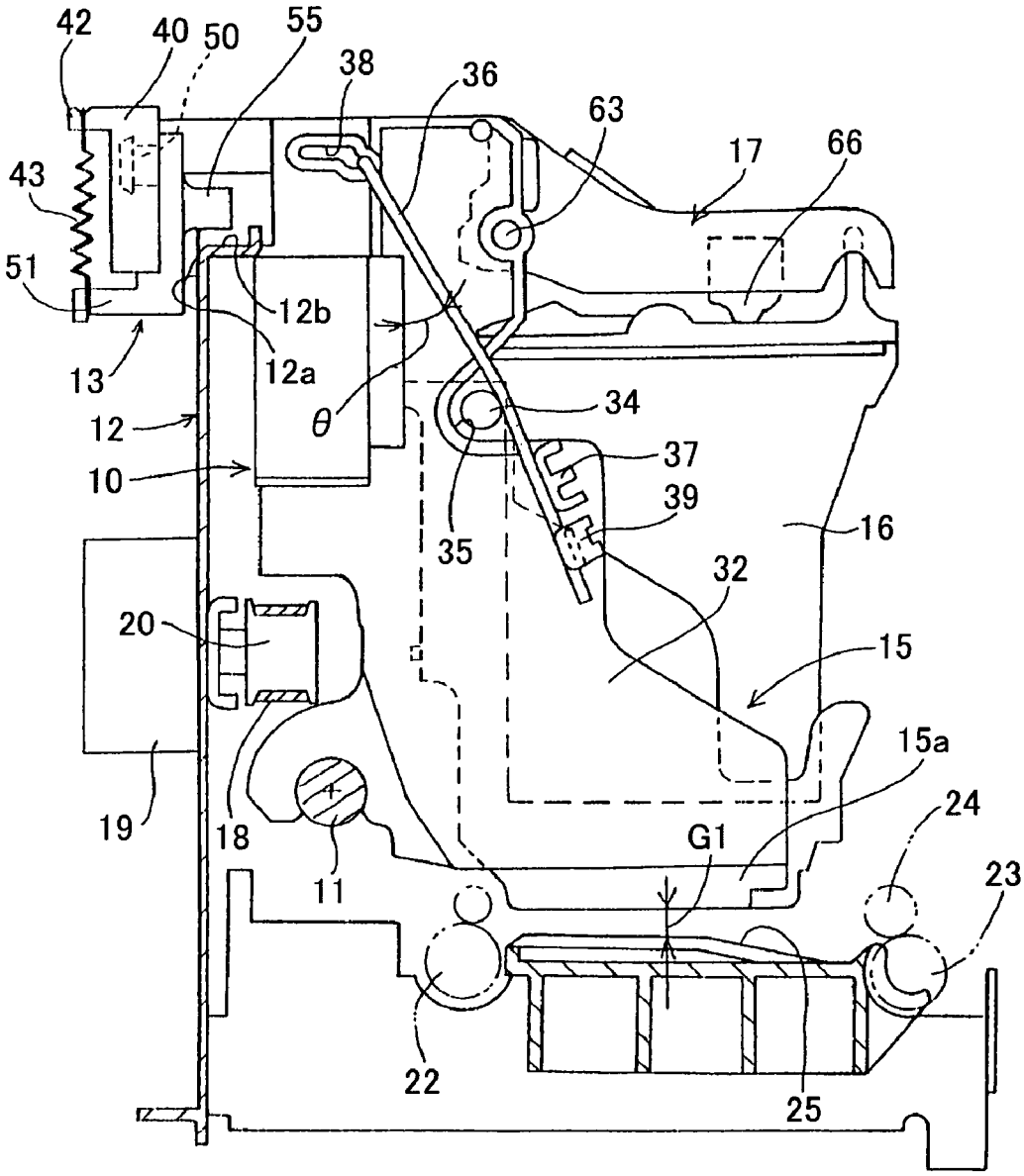
FIG. 6 is a side sectional view of a recording portion showing a posture of the recording portion in a state in which the gap between the tip end surface of the recording portion and the platen is large in the first embodiment.

A lower rear end of the carriage 10 in the recording portion 2 is slidably and pivotably mounted on the guide shaft 11 of a round shaft shape on a surface (front) side of a lower part of the horizontally oblong frame 12 (FIG. 3B). Further, the carriage 10 reciprocatingly moves along a direction penetrating a sheet surface of FIG. 2. As shown in FIG. 6, a timing belt 18 extending in parallel with the guide shaft 11 is wound around a driven pulley (not shown) positioned close to one side of the frame 12 and a driving pulley 20 fixed to an output shaft of a drive motor 19 such as a reversible stepping motor, and a portion of the timing belt 18 is coupled to the carriage 10, whereby the carriage 10 is provided reciprocatingly movable in parallel with the guide shaft 11. While the carriage 10 is reciprocatingly moving once, ink is injected from the recording head 15 and a print operation is performed. However, there are also a two-way printing for performing printing twice in forward and backward movements while a carriage is reciprocatingly moving once, and a one-way printing for performing printing only in one direction of forward movement or backward movement. In any case, the print operation is performed while the carriage 10 is moving at a constant speed in a state in which a sheet is temporarily stopped without being fed. Therefore, feeding of a sheet is basically performed when the carriage 10 turns around (reverses) in the middle of the reciprocating movement. A position of the carriage 10 reciprocatingly moving in this way is detected as the linear encoder 82 integrally formed with the carriage 10 optically reads the encoder slit 83 fixed along a reciprocating movement path.

The Carriage and the Recording Head

Figure 5:
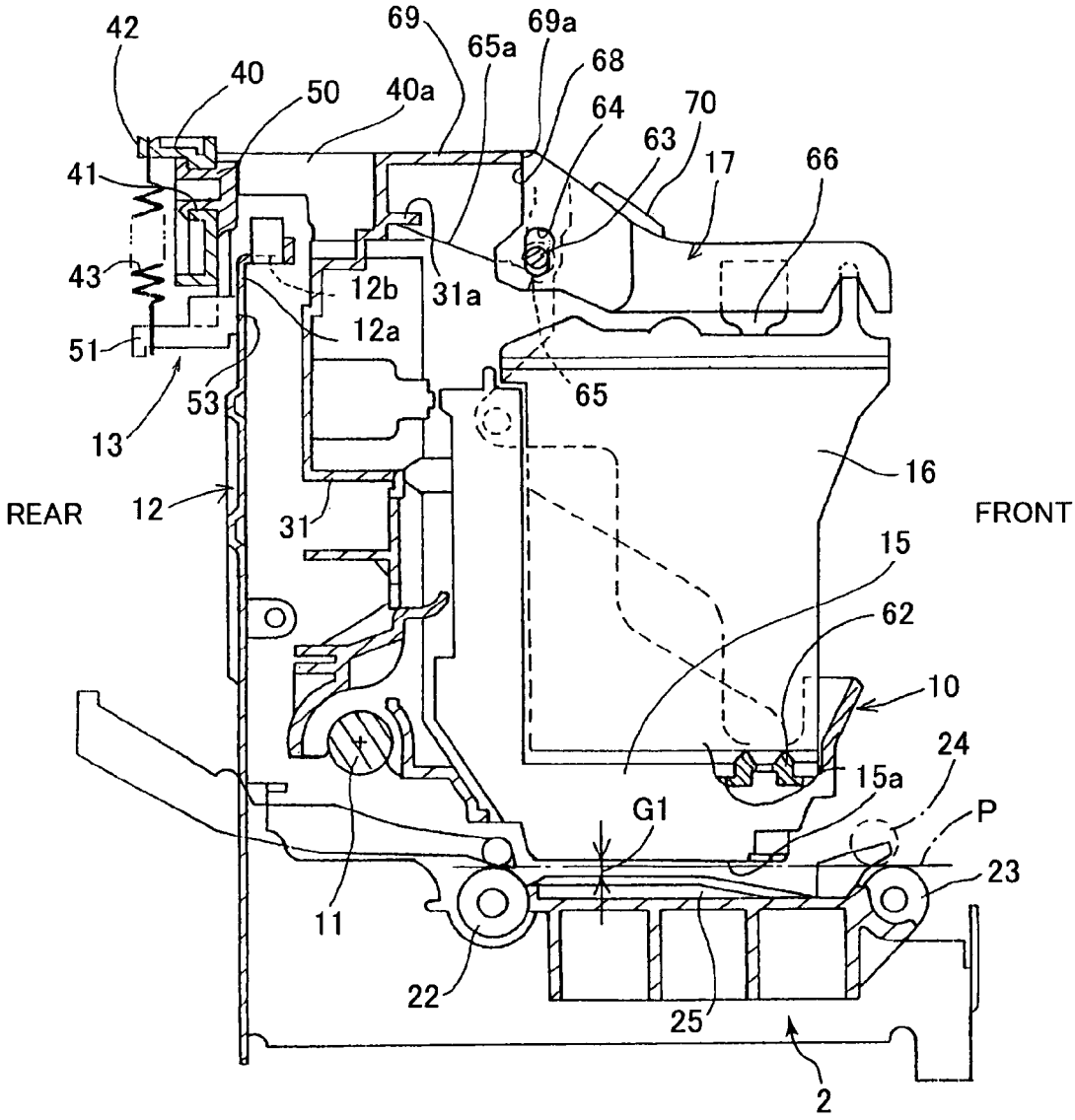
FIG. 5 is a side sectional view of a recording portion showing a posture of the recording portion in a state in which a gap between a tip end surface of the recording portion and a platen is small in the first embodiment.

In the carriage 10, left and right side plates 32 (FIG. 3B) are projected forward from both left and right sides of a rear plate 31 (FIG. 5). In lower ends of the respective side plates 32, supporting portions 33 for supporting left and right sides of a bottom plate of the recording head 15 are provided so as to protrude inward. A nozzle portion 15*a* of the recording head 15 is positioned so as to be exposed downward between both the supporting portions 33. Engaging pins 34 (see FIGS. 7 and 8) projected outward from both the left and right side of the recording head 15, which is positioned between the left and right side plates 32, are positioned in recessed portions 35 (FIG. 6) recessed in the left and right side plates 32. The parts of the respective engaging pins 34 are pressed obliquely downward in a halfway part in a longitudinal direction of wire springs 36 (only one of them is shown in FIG. 6) made of a metal or the like having elasticity, which are pivotably attached to attaching holes 38 (FIG. 6) on upper end sides outside the left and right side plates 32. On the other hand, lower end sides (free end sides) of the respective wire springs 36 are locked so as to not to move upward by first locking portions 37 which are formed outside the side plates 32 so as to protrude therefrom. Moreover, the free end sides of the respective wire springs 36 are prevented from coming off to the outside of the side plates 32 by second locking portion 39 of a hook shape formed obliquely downward. In this way, the recording head 15 is mounted firmly to the carriage 10 so as not to wobble.

On the other hand, the recording head unit 15 is a color ink jet recording head of a cartridge type and is detachably mounted downward to the carriage 10. The recording head 15 for executing color recording has four nozzle portions 15*a* for discharging inks of colors of cyan, yellow, magenta, and black on its lower surface side. Ink cartridges 16 for the respective colors in which inks to be supplied to the recording head 15 can be detachably mounted on an upper surface side of the recording head 15 as shown in FIG. 3B. The respective ink cartridges 16 can be pressed and fixed downward to the recording head 15 by pressing levers 17 which are vertically pivotable forward on the upper end side of the carriage 10.

Figure 7:
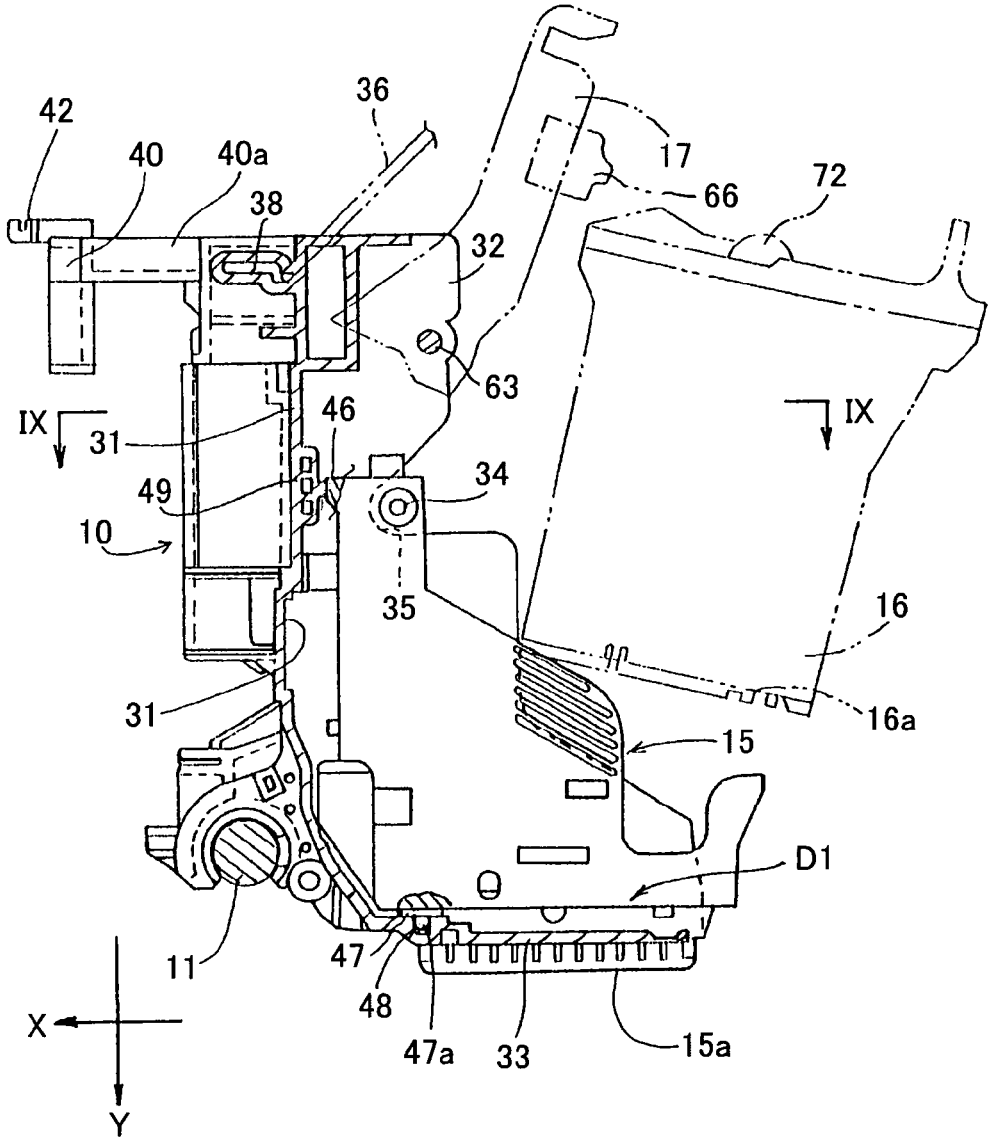
FIG. 7 is a side sectional view of the carriage mounted with a recording head in the first embodiment and shows a state before mounting an ink cartridge.
Figure 8:
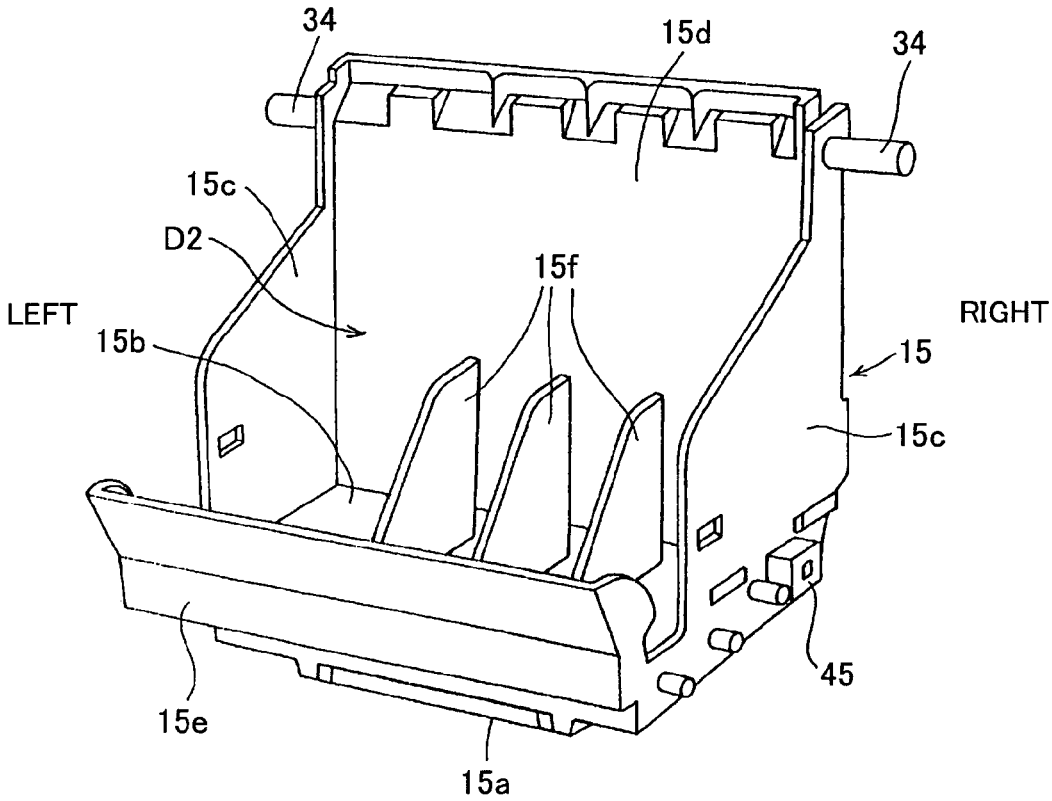
FIG. 8 is a perspective view of a recording head unit in the first embodiment.
Figure 9:
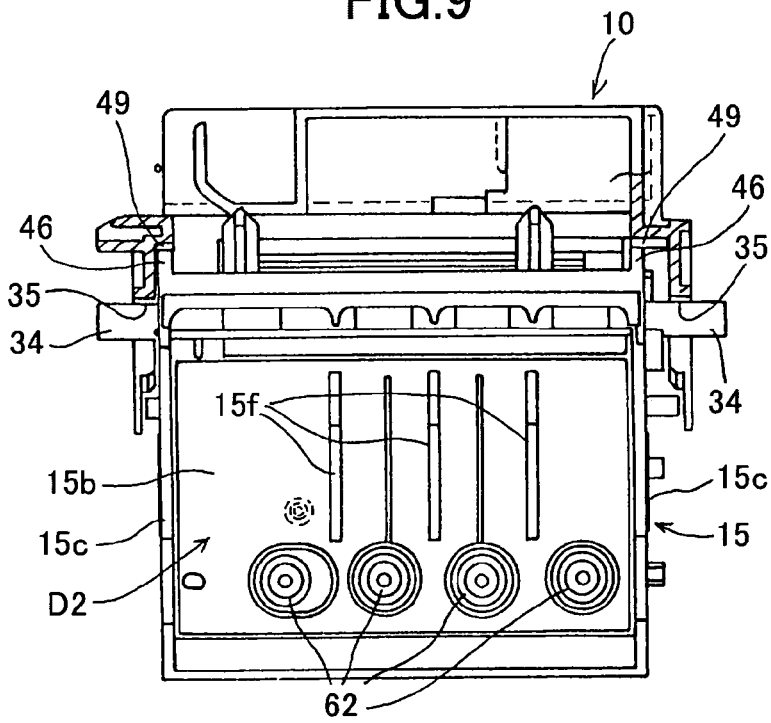
FIG. 9 is a cross-sectional view taken along the line IX-IX of FIG. 12.

As shown in FIGS. 8 and 9, the nozzle portions 15*a* are provided on a lower surface side of a bottom plate 15*b*, and the inside surrounded by the bottom plate 15*b*, left and right side plates 15*c* and 15*c*, a rear plate 15*d*, and a front plate 15*e* constitutes an upward opening ink cartridge receiving portion D2 for receiving the ink cartridges 16. Further, in this ink cartridge receiving portion D2, four manifold ports 62 which fit in ink discharge ports 16*a* (see FIGS. 7 and 14) on the lower surfaces of the ink cartridges 16 of four colors are opened upward on the upper surface of the bottom plate 15*b*. In addition, partition plates 15*f* are vertically provided such that the ink cartridges 16 of respective colors can be partitioned from each other.

On external surfaces of the left and right side plates 15*c* and 15*c* of the recording head unit 15, the engaging pins 34 and 34 (see FIG. 8) as an example of portions to be pressed are projected sideways in portions close to the top of the recording head unit 15. In addition, an abutment block 45 protrudes from an external surface close to the lower part of the right side plate 15*c*. The abutment block 45 is adapted to abut against a cam 44*a* (see FIG. 13) in an inclination adjustment mechanism 44 provided on the carriage side 10 for adjusting left and right inclinations of the recording head unit 15.

Figure 13:
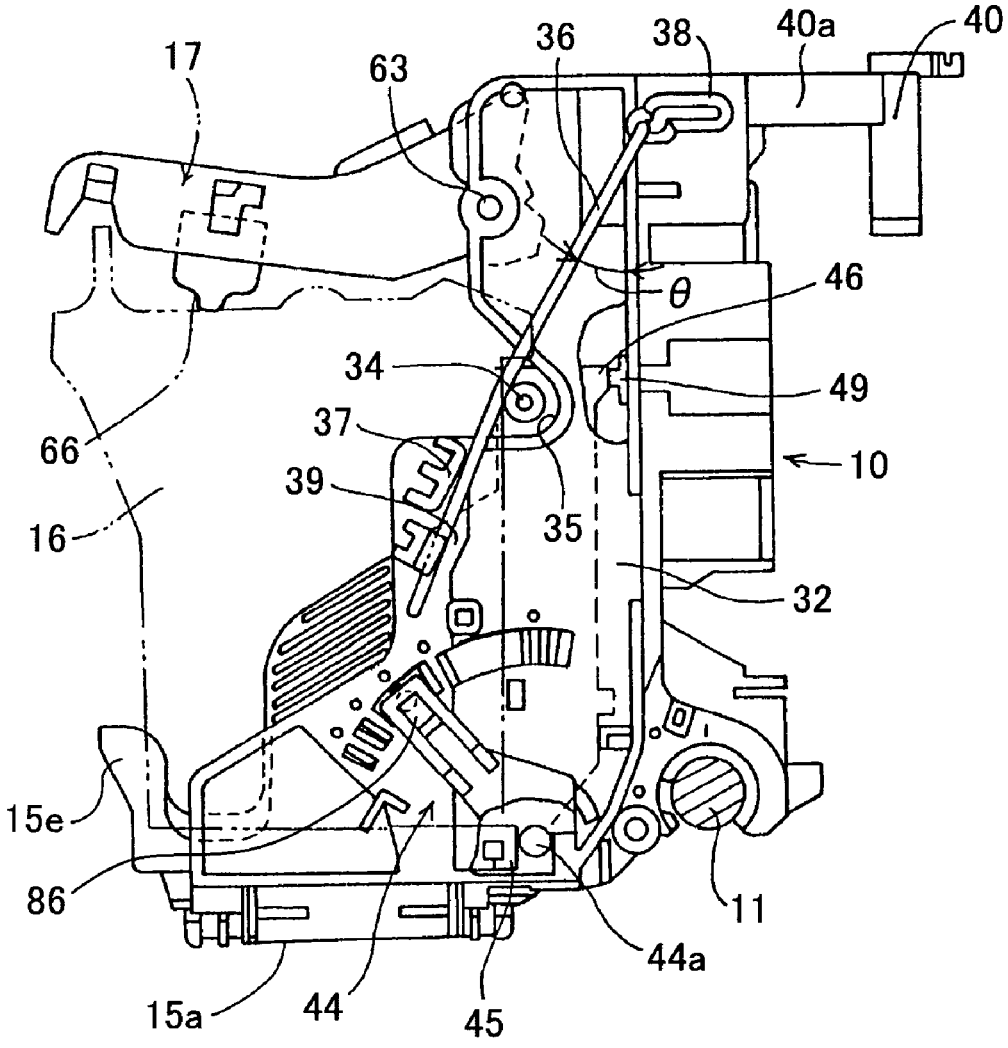
FIG. 13 is a right side view of the carriage mounted with the recording head unit in the first embodiment.
Figure 14:
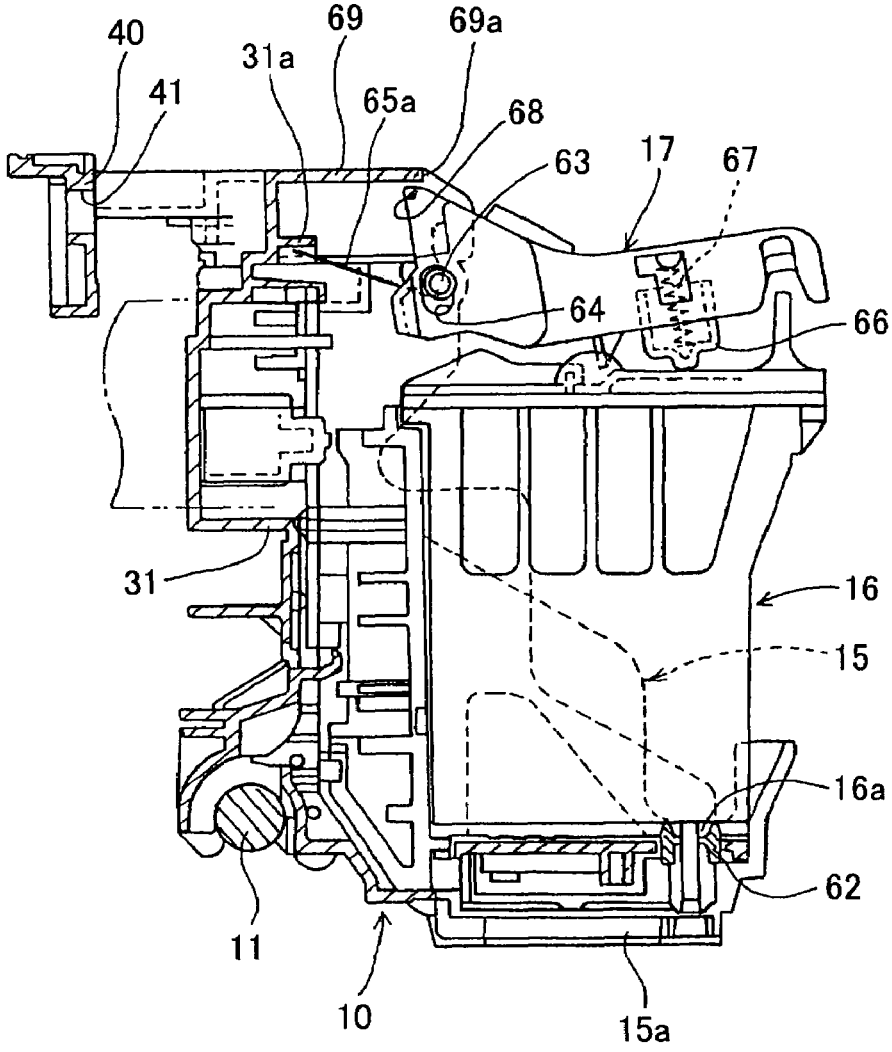
FIG. 14 is a side sectional view of the carriage showing a state before fixing the ink cartridge in the first embodiment.
Figure 15A:
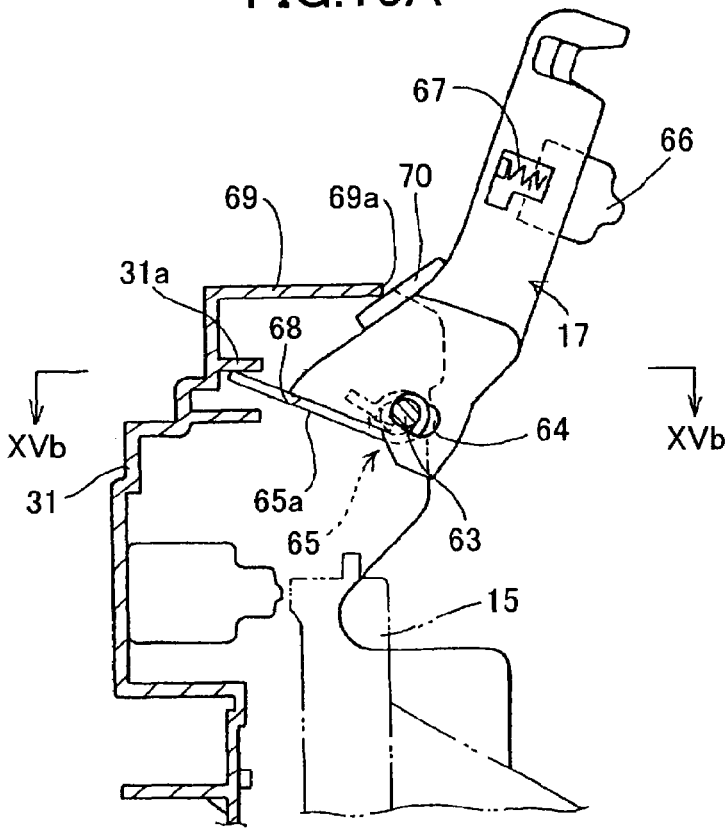
FIG. 15A is a side view showing a state in which a pressing lever of the carriage is wide open in the first embodiment.
Figure 15B:
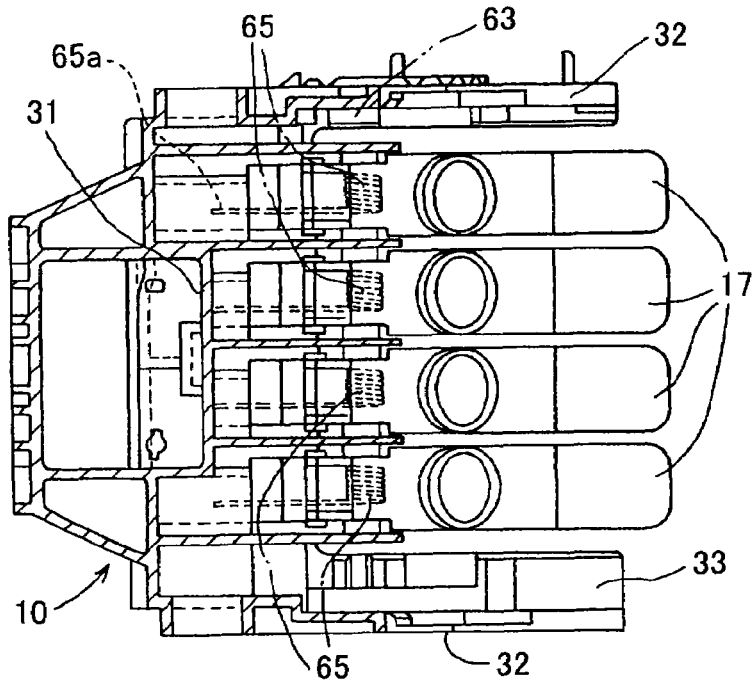
FIG. 15B is a view in an arrow XVb-XVb direction of FIG. 15A.

Moreover, abutment projections 46 and 46 projecting backward are formed in portions close to the upper end on both the left and right sides of the rear plate 15*d* (see FIGS. 7, 9, and 13). Further, on both the left and right sides of the bottom plate 15*b* of the recording head unit 15, bottom abutment portions 47 projecting downward are provided integrally, and a positioning projected portion 47*a* projecting downward is provided in one (left) bottom abutment portion 47.

Figure 12:
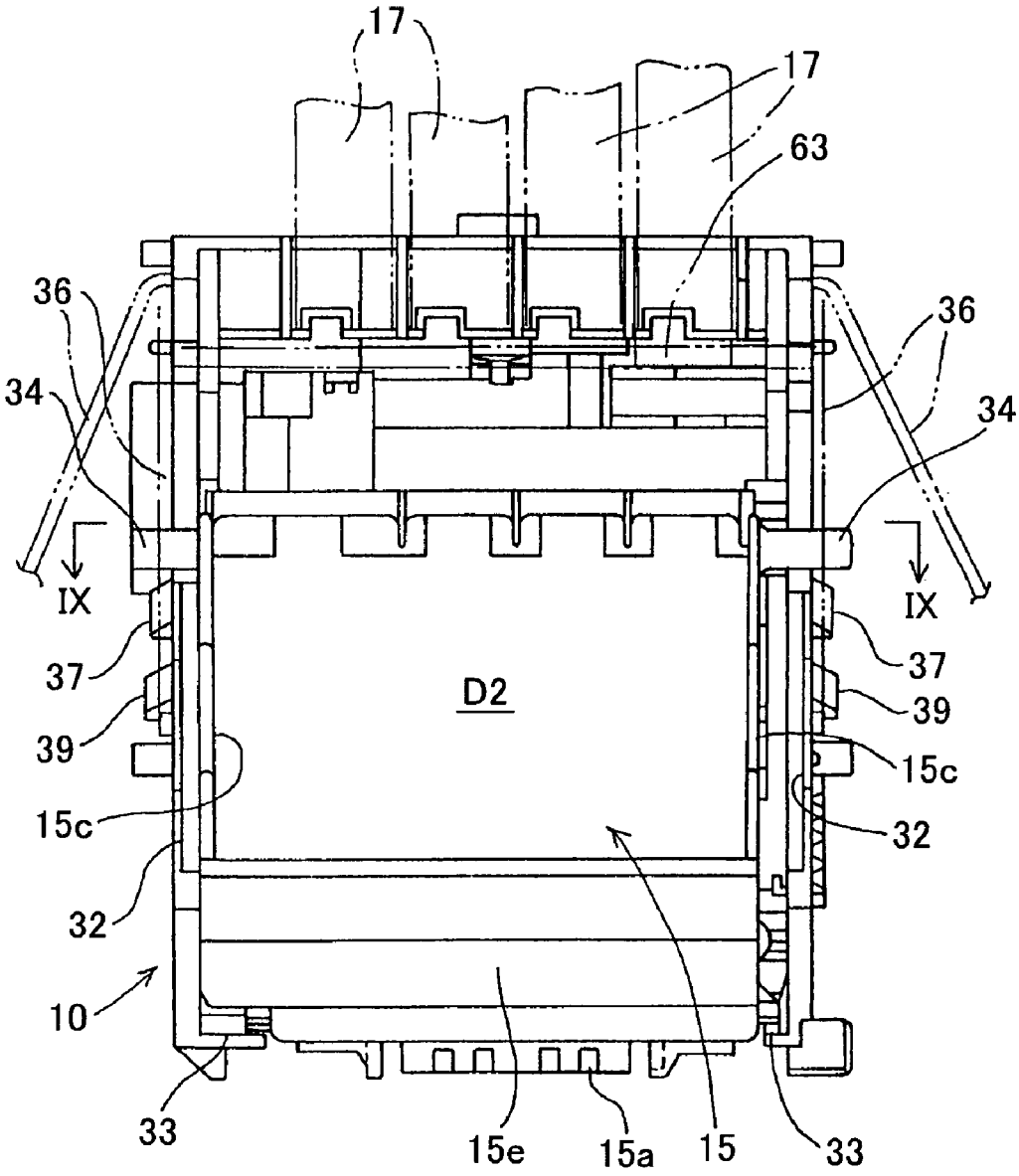
FIG. 12 is a front view of the carriage mounted with the recording head unit in the first embodiment.

In order to accurately perform positioning and firmly fix the recording head unit 15 positioned in an upward opening head receiving portion D1 in the carriage 10, first, as shown in FIGS. 7 and 12, the engaging pins 34 and 34 as an example of a portion to be pressed, which is projected outward from both the left and right sides of the recording head unit 15, are positioned in the recessed portions 35 which are recessed and formed in the left and right side plates 32 and 32 in the carriage 10. Then, the bottom abutment portions 47 are placed and mounted on the bottom supporting portions 33 and 33 on the bottom portions on both the left and right sides of the carriage 10 and, at the same time, the positioning projected portion 47*a* is fit in a receiving groove 48 (see FIG. 7), which is recessed and formed in one (left) bottom supporting portion 33, and supported. In this state, the respective engaging pin 34 are pressed obliquely downward by the halfway part in the longitudinal direction of the wire springs 36 (the left side wire spring shown in FIG. 5 and the right side wire spring shown in FIG. 13) pivotably attached to the attachment holes 38 on the upper end side on the outer side of the left and right side plates 32 and 32.

On the other hand, the lower ends sides (free end sides) of the respective wire springs 36 are locked so as not to move upward by the first locking portions 37 which protrude outwardly from the side plates 32. Moreover, the free end sides of the respective wire springs 36 are prevented from coming off to the outside of the side plates 32 by second locking portion 39 of a hook shape formed obliquely downward.

If the wire springs 36 are locked in this way, as shown in FIGS. 5 and 13, the engaging pins 34 of the recording head unit 15 are pressed in an oblique direction toward the rear side of the carriage 10 at the middle of the respective wire springs 36 extending obliquely downward, whereby the abutment projections 46 and 46 are pressed substantially in the horizontal direction to abut against projection shaped supporting portions (abutment surfaces) 49 and 49 in the rear plate 31 of the carriage 10 by an X component of force (in X direction (horizontal direction of FIG. 7)) of the pressing force (see FIGS. 9 and 13) and, at the same time, the abutment block 45 presses the cam 44*a* (see FIG. 13). On the other hand, a downward force from the bottom abutment portions 47 can be supported on the bottom supporting portions 33 and 33 on both the left and right sides of the carriage 10 by a Y component of force in a Y direction (vertical direction in FIG. 7). Then, the X component of force can be designed to be larger than the Y component of force by setting an inclination angle θ of the wire springs 36 with respect to a vertical line to 45 degrees or more.

Consequently, a pressing force of the recording head unit 15 against the rear supporting portions 49 of the carriage 10 is made larger than its pressing force in the direction toward the bottom supporting portions 33 to ensure close attachment of the recording head unit 15 to the rear plate 31 with high rigidity in the carriage, and it is unnecessary to make the rigidity of the bottom supporting portions 33 large. Moreover, the recording head unit 15 can be mounted on the carriage 10 firmly so as not to wobble, and posturing and positioning of the recording head unit 15 become easy. Furthermore, since the head receiving portion D1 is opened largely with respect to the front side of the carriage 10 (and consequently the front side of the printer apparatus 1), attachment and detachment work of the recording head unit 15 from the front side of the printer apparatus 1 becomes extremely easy.

Next, a structure for attachment and detachment of the ink cartridges 16 will be described. As shown in FIGS. 5 to 7, 12, 15A, 15B, 16A, and 16B, on the upper end side of the left and right side plates 32 and 32 in the carriage 10, a pivotably supporting shaft 63 is laid and suspended, and base end of the pressing lever 17 for pressing the upper surface of each ink cartridge 16 individually is pivotably supported by the pivotably supporting shaft 63 via mounting holes 64 of a downward potbelly shape. A diameter of a lower side of the mounting holes 64 is set to be substantially equal to a diameter of the pivotably supporting shaft 63, and a diameter of an upper side of the mounting holes 64 is set to be approximately 1.5 times as large as the diameter of the pivotably supporting shaft 63. Further, one end 65*a* of a torsion spring 65 loosely fitted to the pivotally supporting shaft 63 is locked by an upper locking portion 31*a* of the rear plate 31 in the carriage 10 and is always biased in an upward pivotal direction (see FIGS. 5, 15A, and 16A)).

A pressing block 66 for pressing the upper surface in each ink cartridge 16 downward is mounted on a portion close to a free end on a lower surface of each pressing lever 17. The lower surface of the pressing lever 17 is formed with a downward C-shape recess in its cross-section, and the pressing block 66 is movable vertically and is unable to drop. Further, the pressing block 66 is biased downward via a biasing spring 67 positioned between a top board of the pressing lever 17 and the pressing block 66. Further, a pressing point of the ink cartridge 16 pressed by this pressing block 66, i.e., a position of the pressing force in the Y direction, is set to be in the vicinity of a manifold port 62 in the recording head unit 15. Consequently, in a fixed state in which the recording head unit 15 is pressed in the XY direction of the carriage 10 by the wire spring 36, since the recording head unit 15 does not shift in the XY direction any more, the ink cartridge 16 can be mounted firmly without applying a large load of external force to the bottom supporting portions 33 and 33 of the carriage 10 by pressing the recording head unit 15 downward in the Y direction with the pressing levers 17 via the ink cartridge 16.

Figure 16A:
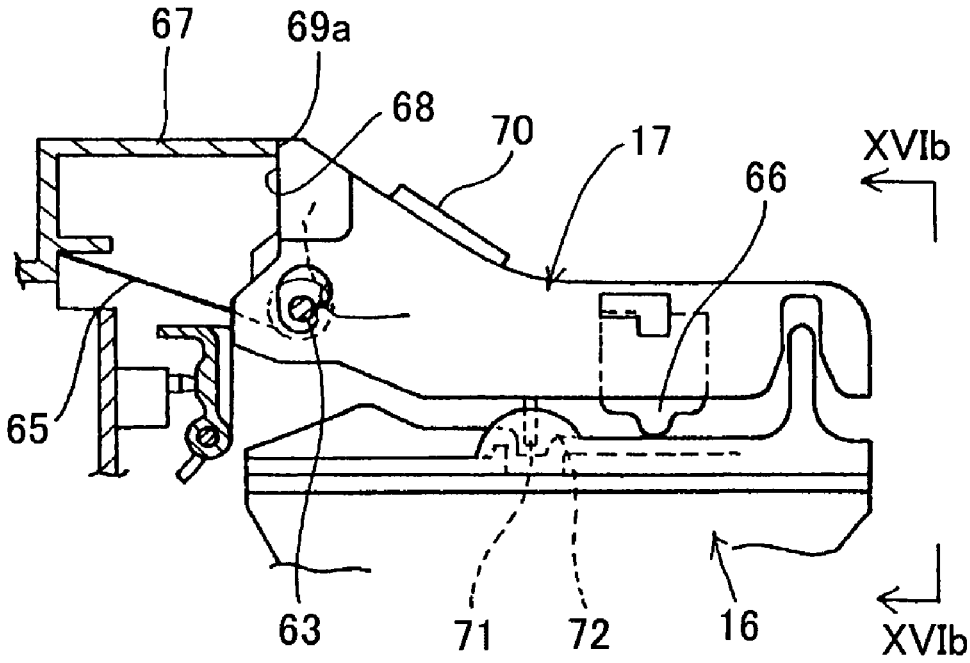
FIG. 16A is a side view showing a state in which the pressing lever is closed in the first embodiment.

Note that, since the pressing lever 17 is loosely fit with respect to the pivotably supporting shaft 63 via the mounting holes 64 which has a vertically oblong shape, when the upper portion on the opening end side of the pressing lever 17 is pushed downward, in a state in which the ink cartridge 16 is pressed by the pressing block 66 on the front side of the pressing lever 17, the base end side of the pressing lever 17 moves upward around the pressing point of the pressing block 66 with respect to the ink cartridge 16, and a vertical locking surface 68 of the pressing lever 17 locks a front end surface 69*a* in a top cover plate 69 of the carriage 10 and the posture of the pressing lever 17 is held (see FIGS. 5 and 16A). When an operating portion 70 close to the base end on the upper surface of the pressing lever 17 is pressed downward in order to release pressing with respect to the ink cartridge 16, the base end side in the pressing lever 17 moves downward via the mounting holes 64. When the locking surface 68 unlocks from the front end surface 69*a*, since the front side (free end side) of the pressing lever 17 can pivot largely upward because of the biasing force of the torsion spring 65, a large space is formed on the upper front side of the carriage 10, and attachment and detachment work of the ink cartridge 16 can be performed easily (see FIGS. 8 and 14). In that case, the operating portion 70 abuts against the front-end surface 69*a* and can hold the upward pivotal posture of the pressing lever 17 (see FIG. 15A).

Figure 16B:
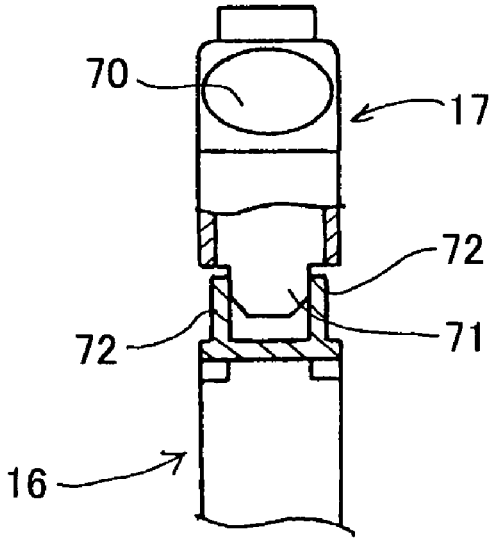
FIG. 16B is a partially cutout view in an arrow XVIb-XVIb direction of FIG. 16A.

Note that, as shown in FIG. 16B, since a regulating piece 71 is provided so as to protrude downward from each lower surface in the middle in the front and back direction of each pressing lever 17, the regulating piece 71 comes into slide contact with inner surfaces of upward side plates 72 and 72 on both the left and right sides on the upper surface of the ink cartridge 16 in a state in which the ink cartridge 16 is pressed by the pressing lever 17, whereby the ink cartridge 16 can be regulated so as to avoid its inclination in its lateral direction.

Figure 10:
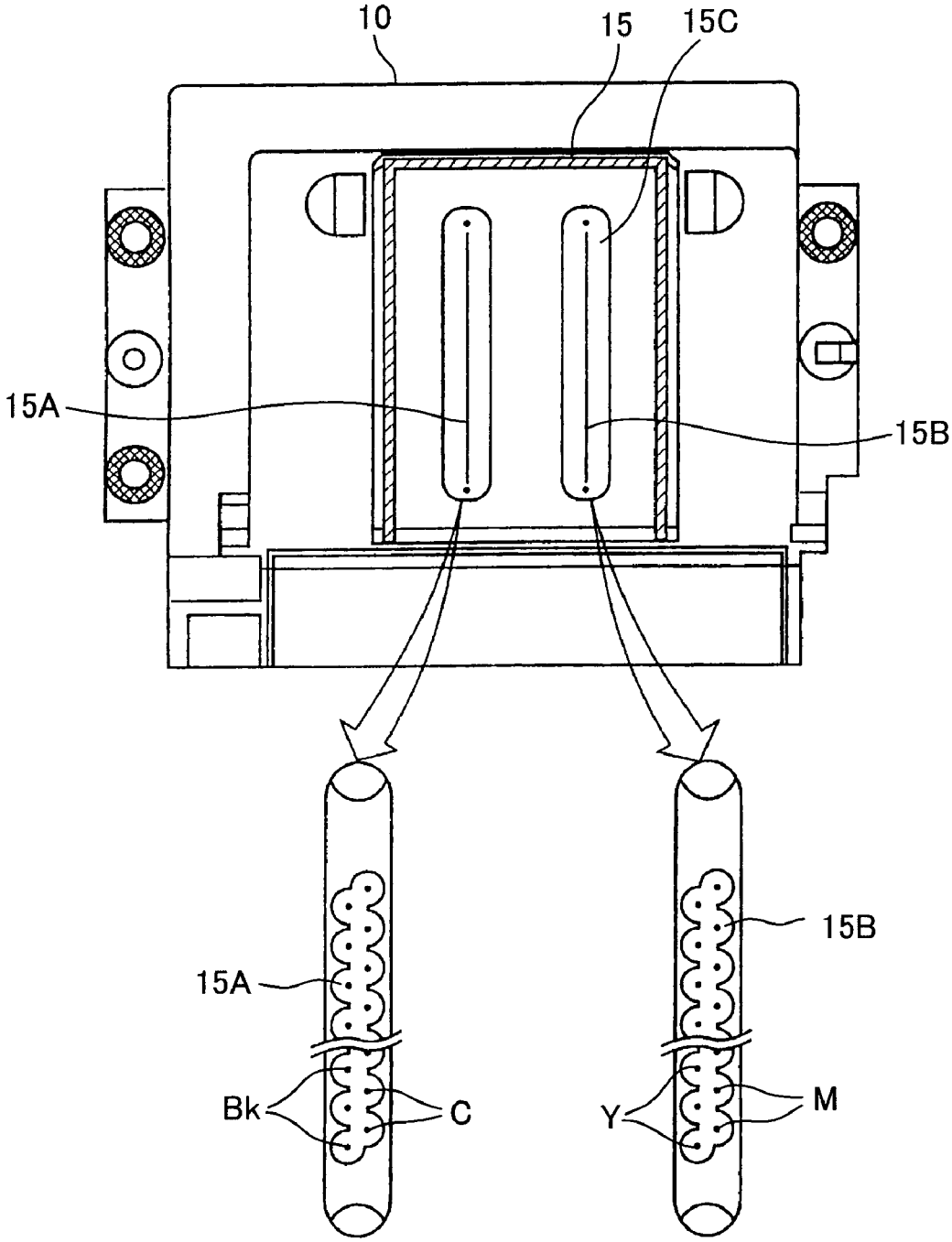
FIG. 10 is a bottom view showing a recording head in a lower part of the carriage in the first embodiment.

As shown in FIG. 13, an adjustment lever 86 is provided on a left surface side of the carriage 10. The adjustment lever 86 is adapted for manually positioning the recording head 15 provided in the lower part of the carriage 10 in a lateral direction (direction penetrating the paper surface of FIG. 13) and, as an example, adjustment positions of five stages are provided. In addition, as shown in FIG. 10, two row nozzle arrays 15A and 15B for injecting ink from an ink tank to a sheet side by an operation of a piezoelectric element or the like are provided in the recording head 15 in the lower part of the carriage 10. The ink tank is independent for each of four colors of black, cyan, yellow, and magenta, of which black and cyan are injected through one nozzle array 15A and yellow and magenta are injected through the other nozzle array 15B. That is, in the nozzle array 15A, nozzles Bk for black and nozzles C for cyan are positioned in zigzag in two rows as a pair along a conveying direction of a sheet and, in the nozzle array 15B, nozzles Y for yellow and nozzles M for magenta are positioned in zigzag in two rows as a pair along the conveying direction of a sheet in the same manner.

Figure 11:
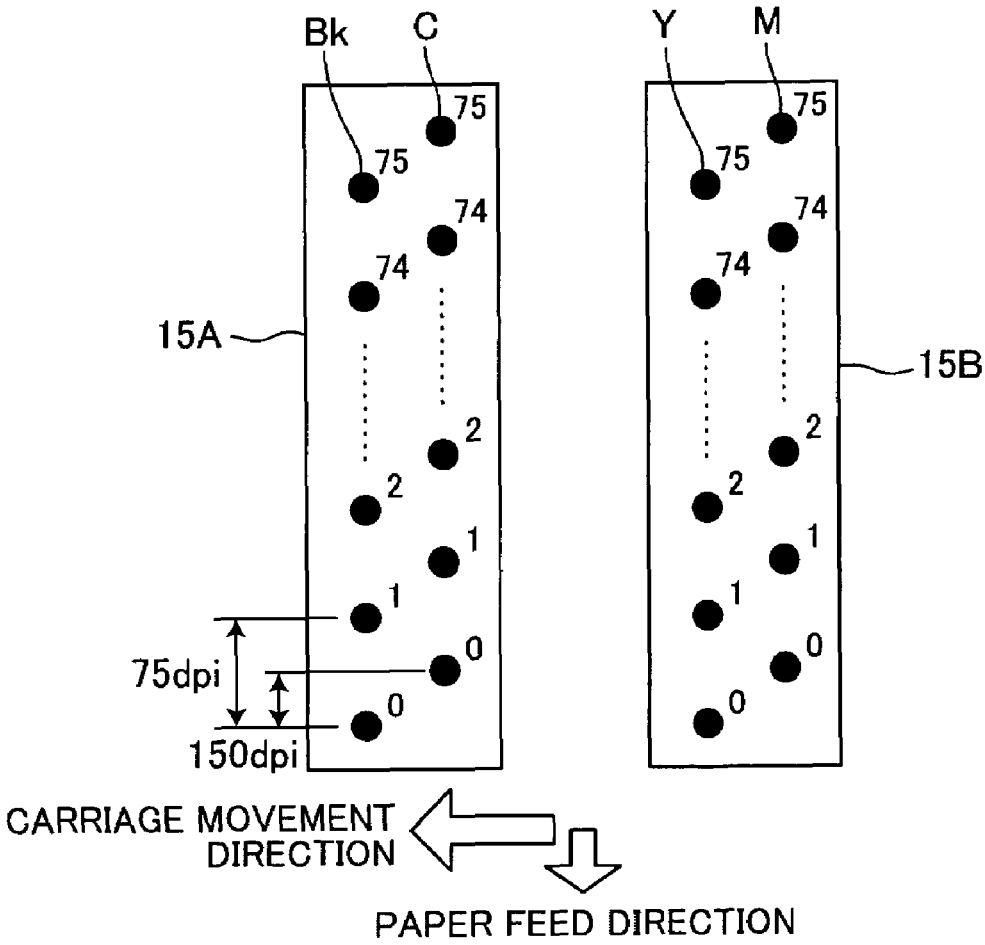
FIG. 11 is an explanatory view concerning an arrangement form of a nozzle array in the recording portion of the first embodiment.

FIG. 11 is an explanatory view for explaining an arrangement form of the nozzle arrays. As shown in FIGS. 10 and 11, for example, a pitch T of the nozzles Bk for black is approximately 1/75 inches, and an interval t along a vertical direction between the nozzles Bk for black and the nozzles C for cyan adjacent to each other is set to 1/150 inches. That is, the nozzles Bk for black and the nozzles C for cyan adjacent to each other are shifted by a half of the nozzle pitch T in a row direction, thereby being positioned in zigzag. The same is true on other nozzles. In addition, a total number of nozzles Bk, C, Y, and M is set to, for example, seventy-five. Consequently, a large printing width in one movement of the carriage 10 is secured, which contributes to speeding-up of printing significantly.

Reciprocating Movement of the Carriage

FIGS. 3A, 3B, and 4 are explanatory views for explaining movement of the carriage 10. In FIGS. 4A and 4B, the carriage 10 moves in a reciprocating movement portion following a print operation. This reciprocating movement portion is divided into a printing area in which the printing operation is performed by the recording head 15 while the carriage 10 is moving at a constant speed (constant speed portion L; L1 and L3 in FIG. 3) and acceleration and deceleration portions ΔL on both sides of the printing area in which the carriage 10 decelerates from a constant speed state and starts to accelerating in the opposite direction in order to reverse. In addition, in feeding and discharging sheets, sheets P are continuously conveyed. And, at this time, print surfaces of the sheets P are soiled if the sheets P are brought into contact with the nozzle portion of the recording head 15. Therefore, a position to which the carriage 10 is retracted at the time of sheet feed and sheet discharge (retract position at the time of sheet feed and sheet discharge) is set outside the reciprocating movement portion. In addition, outside the reciprocating movement portion, there are also set an ink empty sensor position for detecting a remaining amount of ink with a not-shown sensor, a flushing position for removing stains on the head with a flushing portion 29 to be described later, a head protection position (home position) for putting a rubber cap 28 on the head to protect it at non-operation time with a purge device 28 to be described later and where a purge operation can be performed, a small gap switching position for switching to a gap with a shorter distance between a sheet and the surface of the recording head 15, a large gap switching position for switching to a gap with a longer distance between a sheet and the surface of the recording head 15. Note that boundaries among the positions or the portions are determined with a nozzle position as a reference.

In FIGS. 3A and 3B, a maintenance portion 27 is provided in the vicinity of a movement end of the carriage 10 outside the recording area, for example, on the right side of the platen 25. In this maintenance portion 27, there are positioned a nozzle wiping device (wiper device) for wiping ink drops adhered to a surface (face) of the nozzle portion 15*a* of the recording head 15 and a purge device (nozzle suction device) 28 for restoring stop of discharge or discharge failure of ink in the recording head 15. In this purge device 28, the nozzle portion in the recording head 15 is covered by a suction cap 28*a*, and recording failure is removed by sucking inferior ink in the recording head 15 with a negative pressure generated by a not-shown pump. Note that the purge device 28 in the maintenance portion 27 also serves as a cap mechanism (protection device) which is in a home position at the movement end of the carriage 10 and covers all the nozzles 15*a* of the recording head 15 of the carriage 10 to prevent drying of ink. The suction cap 28*a* made from rubber also carries out a function of a protection cap. In addition, on the left end of the platen 25, there is provided the flushing portion 29 for experimentally discharging ink from the respective nozzle portions 15*a* of the recording head 15 to eliminate ink clogging.

L1 represents a recordable (printable) range of a plain paper, on which characters or the like can be printed on plain paper. Note that a range of L2 including the recordable (printable) range L1 therein is a range of carriage return in the case of printing on plain paper and is located on the left side of the large gap switching position. In other words, the large gap switching position is in a position on the right side of the right end position of L2, And, the home position (capping position) is in a position on the further right side of the large gap switching position. On the other hand, the flushing position is at least in a position on the left side of the left end position of the recordable range L1, and the small gap switching position is in a position on the left side of the flushing position and on the left side of the left end position of L2. In addition, L3 represents a recordable range where printing is performed on a thick medium such as an envelope, which is narrower than the recordable range L1 for plain paper and is set on the inner side of L1. For printing, the carriage 10 is constituted to be reciprocatingly movable in a range of L4 made by adding the acceleration and deceleration portions (ΔL) to both left and right sides of L3, respectively.

Gap Adjustment Mechanism

An adjustment mechanism 30 of a gap between the face of the recording head 15 and the sheet P will be described based on FIGS. 3 to 23B. A gap switching mechanism 14 for automatically switching the gap between the nozzle portion of the recording head 15 and the sheet P is provided in the carriage 10. In addition, projected portions (pushing pieces) 57 and 56 for abutting against the gap switching mechanism 14 due to the movement of the carriage 10 and causing this gap switching mechanism 14 to operate automatically are provided in a guide frame 12. For example, when the gap switching mechanism 14 abuts against one projected portion 57 to operate, the carriage 10 is brought into a posture slightly risen around a guide shaft 11, and the gap between the recording head 15 and the sheet P increases. On the other hand, when the gap switching mechanism 14 abuts against another projected portion 56 to operate, the nozzle surface of the recording head 15 is kept substantially horizontally, and the gap between the recording head 15 and the sheet P decreases. Such switching of a gap is performed for securing a gap between an object of printing and the recording head 15 to some extent while reducing it as much as possible according to the case in which printing is performed on an envelope or the like which is relatively thick, or the case in which printing is performed on plain paper which is thin. Therefore, the above-mentioned gap switching position for causing the gap switching mechanism 14 to abut against the projected portion 57 and 56 to switch a gap is set on the outer side of the retract position at the sheet feeding/sheet discharging time outside the reciprocating movement portion.

Figure 17A:
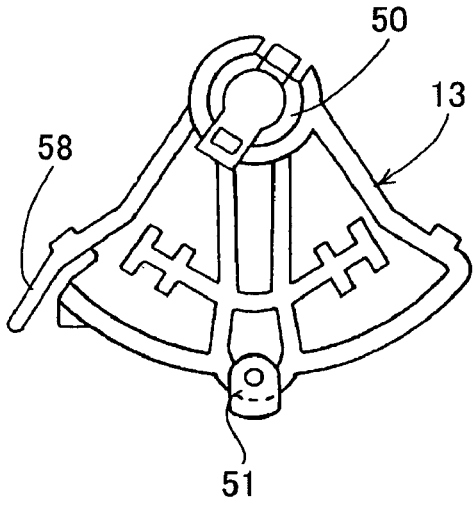
FIG. 17A is a rear view of a switching block member according to the first embodiment.

A bracket portion 40 facing rearward and downward is integrally formed on the upper end side of the rear plate 31 in the carriage 10 via a pair of left and right bracket coupling portions 40*a*. A switching block member 13 made of synthetic resin to be pivotably mounted on the bracket portion 40 is formed in a fan shape viewed from the front (viewed from the back) as shown in FIG. 17A which is a back view and FIG. 17B which is a front view. A backward pivotal shaft 50 on the upper end is pivotably fitted in a support hole 41 (FIG. 5) drilled in the bracket portion 40. A spring lower attachment portion 51 provided backward so as to protrude in the central part at the lower end of the switching block member 13 and a spring upper attachment portion 42 provided backward so as to protrude at the upper end of the bracket portion 40 are coupled by a switching coil spring 43 serving as biasing means for switching the switching block member 13 into a lateral pivot posture and keeping the posture (see FIGS. 5, 6, 18A to 20B, 21A to 23B). Note that when the switching block member 13 takes a posture pivoted left or right largely, a fan-shaped end face of the switching block member 13 abuts against a lower surface of one of the left and right bracket coupling portions 40*a* (40*a*) so that the switching block body 13 is regulated so as not to pivot exceeding an angle defined above.

Figure 17B:
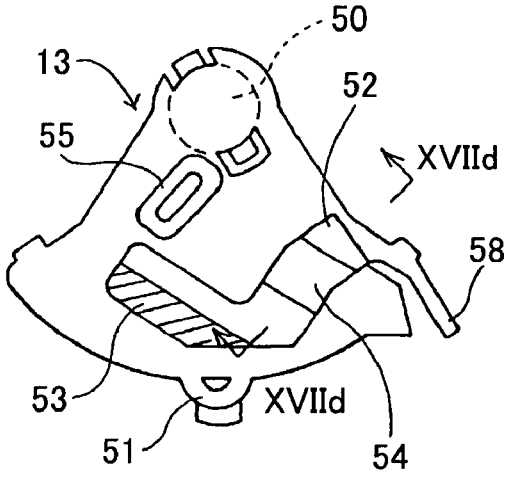
FIG. 17B is a front view of the switching block member.
Figure 17C:
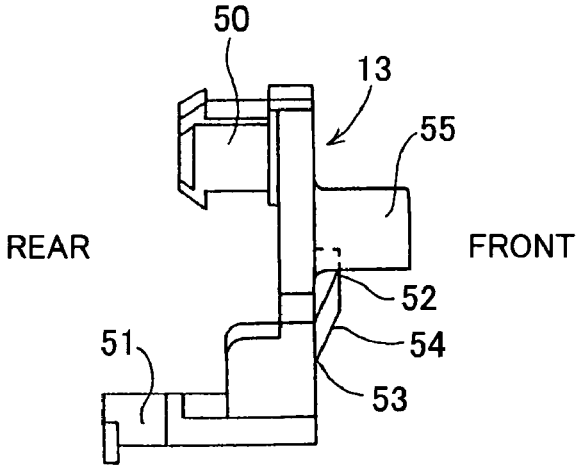
FIG. 17C is a left side view of the switching block member.
Figure 17D:
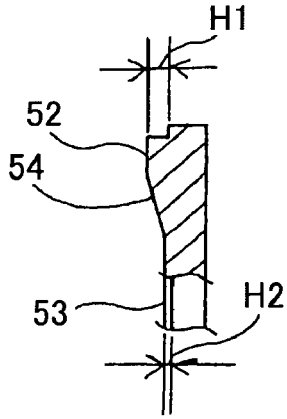
FIG. 17D is an enlarged sectional view in an arrow XVIId-XVIId direction of FIG. 17B of the switching block member and shows a height of an abutment portion.

On the front surface side of the switching block member 13, as shown in FIGS. 17B to 17D, a first abutment portion 52 and a second abutment portion 53, which selectively abut against a slide contact portion 12*a* on the upper end side on the back of the frame 12 at different heights, are continuously provided via an inclined guide surface 54. The first abutment portion 52, the second abutment portion 53, and the inclined guide surface 54 are set so as to have substantially equal radial diameter from a central axis of the pivotal shaft 50. A height H1 from the surface of the switching block member 13 is set larger for the first abutment portion 52, and a height H2 of the second abutment portion 53 is set to be smaller. In addition, on the surface of the switching block member 13, a switching abutment portion 55 is integrally provided facing forward so as to protrude toward a position having a radial distance from the central axis of the pivotal shaft 50 which is shorter than those of the respective abutment portions 52 and 53.

On the other hand, the frame 12 has a horizontal rail portion 12*b* which is bent forward at a position higher than the slide contact portion 12*a*. A first pushing piece 56, which is cut and raised in a substantially vertical direction and serves as first pushing means for switching and guiding the lateral pivot posture of the switching block member 13, is provided in the vicinity of a left end of the horizontal rail portion 12*b* (left side of the flushing portion 29). A second pushing piece 57 having a chevron shape (reverse V shape) viewed from the front is provided as second pushing means in the vicinity of a right end of the horizontal rail portion 12*b* (in substantially a center in the lateral direction of the maintenance portion 27) (see FIGS. 3, 18A to 20B, and 21A to 23B).

Next, the case in which printing is performed on plain paper by the printer apparatus 1 will be described. The carriage 10 located in the home position (cap position) 28 of FIG. 3A moves in a direction of arrow A of FIG. 5B when a print instruction is issued. A test of ink discharge in the nozzle portions 15*a* is executed in the flushing portion 29 (this flushing may be performed after a pushing operation to be discussed later as long as it is performed at least before starting printing). After that, when the carriage 10 (switching block member 13) further moves in a left direction (direction of arrow A) in FIG. 3B. A side of the switching abutment portion 55 collides with a right surface of the first pushing piece 56 which extends a substantially vertically. And then, the switching block member 13 pivots in a counterclockwise direction viewed from the front as shown in FIGS. 18A and 19A.

Figure 18A:
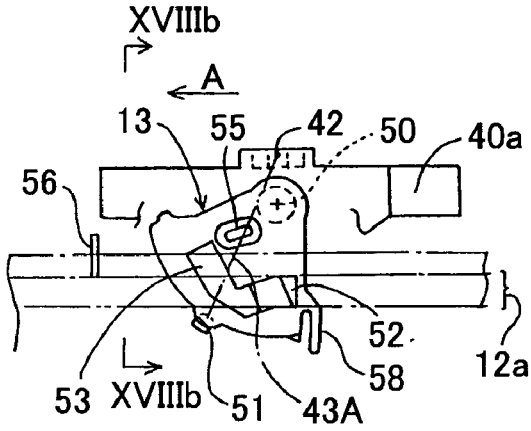
FIG. 18A is a front view showing a change in a posture of the switching block member on the left side of the frame before the switching abutment portion abuts against a first pushing piece in the first embodiment.
Figure 18B:
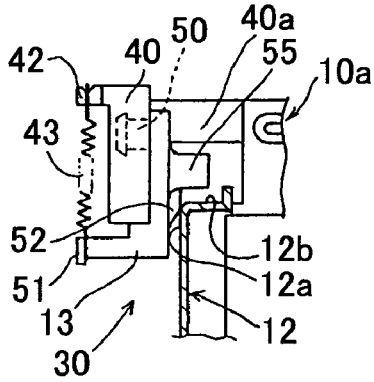
FIG. 18B is a view in an arrow XVIIIb-XVIIIb direction of FIG. 18A.
Figure 19A:
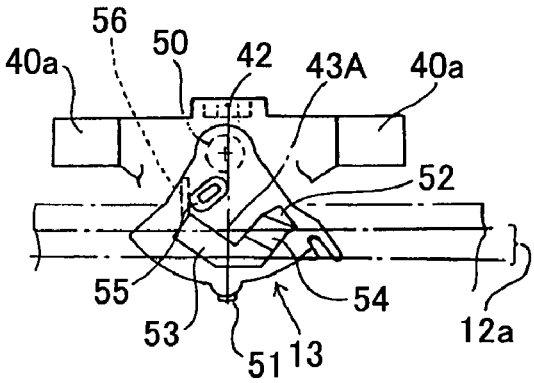
FIG. 19A is a front view showing a state in which the switching block member crosses a dead center.
Figure 19B:
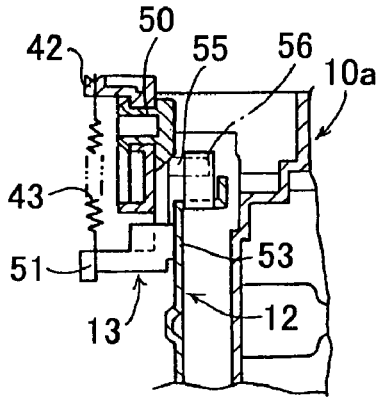
FIG. 19B is a left side view showing a state in which the switching block member crosses the dead center.
Figure 20A:
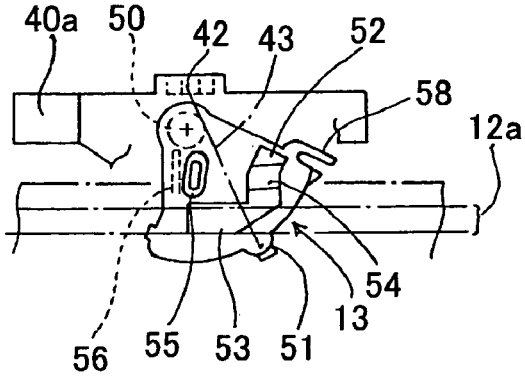
FIG. 20A is a front view at the time when the switching abutment portion has abutted against the first pushing piece and the posture of the switching block member has been completely switched.
Figure 20B:
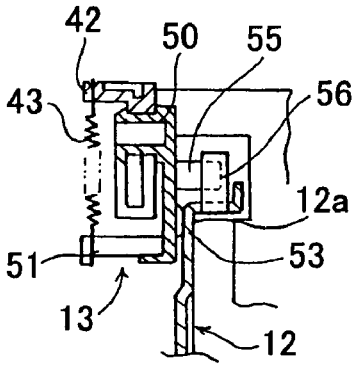
FIG. 20B is a left side view at the time when the switching abutment portion has abutted against the first pushing piece and the posture of the switching block member has been completely switched.

In this case, in FIG. 18A, a central axial line of the switching coil spring 43 is located on a left side of the center of the pivotal shaft 50 which is the pivotal center of the switching block member 13. The posture of the switching block member 13 is held such that its left side faces upward, and the first abutment portion 52 having a larger height is in slide contact with the slide contact portion 12*a*. In a state of FIG. 19A, a central axial line 43A of the switching coil spring 43 (line connecting the spring upper attachment portion 42 and the spring lower attachment portion 51) is brought close to the center of the pivotal shaft 50, which is the pivotal center of the switching block member 13, form its left side. And the inclined guide surface 54 pivots while being in slide contact with the slide contact portion 12*a*. When the inclined guide surface 54 further moves to the right, it crosses a so-called dead center, whereby the switching block member 13 pivots in the counterclockwise direction to a state of FIG. 20A such that its right side faces upward. Consequently, the switching block member 13 is changed to a posture in which the first abutment portion 52 shifts in the upward direction from the slide contact portion 12*a* and, on the other hand, the second abutment portion 53 with a smaller height is in slide contact with the slide contact portion 12*a*. In this state, as shown in FIG. 5, since the guide shaft 11 of a round shaft shape is offset to the left side of a center of gravity position of the carriage 10, and the carriage 10 is pivotable in the clockwise direction around the guide shaft 11 due to its own weight. Thus, the carriage 10 pivots such that the second abutment portion 53 with a smaller height on the front surface of the switching block member 13 on the upper side of the carriage 10 is brought close to the back of the frame 12 extending vertically. Therefore, the face, which is the lower surface of the nozzle portions 15*a* of the recording head 15 in the carriage 10, is brought close to the upper surface of the platen 25, and its posture is changed to a state in which a gap G1 becomes small. Note that the switching block member 13, in which the side of the switching abutment portion 55 has collided with the right surface of the first pushing piece 56 extending substantially vertically, as well as the carriage 10, become unable to further move in the left direction.

Subsequently, the carriage 10 is moved in a right direction (direction of arrow B) of FIG. 3A, and characters can be printed on plain paper within the recordable (printable) range of L1. Note that, the range of L2 including the recordable (printable) range L1 corresponds to a range of carriage return in the case of performing printing on plain paper, which is on a left side of a position for switching to a larger gap to be described later.

That is, in the case of performing printing on plain paper, it is necessary to move the carriage 10 in the range of L2 made by adding the acceleration and deceleration portions (ΔL) to both left and right sides of the recordable range L1 for plain paper, respectively. However, even when the carriage 10 moves to a right end position of L2, a gap is still kept small (the switching abutment portion 55 does not abut against the second pushing piece 57 of a chevron shape).

Therefore, a pushing operation by the second pushing piece 57 for increasing the gap is performed in a position on the further right side of the right end position of L2. Furthermore, the home position (capping position) 28 is in a position on the right side of the position where the pushing operation is performed. On the other hand, a flushing position is at least on the left side of the left end position of the recordable range L1. The pushing operation by the first pushing piece 56 for reducing the gap is set to be performed in a position on the further left side of the flushing position and on the left side of the left end position of L2. Thus, at least while the carriage 10 reciprocatingly moves within the range of L2, printing on plain paper is performed with the gap kept small. In addition, during the printing, for example, even when flushing is performed for every fixed time, the flushing operation is performed with the gap kept small.

Figure 21A:
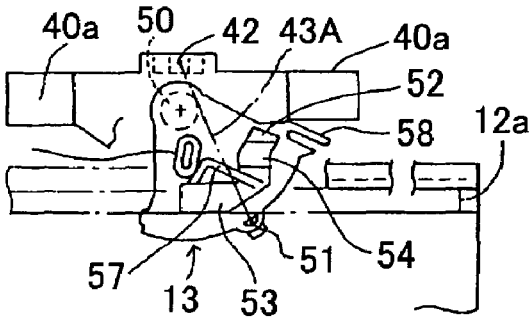
FIG. 21A is a front view immediately before the switching abutment portion abuts against a second pushing piece in the first embodiment.
Figure 21B:
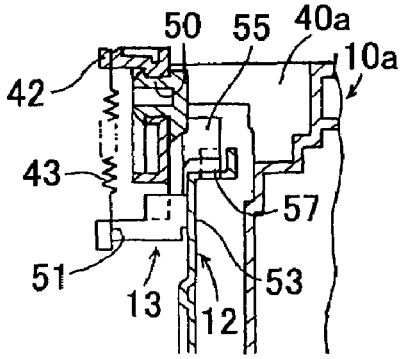
FIG. 21B is a left side view immediately before the switching abutment portion abuts against a second pushing piece in the first embodiment.
Figure 22A:
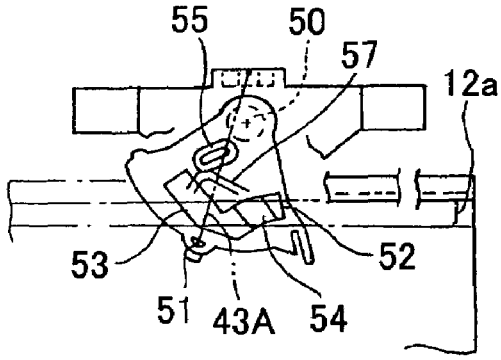
FIG. 22A is a front view showing a state in which the switching abutment portion passes over the second pushing piece.
Figure 22B:
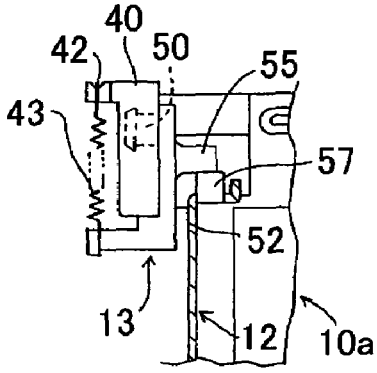
FIG. 22B is a left side view showing the state in which the switching abutment portion passes over the second pushing piece.
Figure 23A:
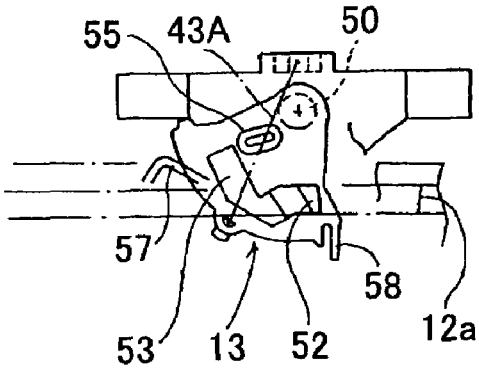
FIG. 23A is a front view at the time when the switching abutment portion has passed the part of the second pushing piece and the posture of the switching block member has been completely switched.
Figure 23B:
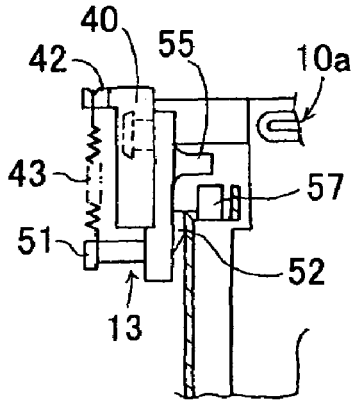
FIG. 23B is a left side view at the time when the switching abutment portion has passed the part of the second pushing piece and the posture of the switching block member has been completely switched.

In the case of performing printing on a thick envelope, unless the gap is increased, the envelope moving in a sheet conveying path is brought into contact with the nozzle portions 15*a* to soil a surface of the envelope with ink. Thus, the gap is adjusted to be wider (see FIGS. 19A to 23B). In this case, for example, when the previous print operation is the printing on plain paper, the carriage 10 is first moved in the right direction (direction of arrow B) of FIG. 3A in an attempt to retract the carriage 10 toward the home position (cap position) 28 after the printing ends. The switching block member 13 held with the gap for plain paper is held in a posture with its right side facing upward as in FIG. 20A by a biasing force of the switching coil spring 43 until the switching abutment portion 55 passes over the second pushing piece 57 of a chevron shape (FIG. 21A). As shown in FIG. 22A, as the switching abutment portion 55 passes over the upper end of the second pushing piece 57 at the time of movement of the carriage 10 to the right, the switching block member 13 pivots in the clockwise direction, and the first abutment portion 52 with a larger height is moved to be in slide contact with the slide portion 12*a* of the frame 12 via the inclined guide surface 54. At this point, when the central line of the switching coil sprint 43 connecting the spring upper attachment portion 42 and the spring lower attachment portion 51 shifts to the left side of the central line 43A of the pivotal shaft 50 to cross the dead center, the switching block member 13 promptly changes its posture such that its left side comes to an upper position, and the posture thereof is kept by a biasing force of the switching coil spring 43 (see FIG. 23A).

Therefore, since the first abutment portion 52 with a larger height on the front surface of the switching block member 13 on the upper side of the carriage 10 slides to the slide portion 12*a* on the back of the frame 12 extending vertically, the lower surface side of the carriage 10 is raised and caused to pivot upward about the guiding axis 11 (counterclockwise direction in FIG. 6) and the carriage 10 pivots so as to increase the gap dimension G1 (see FIG. 6). Therefore, the surface of the envelope does not rub against the nozzle portions 15*a*, whereby stains due to adhesion of unnecessary ink can be prevented.

That is, in the case of performing printing on an envelope, the recordable range L3 for the envelope is narrower than the recordable range L1 for plain paper and is set on the inner side of L1. Thus, when the carriage 10 is moved in the range of L4 made by adding the acceleration and deceleration portions (ΔL) to both left and right sides of L3, respectively, even when the carriage 10 has moved to the left end position of L4, and, moreover, when the carriage 10 has moved to the flushing position, the gap is still kept large (the switching abutment portion 55 does not collide with the first pushing piece 56 standing substantially vertically).

Therefore, printing on the envelope is performed with the gap kept large at least while the carriage 10 reciprocatingly moves within the range of L4. In addition, during the printing, for example, even when flushing is performed for every fixed time, the flushing operation is performed with the gap kept large. Consequently, when the flushing is performed, it is unnecessary to idly move the carriage 10 to a position, where the switching abutment portion 55 abuts against the second pushing piece 57 of a chevron shape, each time the flushing is performed. Thus, a printing operation on the envelope can be carried out promptly.

Note that, when the carriage 10 moves to the home position 28, for example, even in a state in which the gap is switched to be small, since the gap dimension G1 is switched to be large in a position before the home position, the respective caps 28*a* are reliably capped keeping a predetermined correspondence relationship with respect to the nozzle portions 15*a* at the time of movement of the carriage 10 to the home position 28. In addition, a replacement position of the ink cartridge is set to a right side of a pushing position where the gap is switched to be small (position where the switching abutment portion 55 collides with the first pushing piece 56 extending substantially vertically), whereby an interference state can be prevented in which ink drops leaked to the outside from the nozzle portions 15*a* at the time of replacing the ink cartridge are rubbed against a wall of the maintenance portion 27.

Note that, as shown in FIG. 17A, a horn-like elastic projection 58 for buffering is provided on one end face (right end face) of the fan-shaped portion of the switching block member 13. Consequently, when the switching abutment portion 55 passes over the upper end of the second pushing piece 57 at the time of movement of the carriage 10 to the right, the gap dimension G1 as defined cannot be set if pivotal displacement of the switching block member 13 in the clockwise direction is insufficient. Therefore, the elastic projection 58 is abutted against a regulating piece (not shown) provided in the frame 12 when the carriage 10 is moved to the home position 28, whereby a pivotal posture of the switching block member 13 is ensured.

Moreover, in a state in which the carriage 10 is retracted to the home position 28, when the carriage 10 is subjected to an impulsive load causing the carriage 10 to move further in the right direction, for example, when the product is dropped by mistake when it is transported, intense collision of the carriage 10 against the regulating piece provided in the frame 12 can be eased by the projection 58, and damages to the switching block member 13 can be prevented.

Circuit Configuration and a Series of Operations

The printer apparatus 1 as described above is provided with a usual function for, according to various instructions from an operation to be inputted in response to various key operations in the operation panel portion 6, executing setting of various processing operations, reading of an original image with the original reading unit 5, conversion of the original image into transmission data, conversion of the transmission data into a code, transmission and reception of facsimile data to be transmitted to another facsimile apparatus via communication network such as telephone lines, decoding of received data, and recording of the decoded facsimile data on a sheet P with a recording unit. In addition to this function, the printer apparatus 1 is also provided with a copy processing function for reading an original with a contact image sensor (CIS) of the original recording unit 5 and forming a color image on the sheet P with each unit of the recording portion, a printer processing function for receiving print data transmitted via a printer cable or wireless means such as infrared rays from an external apparatus such as a not-shown personal computer (host computer) and forming a color image on the sheet P according to the data, and a scanner processing function for transmitting image data read with the original reading unit 5 to the external apparatus.

Figure 24:
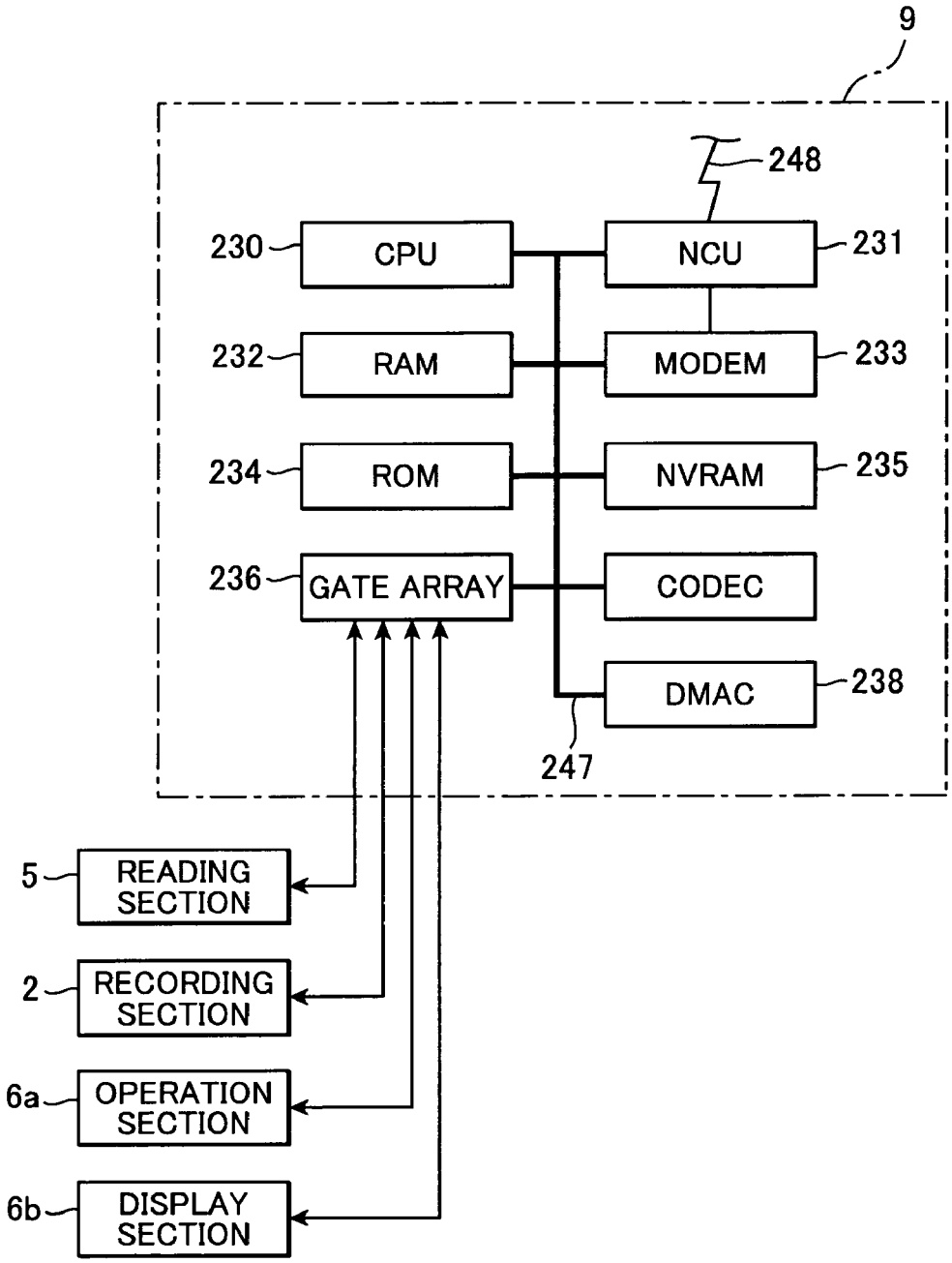
FIG. 24 is a block diagram showing a circuit structure of the multifunction facsimile/printer apparatus in the first embodiment.

FIG. 24 is a block diagram showing a circuit structure of a facsimile apparatus A. As shown in this figure, the multifunction facsimile/printer apparatus is generally provided with a CPU 230, an NCU 231, a RAM 23, a modem 233, a ROM 234, an NVRAM (Non-Volatile RAM) 235, a gate array 236, a codec 237, and a DMAC 238 other than the above-described original reading unit 5, the recording portion 2, the operation portion 6*a*, and the display portion 6*b*. The CPU 230, the NCU 231, the RAM 232, the modem 233, the ROM 234, the NVRAM 235, the gate array 236, the codec 237, and the DMAC 238 are connected with each other by a bus line 247. An address bus, a data bus, and a control signal line are included in the bus line 247. The reading portion 5, the recording portion 2, the operation portion 6*a*, and the display portion 6*b* are connected to the gate array 236. A public telephone line 248 is connected to the NCU 231.

The CPU 230 controls whole operations of the printer apparatus. The NCU 231 is connected to the public telephone lines to perform network control. The RAM 232 provides a work area for the CPU 230 and a development area of print data. The modem 233 performs modulation and demodulation of facsimile data. The ROM 234 has stored therein a program which the CPU 230 should execute. The NVRAM 235 stores data and various kinds of information. The gate array 236 functions as an interface between the CPU 230 and the recording portion 2, the reading portion 5, the operation portion 6*a*, and the display portion 6*b*. The codec 237 performs coding and decoding of data. The DMAC 238 mainly writes data in and reads it out from the RAM 232. The reading portion 5 reads an image from an original or the like according to control of the CPU 230. The recording portion 2 performs aforementioned various operations according to control of the CPU 230. In addition, according to an operation of the operation portion 6*a*, an input signal from a user is transmitted to the CPU 230 and different kinds of information is displayed on the display portion 6*b*.

The CPU 230 realizes: reciprocating movement means which makes the carriage 10 repeatedly and reciprocatingly movable by accelerating the carriage 10 in one direction to bring it into a constant speed state, decelerating the carriage after making it undergo the constant speed state for a short time, and decelerating the carriage after accelerating it in the opposite direction to bring it into the constant speed state again; first determining means which, in stopping in a predetermined position the carriage 10 reciprocatingly moved by the reciprocating movement means, determines that the carriage is stopped when it is decelerated to a speed equal to or lower than a first speed; and second determining means which, when the carriage 10 is reciprocatingly moved by the reciprocating movement means to perform printing, determines that the carriage is stopped when decelerated to a speed equal to or lower than a second speed higher than the first speed.

The CPU 230 further realizes: reciprocating movement means which, when discharge of a sheet is performed, retracts the carriage 10 to the outside of a reciprocating movement portion of the carriage 10; and carriage movement control means which brings the carriage 10 into the constant speed state with the reciprocating movement means according to the print command when it receives a sheet discharge command indicating that discharge of a sheet is to be performed together with a paper feed command indicating that feeding of a sheet is to be performed without any other print command following a print command indicating that printing is to be performed by the recording head mounted on the carriage 10. The carriage movement control means retracts the carriage 10 to the outside of the reciprocating movement portion continuously with the reciprocating movement means according to the sheet discharge command immediately after the printing ends.

The CPU 230 further realizes: reciprocating movement means which moves the carriage 10 to a gap switching position located outside a reciprocating movement portion of the carriage 10; and carriage movement control means which moves the carriage 10 to the gap switching position during feeding of a sheet P.

On the other hand, there is a computer program, which is stored in the ROM 234, for executing control for reciprocatingly moving a carriage 10 substantially perpendicular to a feeding direction of a sheet to apply printing to the sheet with a recording head 15 mounted on the carriage 10. The computer program includes: a reciprocating movement program for accelerating the carriage 10 in one direction to bring it into a constant speed state, decelerating the carriage after making it undergo the constant speed state for a short time, and decelerating the carriage after accelerating it in the opposite direction to bring it into the constant speed state again, thereby making the carriage repeatedly and reciprocatingly movable; a first determination program for, in stopping the carriage reciprocatingly moved based upon the reciprocating movement program, determining that the carriage is stopped when decelerated to a speed equal to or lower than a first speed; and a second determination program for, when the carriage is reciprocatingly moved based upon the reciprocating movement program to perform printing, determining that the carriage is stopped when decelerated to a speed equal to or lower than a second speed higher than the first speed.

Further, there is a computer program, which is stored in the ROM 234, for controlling, when the carriage 10 reverses for reciprocating movement, feeding of a sheet P in association therewith. The computer program includes: a reciprocating movement program for accelerating the carriage 10 in one direction to bring it into a constant speed state, decelerating the carriage 10 after making it undergo the constant speed state for a short time, and decelerating the carriage 10 after accelerating it in the opposite direction to bring it into the constant speed state again, thereby repeatedly reversing the carriage 10 to move it reciprocatingly, and on the other hand, when discharge of a sheet P is performed, retracting the carriage 10 to the outside of a reciprocating movement portion of the carriage 10; and a carriage movement control program for, when a sheet discharge command to the effect that discharge of the sheet P is to be performed is received together with a paper feed command to the effect that feeding of the sheet P is to be performed without any other print command following a print command to the effect that printing is to be performed by the recording head 21 mounted on the carriage 10, bringing the carriage 10 into the constant speed state based upon the reciprocating movement program according the print command, and on the other hand, immediately after the printing ends, retracting the carriage 10 to the outside of the reciprocating movement portion continuously based upon the reciprocating movement program according to the sheet discharge command.

Further, there is a computer program, which is stored in the ROM 234, for executing control for automatically switching a gap between the sheet P and the recording head 15. The computer program includes: a reciprocating movement program for accelerating the carriage 10 in one direction to bring it into a constant speed state, decelerating the carriage 10 after making it undergo the constant speed state for a short time, and decelerating the carriage 10 after accelerating it in the opposite direction to bring it into the constant speed state again, thereby repeatedly reversing the carriage 10 to move it reciprocatingly, and on the other hand, moving the carriage 10 to a switching position of the gap located outside a reciprocating movement portion of the carriage 10; and a carriage movement control program for moving the carriage 10 to the switching position of the gap based upon the reciprocating movement program during feeding of the sheet P.

Figure 25:
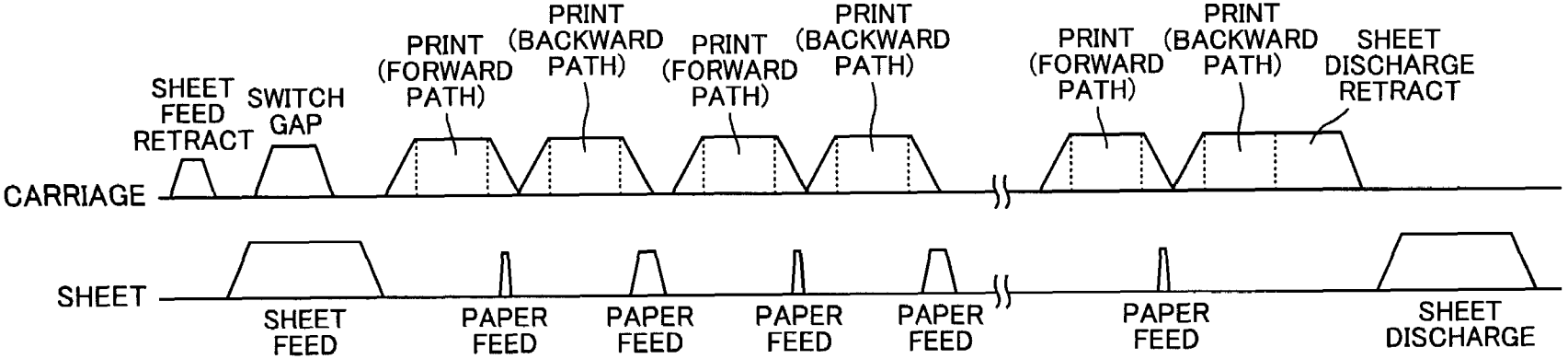
FIG. 25 is a time chart showing timing of an operation of the carriage and movement of a sheet in the first embodiment.
Figure 26:
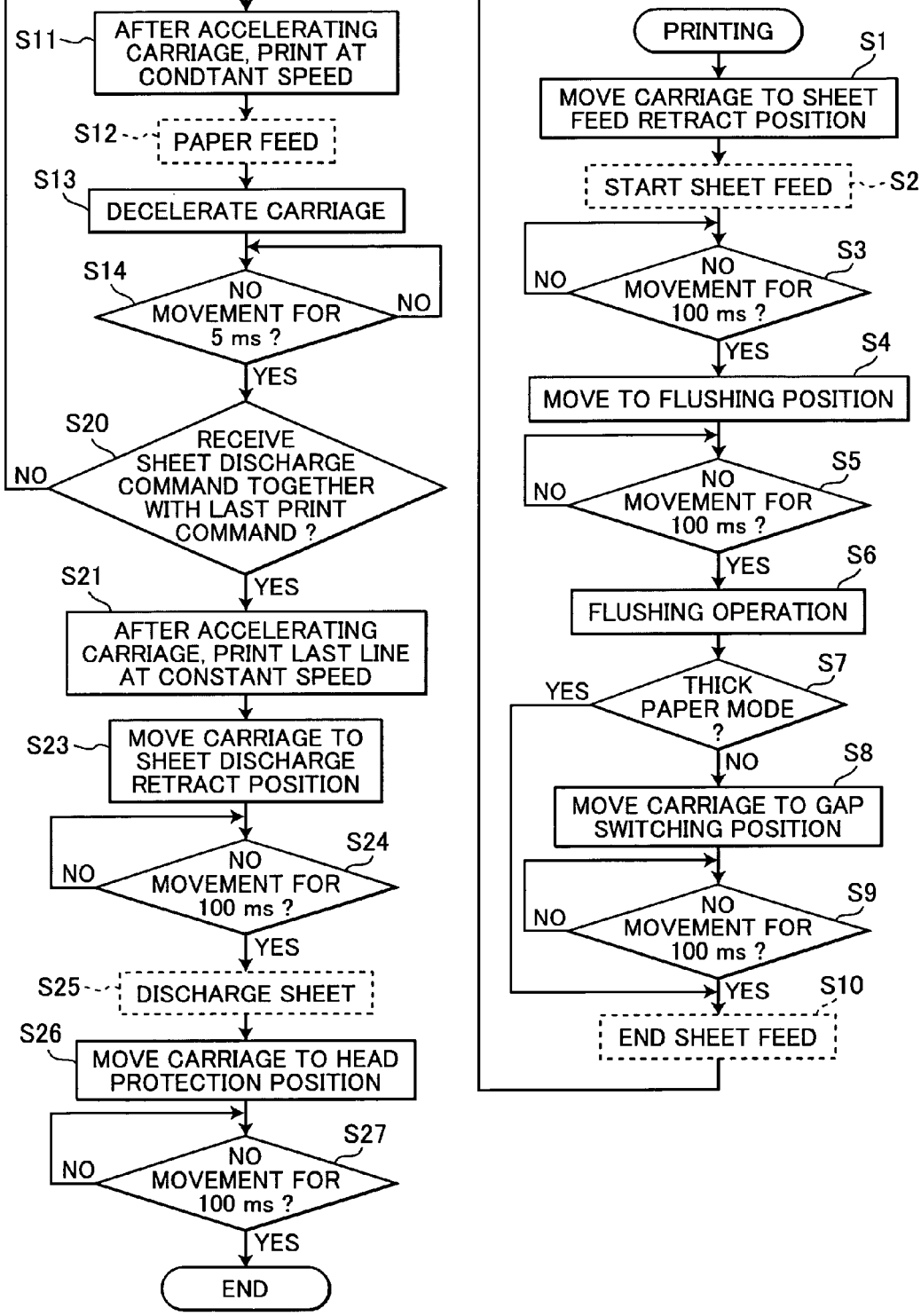
FIG. 26 is a flowchart showing a flow of entire print processing in the first embodiment.

Next, operations will be described based upon FIGS. 25 and 26. Note that, In FIG. 26, processing concerning operations of the carriage 10 is indicated by solid lines and processing concerning movements of the sheet P is indicated by broken lines.

In starting print processing, first, the CPU 230 causes the carriage 10 to move from the head protection position to the retract position at sheet feeding time (S1).

In addition, during the movement of the carriage 10, the CPU 230 starts sheet feed (S2). Consequently, the sheet P is fed into the inside via the sheet supply roller 21.

Simultaneously with feeding the sheet P in this way, the CPU 230 monitors the movement of the carriage 10 according to whether or not an output interval of encoder signals from the linear encoder 82 has exceeded, for example, 100 ms (S3).

When it is determined that the output interval of encoder signals has exceeded 100 ms and the carriage 10 has stopped (S3: YES), the CPU 230 causes the carriage 10 to move to the flushing position in order to perform flushing of ink (S4). Then, when it is determined that the output interval of encoder signals has exceeded 100 ms and the carriage 10 has stopped (S5: YES), the CPU 230 issues an instruction for performing a flushing operation (S6). Thereafter, if the apparatus is not set in a print mode for thick paper for printing on an envelope or the like (S7: NO), the CPU 230 causes the carriage 10 to move to the gap switching position (S8). Note that, such a switching operation of a gap is performed by the time when the sheet P being conveyed reaches the registration roller 22 such that the recording head 15 of the moving carriage 10 is not brought into contact with the sheet P. Note that, although the operation of S8 is effective when printing is performed on plain paper with the printer apparatus set in the thick paper mode at first, the carriage 10 is kept in a state in which it is stopped in the retract position at sheet feeding time when it is unnecessary to switch a gap.

Thereafter, when the CPU 230 determines that the output interval of encoder signals has exceeded 100 ms and the carriage 10 has stopped (S9: YES), and detects a leading edge position of the sheet P by the sheet sensor 80, and the leading edge of the sheet P is then sent out from the registration roller 22 by a predetermined amount, and the CPU 230 ends the sheet feed accordingly (S10).

Then, after controlling the DC motor to accelerate the carriage 10 to a certain speed, the CPU 230 causes the carriage 10 to move at a constant speed along one direction (forward path). The CPU 230 controls the recording head 15 while the carriage 10 is moving at the constant speed, so that printing is performed (S11). That is, while the carriage 10 is moving on the sheet P at the constant speed, ink is injected from the nozzle arrays 15A and 15B of the recording head 15 and deposits on the sheet P with a fixed width, so that printing is performed.

When the printing in one direction is finished, the CPU 230 controls the DC motor to decelerate the carriage 10 (S13) while performing feeding of the sheet P (S12).

Moreover, during the deceleration of the carriage 10, the CPU 230 monitors whether or not the output interval of encoder signals from the linear encoder 82 has exceeded, for example, 5 ms (S14).

When the output interval of encoder signals has exceeded 5 ms (S14: YES), the CPU 230 determines that the carriage 10 has stopped and executes printing of the next line when the feeding of the sheet P ends. Note that, considering the determination time in the order of 5 ms, the carriage 10 cannot be in a completely stopped state but may be slightly moving. In addition, when the feeding of the sheet P ends during the deceleration of the carriage 10, since the printing of the next line is started immediately, a slight load is applied to the DC motor when the carriage 10 is accelerated in the opposite direction in such a state. However, since the carriage 10 starts to accelerate in the opposite direction in the middle of the predetermined acceleration and deceleration portion, a reverse operation of the carriage 10 is performed promptly.

The CPU 230, which controls two-way printing as described above, is constituted so as to perform the two-way printing for each print command while sequentially receiving print commands and storing them. Such a CPU 230 determines whether or not a sheet discharge command has been received together with a last print command (S20). Note that, after the last print command, the sheet discharge command may be issued for processing subsequent to a paper feed command.

When the sheet discharge command has been received together with the last print command (S20: YES), after accelerating the carriage 10 to a certain speed according to the last print command, the CPU 230 performs printing of a last line by controlling the recording head 15 while the carriage 10 is moving at the constant speed (S21).

Thereafter, upon finishing the printing of the last line, the CPU 230 causes the carriage 10 to move to the retract position at sheet discharge time without stopping the carriage 10 once in the acceleration and deceleration portion according to the sheet discharge command (S23). That is, when the paper feed command is caused to wait for processing before the sheet discharge command, the CPU 230 neglects this paper feed command to cause the carriage 10 to move to the retract position at sheet discharge time immediately after the printing of the last line. When the CPU 230 determines that the output interval of encoder signals has exceeded 100 ms and the carriage 10 has stopped (S24: YES), the sheet P is thus discharged promptly without a wasteful feeding operation of the sheet P (S25).

Thereafter, the CPU 230 causes the carriage 10 to move to the initial head protection position (S26). When the CPU 230 determines that the output interval of encoder signals has exceeded 100 ms and the carriage 10 has stopped (S27: YES), the CPU 230 ends this print processing.

When it is determined in S27 that the output interval of encoder signals has not exceeded 100 ms and the carriage 10 is moving (S27: NO), the CPU 230 stands by for the next processing until it determines that the carriage 10 comes into a stopped state.

When it is determined in S24 that the output interval of encoder signals has not exceeded 100 ms and the carriage 10 is moving (S24: NO), the CPU 230 stands by for the next processing until it determines that the carriage 10 comes into a stopped state.

When the last print command and the sheet discharge command have not been received in S20 (S20: NO), the CPU 230 returns to S11 to continue the two-way printing.

In S14, when the carriage 10 is moving in deceleration even in the time interval set to 5 ms during the two-way printing (S14: NO), the CPU 230 stands by for execution of the next operation until the carriage 10 comes into the stopped state.

When it is determined in S9 that the output interval of encoder signals has not exceeded 100 ms and the carriage 10 is moving (S9: NO), the CPU 30 stands by for the next processing until it determines that the carriage 10 comes into a stopped state.

In S7, when the printer apparatus is set in the thick paper mode from the beginning and it is unnecessary to switch the mode in S7 (S7: NO), the CPU 230 proceeds to S10.

When it is determined in S5 that the output interval of encoder signals has not exceeded 100 ms and the carriage 10 is moving (S5: NO), the CPU 230 stands by for the next processing until it determines that the carriage 10 comes into a stopped state.

When it is determined in S3 that the output interval of encoder signals has not exceeded 100 ms and the carriage 10 is moving (S3: NO), the CPU 230 stands by for the next processing until it determines that the carriage 10 comes into a stopped state.

Therefore, according to the multifunction facsimile and printer apparatus which is provided with the above-mentioned ink jet printer, a reference for determination for stopping the carriage 10 in the head protection position, the retract position, or the gap switching position (in the above-mentioned example, the time interval of 100 ms during which the movement of the carriage 10 is detected based upon the encoder signals) and a reference for determining that the carriage 10 is in the stopped state when the carriage 10 in the middle of printing is reversed (in the above-mentioned example, the time interval of 5 ms during which the movement of the carriage 10 is detected based upon the encoder signals) are different therebetween. That is, when printing is performed, determination on stop as timing for reversing the carriage 10 is set earlier than timing in causing the carriage 10 to move to each predetermined position to stop there. Consequently, time required for the entire reciprocating movement of the carriage 10 at the printing time is reduced and speeding-up can be realized easily.

In addition, prior to the discharge of the sheet P according to the sheet discharge command, feeding of the sheet P is never performed even if there is the paper feed command received immediately before receiving the sheet discharge command, and the carriage 10 moves to the retract position at sheet discharge time immediately after the last printing. Thus, the sheet discharge can be performed promptly following the print operation according to the last print command and speeding-up can be realized easily.

Moreover, simultaneously with the feeding of the sheet P, the carriage 10 moves to the gap switching position, whereby the gap is automatically switched. Thus, sheet feed is not delayed due to switching of the gap, and speeding-up can be realized easily.

Second Embodiment Concerning the Gap Adjustment Mechanism

Figure 27A:
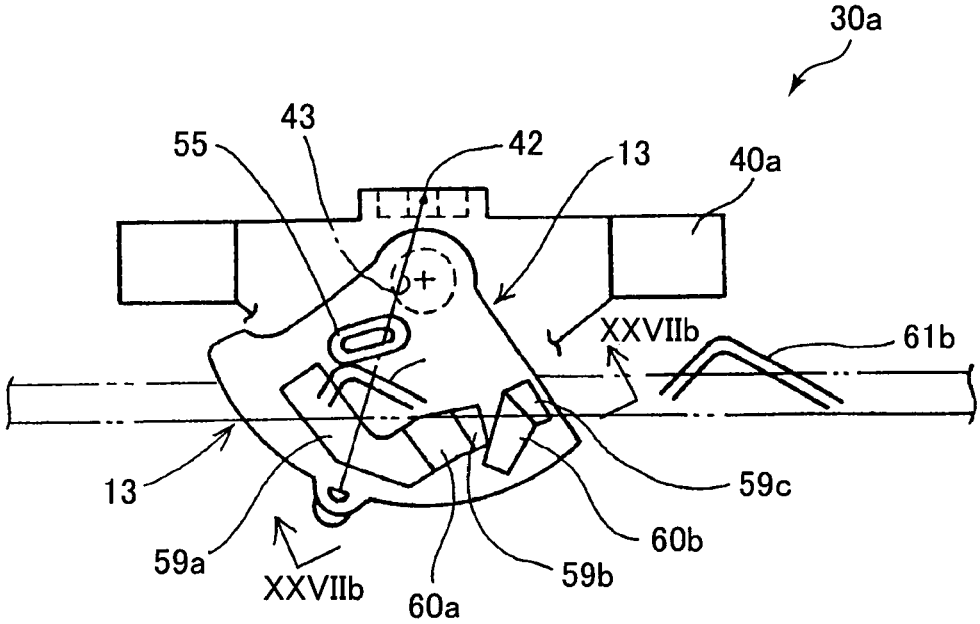
FIG. 27A is a front view of a switching block member in a second embodiment which has an abutment portion with heights different in three stages.
Figure 27B:
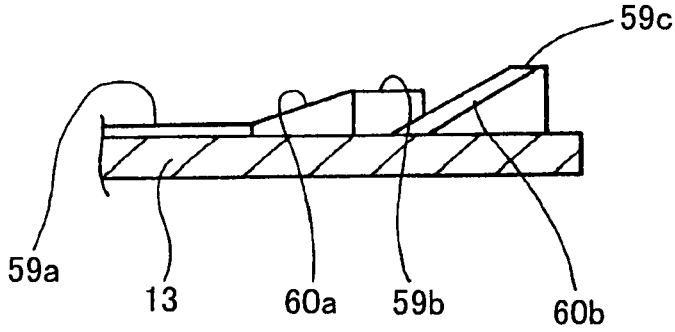
FIG. 27B is an enlarged sectional view in an arrow XXVIIb-XXVIIb direction of FIG. 27A.

The gap dimension G1 is switched to two types, a small one and a large one in the above-mentioned first embodiment, switching to three types if gaps can be executed in a gap adjustment mechanism 30*a* according to this embodiment. As shown in FIGS. 27A and 27B, three states with different heights of abutment portions 59*a*, 59*b*, and 59*c* provided on the surface of the switching block member 13 laterally pivotable are set. Next, the lowest first abutment portion 59*a* and the second highest second abutment portion 59*b* are connected by a first inclined guide surface 60*a*. The highest third abutment portion 59*c* is set so as to have a second inclined guide surface 60*b* which is in a position parallel with the second highest abutment portion 59*b*. Two pushing pieces 61*a* and 61*b* of a chevron shape with different heights are provided to be apart from each other appropriately in a moving direction of a carriage on an upper surface of the horizontal rail portion 12*b* of the frame 12. The higher pushing piece 61*b* is positioned on a side closer to a movement terminal of the carriage 10.

In that case, only the second highest abutment portion 59*b* abuts against the slide contact portion 12*a* of the frame 12 when the switching abutment portion 55 is selected to be in a state in which it has passed over the lower pushing piece 61*a* but has not passed over the higher pushing piece 61*b*. Only the highest third abutment portion 59*c* abuts against the slide contact portion 12*a* of the frame 12 when the switching abutment portion 55 passes over the higher pushing piece 61*b*. Accordingly, the carriage 10 pivots around the guide shaft 11 and the cap dimension G1 can be switched to one of three types of small, medium, and large.

Third Embodiment Concerning the Gap Adjustment Mechanism

In the gap adjustment mechanisms 30 and 30*a* according to the first and second embodiments, the abutment portions with different heights of the switching block member 13 are switched to perform size adjustment of the gap by utilizing the first pushing piece 56 and the second pushing piece 57 provided in the frame 12, respectively, according to the reciprocating lateral movement of the carriage 10. The third embodiment relates to a gap adjustment mechanism which is capable of increasing accuracy of gap formation while further miniaturizing and simplifying a structure for adjustment of the gap.

Figure 28:
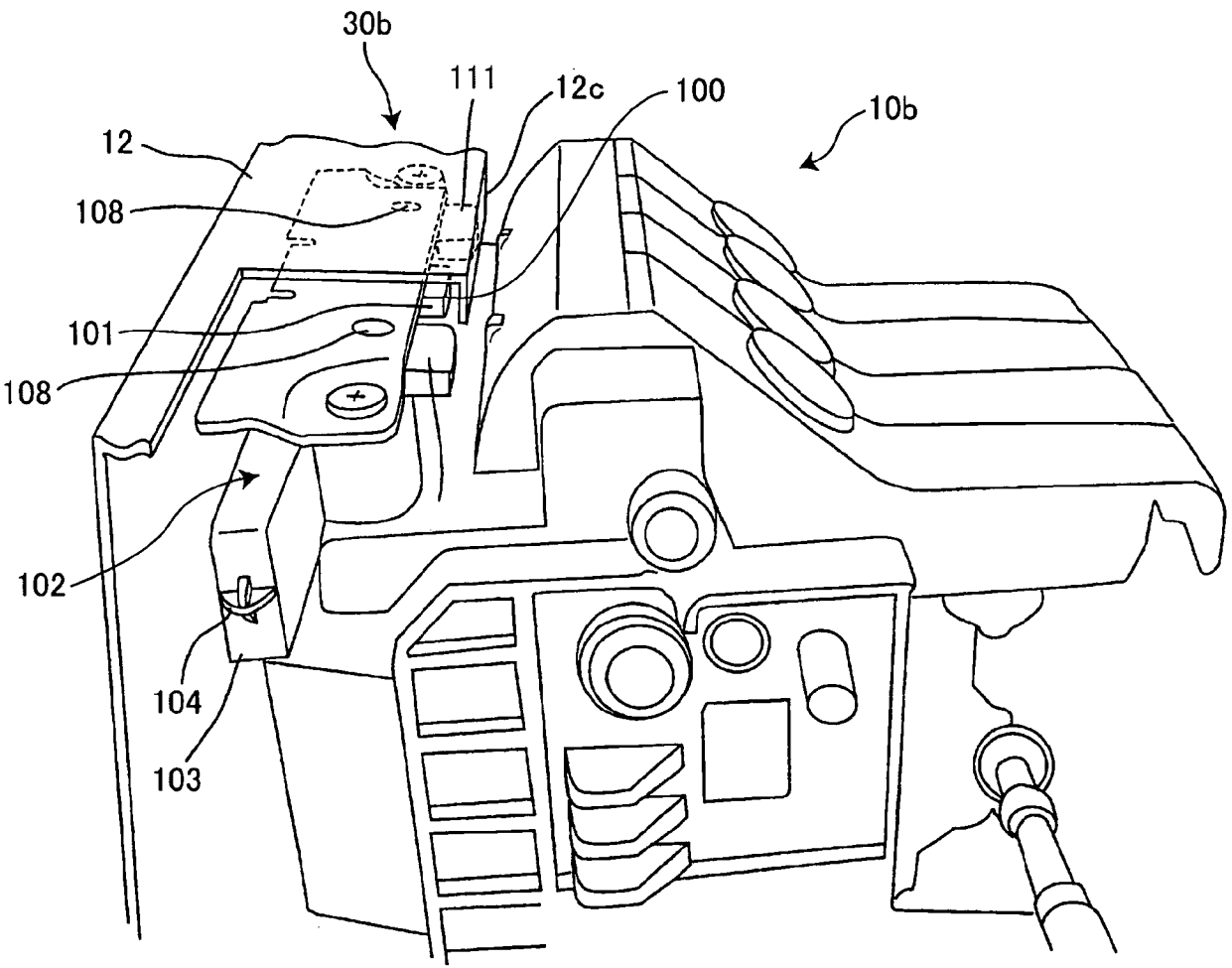
FIG. 28 is an upper perspective view of a carriage in accordance with a third embodiment.

An upper perspective view of a carriage 10*b* in accordance with this embodiment is shown in FIG. 28. Since a structure of the carriage 10*b* is substantially the same as that of the carriage 10 of the first embodiment except the gap adjustment mechanism 30 of the first embodiment, detailed descriptions of the structure will be omitted. A gap adjustment mechanism 30*b* provided at a rear end on an upper surface of the carriage 10*b* of this embodiment will be mainly described with reference to FIGS. 28 to 33.

Figure 29A:
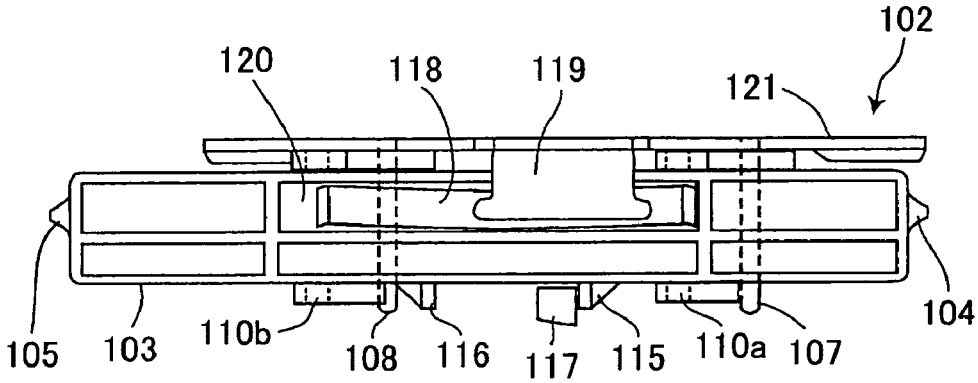
FIG. 29A is a rear view of an actuator portion 102 showing a state in which second abutment portions 109 and 111 are received in the third embodiment.

As shown in FIG. 28, a first abutment portion 101, which has a first abutment surface 100 (FIG. 29B) to be in slide contact with the a vertical rail portion 12*c* of the frame 12, is adhered to substantially a central part of the rear end on the upper surface of the carriage 10*b*. Moreover, a pressing plate 121 (FIG. 29A) of an actuator portion 102 is screwed to the rear end on the upper surface of the carriage 10*b* so as to cover the first abutment portion 101 from above. The actuator portion 102 is provided with a switching lever 103 in which a first projected portion 104 and a second projected portion 105 (not shown) are formed at respective ends in a longitudinal direction, a metal pressing plate 121 carrying out a function as a frame of the actuator portion 102, and two second abutment portions 109 and 111 which project and retract in connection with a longitudinal movement of the switching lever 103 about shafts fixed to the pressing plate 121 as pivotally supporting shafts 107 and 108 (FIG. 29A).

Figure 29B:
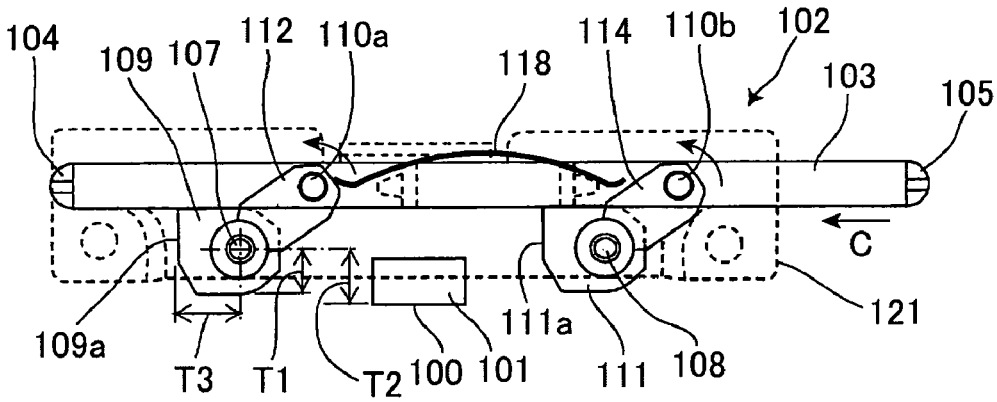
FIG. 29B is a plan sectional view of FIG. 29A.
Figure 29C:
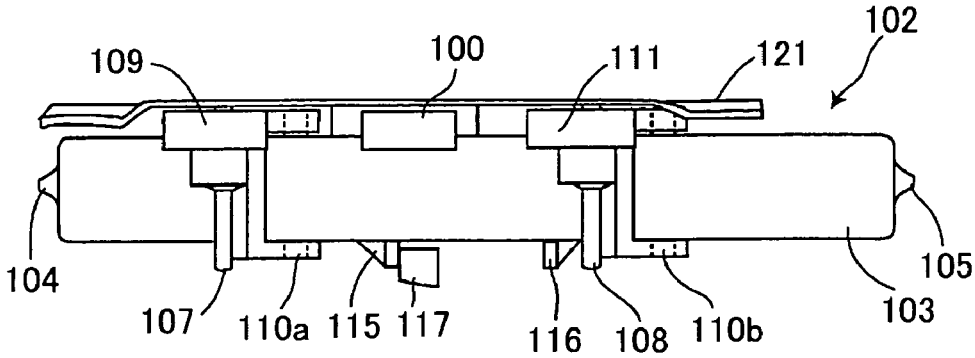
FIG. 29C is a front view of FIG. 29A.

Next, details of the actuator portion 102 will be described based upon FIGS. 29A to 29C and FIGS. 30A to 30C. FIG. 29A is a rear view of the actuator portion 102 showing a state in which the second abutment portions 109 and 111 are received. FIG. 29B is a plan sectional view of the actuator portion 102. FIG. 29C is a front view of the actuator portion 102. The second abutment portions 109 and 111 are fittingly inserted pivotably in the actuator portion 102 with the first pin 107 and the second pin 108 vertically provided on the pressing plate 121 as pivotally supporting shafts, respectively. The second abutment portions 109 and 111 are coupled to one ends of coupling arms 112 and 114, respectively. The other ends of the coupling arms 112 and 114 are respectively inserted in a third pin 110*a* and a fourth pin 110*b*, which are formed on upper and lower end faces of the switching lever 103. A first projected portion 104 and a second projected portion 105 which, when the switching lever 103 is pushed by pushing means to be described later, abuts against the pushing means are formed at both ends in the longitudinal direction of the switching lever 103. In addition, the pressing plate 121 has a spring retainer 119 which is bent vertically downward in a central part of a back of the pressing plate 121. The pressing plate 121 presses a leaf spring 118 inserted in a recessed portion 120 on an upper part of a back of the switching lever 103. Thus, the switching lever 103 becomes reciprocatingly movable in the lateral longitudinal direction, so that a first stopping projected portion 115 or a second stopping projected portion 116 formed on the lower end face of the switching lever 103 collides with a stopper 117 formed on the upper surface of the carriage. Therefore, the movement of the switching lever 103 is reliably stopped and a posture of the switching lever 103 is held by a force of the leaf spring 118.

When the pushing means pushing down the second projected portion 105 moves the switching lever 103 in a C direction shown in the figure (FIG. 29B), the other ends of the coupling arms 112 and 114 are pulled in the C direction in association with the switching lever 103. At the same time, the second abutment portions 109 and 111 coupled to one ends of the coupling arms 112 and 114, respectively, rotate counterclockwise (see FIG. 29B) about the first pin 107 and the second pin 108 as pivotally supporting shafts for the respective abutment portions. When the pushing means pushes the switching lever 103 to a certain predetermined position, a force rotating the second abutment portions 109 and 111 in the same rotating direction is generated by a force of the leaf spring 118 pushing the spring retainer 119. Thus, even if the switching lever 103 is not pushed by the pushing means, the second abutment portions 109 and 111 rotate to a position where the second stopping projected portion 116 abuts against the stopper 117. Furthermore, the posture of the switching lever 103 is held by the force of the spring retainer 119 pushing the leaf spring 118, so that postures of the second abutment portions 109 and 111 are also held in a position shown in FIG. 30B.

Figure 30A:
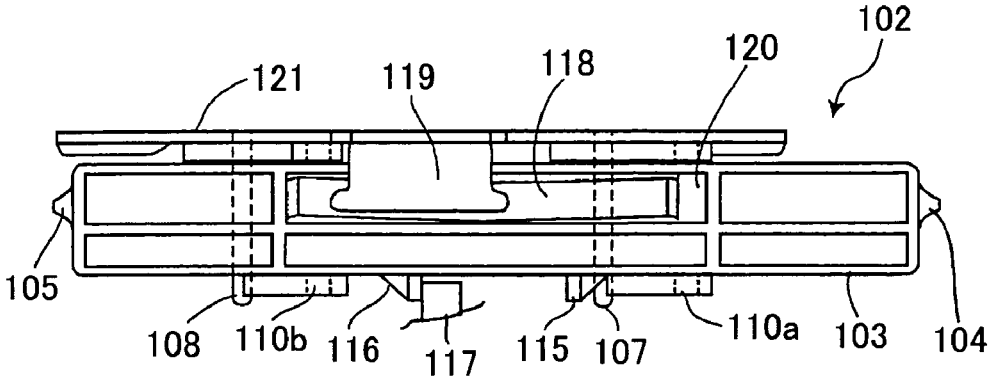
FIG. 30A is a rear view of the actuator portion 102 showing a state in which the second abutment portions 109 and 111 are projected in the third embodiment.

On the other hand, when the pushing means pushing down the first projected portion 104 moves the switching lever 103 in a D direction shown in FIG. 30A, the other ends of the coupling arms 112 and 114 are pulled in the D direction in association with the switching lever 103. At the same time, the second abutment portions 109 and 111 coupled to one ends of the coupling arms 112 and 114, respectively, rotate clockwise (see FIG. 30B) about the first pin 107 and the second pin 108 as pivotally supporting shafts for the respective abutment portions. When the pushing means pushes the switching lever 103 to a certain predetermined position, a force rotating the second abutment portions 109 and 111 in the same rotating direction is generated by a force of the leaf spring 118 pushing the spring retainer 119. Thus, even if the switching lever 103 is not pushed by the pushing means any more, the second abutment portions 109 and 111 rotate to a position where the first stopping projected portion 115 abuts against the stopper 117. Thereafter, the posture of the switching lever 103 is held by the force of the spring retainer 119 pushing the leaf spring 118, so that postures of the second abutment portions 109 and 111 are also held in a position shown in FIG. 29B.

Figure 30B:
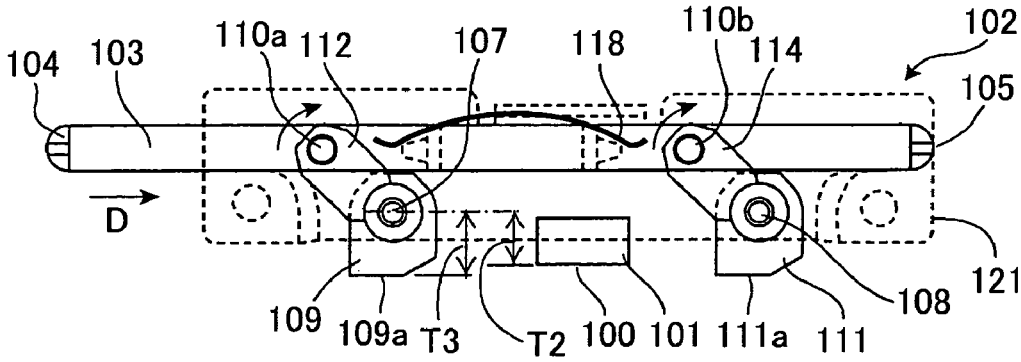
FIG. 30B is a plan sectional view of FIG. 30A.

In addition, the first abutment portion 101 having the first abutment surface 100 shown in FIGS. 29B and 30B is adhered and fixed to the upper surface of the carriage. A height from an axial line of the first pin 107 or the second pin 108 which is parallel with a moving direction of the switching lever 103 to the first abutment surface 100 is set to T2. In this case, a relationship of T2 with respective heights T1 and T3 at the time when the second abutment portions 109 and 111 retract or project is T1<T2<T3. That is, the height T3 is projected most in a front direction in the figure, next T2, and then T1.

Figure 31:
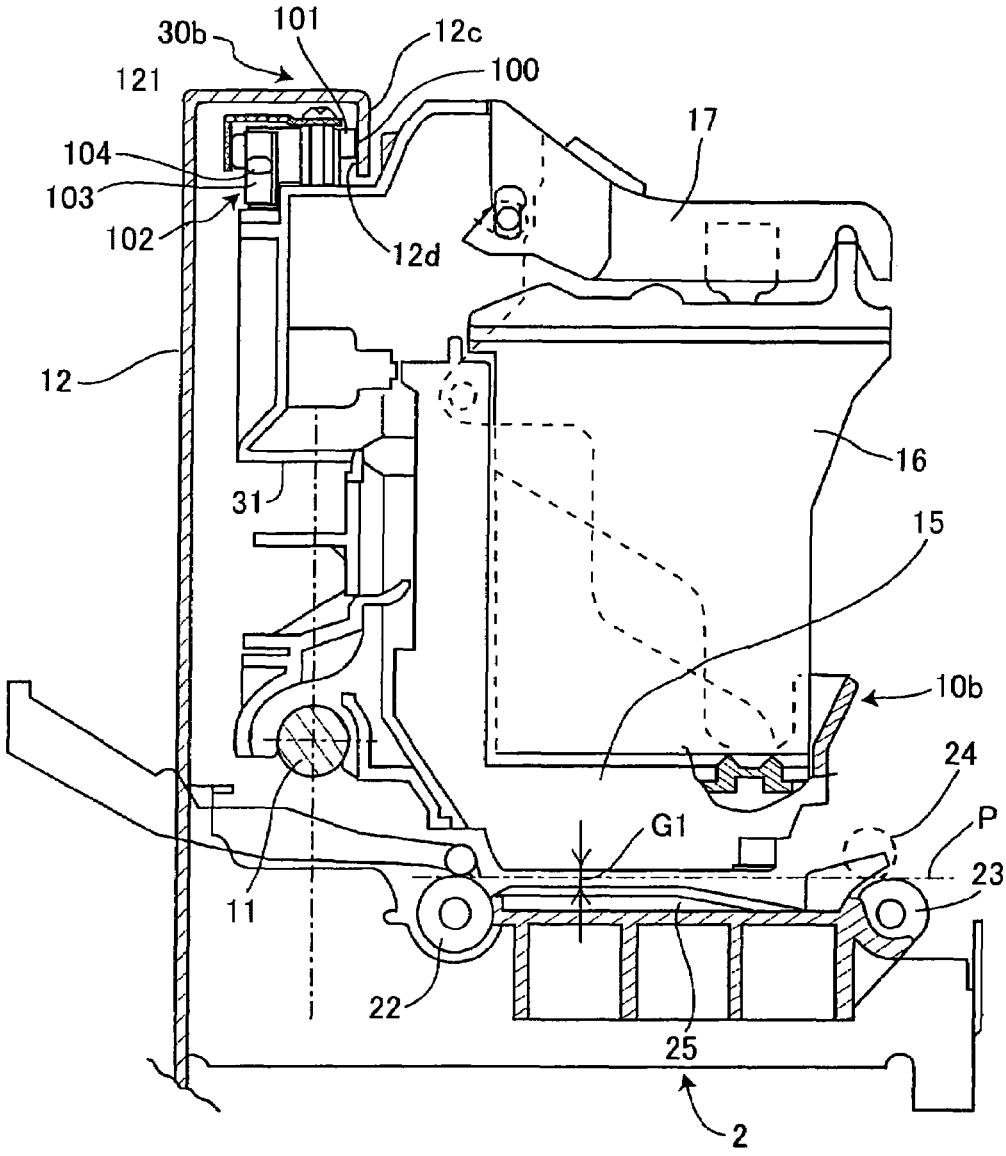
FIG. 31 is a side sectional view of a recording portion in a state in which a gap G1 is small in the third embodiment.

Subsequently, an action of gap adjustment according to cooperation of the gap adjustment mechanism 30*b*, which is composed of the first abutment portion 101 and the actuator portion 102, and the frame 12 will be described. FIG. 31 is a side sectional view of a recording portion in a state in which the gap G1 is small. An upper part of the frame 12 provided vertically on the back (left side in the figure) of the carriage 10*b* is bent in two portions. A vertical surface of a tip end portion thereof forms a vertical rail portion 12*c*, which is opposed to the first abutment portion 101 and the second abutment portions 109 and 111. In addition, the vertical rail portion 12*c* abuts against the first abutment portion 101 or the second abutment portions 109 and 111, thereby sliding to guide them with a surface on the opposite side of the ink cartridge 16 as a frame sliding surface 12*d*. FIG. 31 shows a state in which the second abutment portions 109 and 111 of the actuator portion 102 are retracted, having the height of T1, that is, the state shown in FIGS. 29A to 29C. In FIGS. 29A to 29C, the guide shaft 11 of a round shaft shape offsets to the left side from the position of the center of gravity of the carriage 10*b*. The carriage 10*b* is made pivotable in the clockwise direction around the guide shaft 11 due to its own weight. Thus, the first abutment portion 101, which is adhered and fixed to the carriage upper surface and has the surface at the height T2 larger than T1, abuts against the frame sliding surface 12*d*. As a result, the carriage 10*b* is brought into a state in which it pivots at a maximum angle in the clockwise direction about the guide shaft 11. The face, which is the lower surface of the nozzle portions 15*a* of the recording head 15 in the carriage 10*b*, is brought close to the upper surface of the platen 25 so that its posture is held in the state in which the gap dimension G1 is small.

Figure 32:
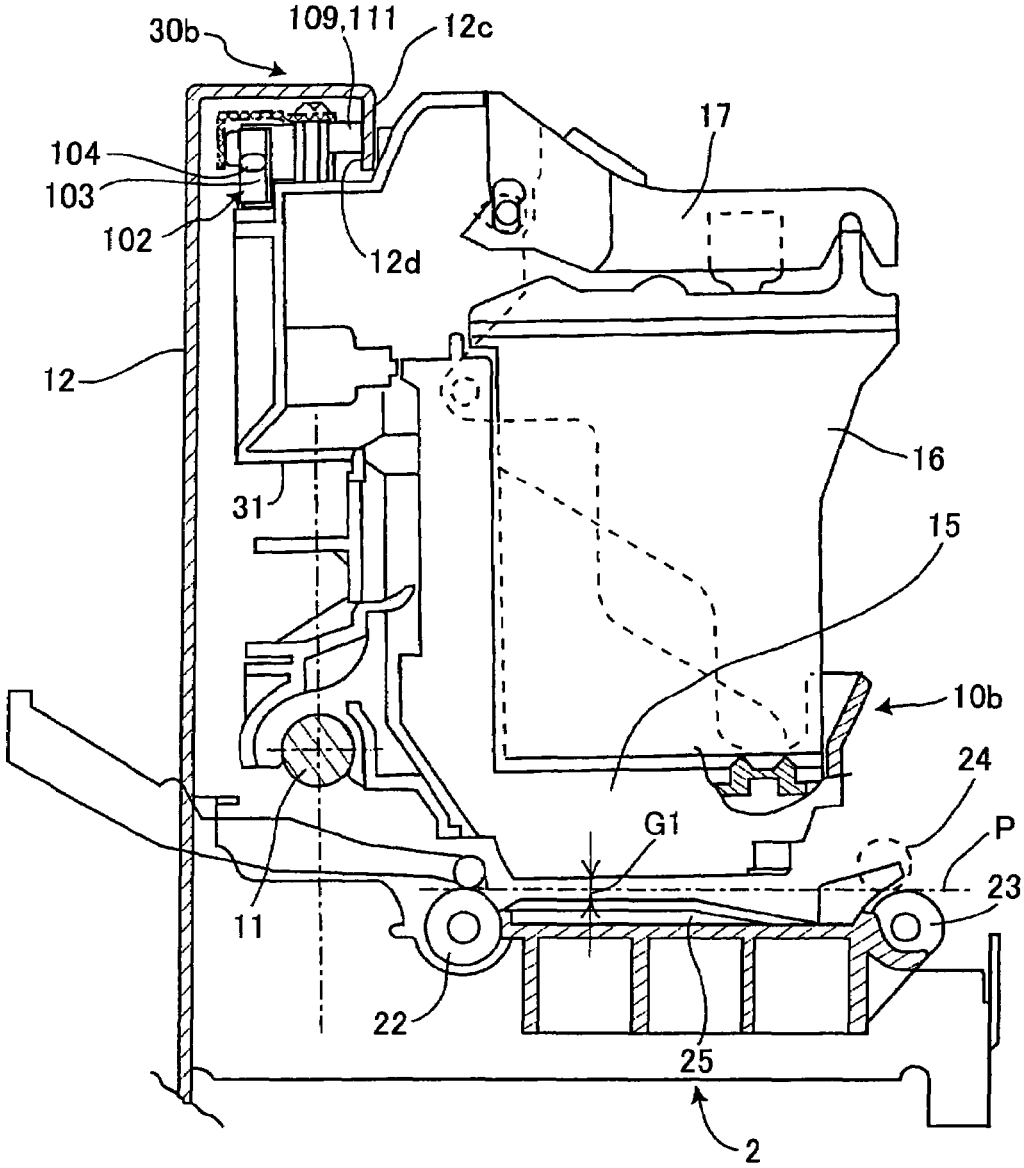
FIG. 32 is a side sectional view of a recording portion in a state in which the gap G1 is large in the third embodiment.

FIG. 32 is a side sectional view of the recording portion in a state in which the gap G1 is large. In FIG. 32, the second abutment portions 109 and 111 of the actuator portion 102 are projecting, and the second abutment portions 109 and 111 having the height T3 larger than T2 abut against the frame sliding surface 12*d*.

Figure 30C:
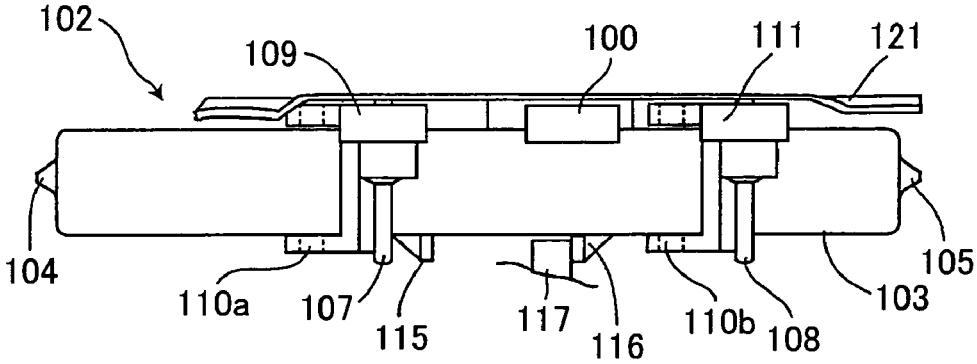
FIG. 30C is a front view of FIG. 30A.

That is, since the above state is the same as the state shown in FIGS. 30A to 30C, the carriage 10*b* pivots in the counterclockwise direction about the guide shaft 11, and the posture of the face which is the lower surface of the nozzle portions 15*a* of the recording head 15 in the carriage 10*b* is changed to the state in which the gap dimension G1 is large so as to separate from the upper surface of the platen 25 more than that in FIG. 31.

Note that, when the guide shaft 11 to be a pivotal center of the carriage 10*b* displaces to the front side (right side in the figure) of the position of the center of gravity of the carriage 10*b* depending upon a structure of the carriage 10*b*, it is possible to obtain the same effect even if the first abutment portion 101 and the second abutment portions 109 and 111 are constituted so as to abut against the front surface (right side in the figure) or the upper surface of the frame 12. Various layouts are possible for positions of the abutment portions and the abutment surface (horizontal rail portion) taking into account a piercing position of the guide shaft with respect to the carriage and the center of gravity of the carriage.

As to the printer apparatus according to the above-mentioned structure, an operation for adjusting a gap between the recording head 1 and the upper surface of the platen 25 (which is a surface and a passing route of the sheet P as a recording medium) will be described. For example, when the above-mentioned printer processing function is executed, printer driver software installed in an external apparatus such as a personal computer is started up. Then, a type of a recording medium on which printing (recording) is to be performed (sheet P) is selected. At this time, it is assumed that the gap can be set small if plain paper (e.g., a letter sheet and an A4 sheet) is selected and the gap can be set large if an envelope is selected.

Figure 33A:
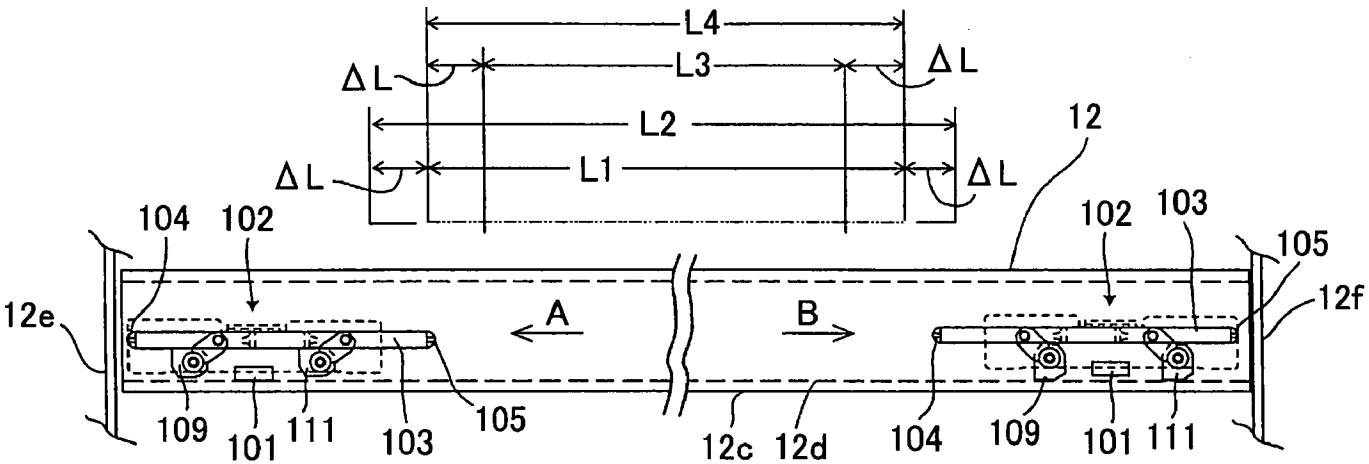
FIG. 33A is a schematic plan view showing a state of lateral movements of a carriage with respect to a frame in the third embodiment.
Figure 33B:
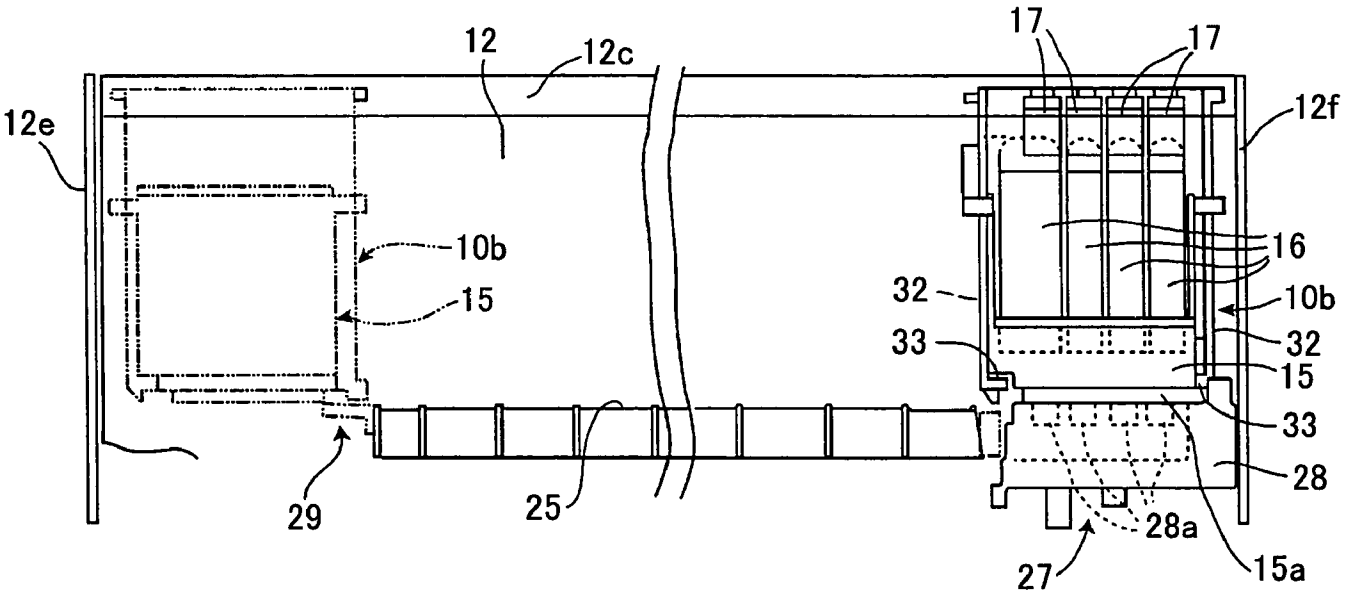
FIG. 33B is a schematic front view showing a positional relationship of a gap adjustment mechanism with respect to the frame in the third embodiment.

First, the case in which printing is performed on plain paper will be described. FIG. 33A is a schematic front view showing a state of lateral movements of a carriage with respect to the frame 12. FIG. 33B is a schematic top view showing a positional relationship of a gap adjustment mechanism with respect to the frame 12. When a print instruction is issued, the carriage 10*b* located in the home position (cap position) 28 of FIG. 33A moves in a direction of arrow A and executes a test of ink injection in the nozzle portions 15*a* in the flushing portion 29 (this flushing may be performed before switching of the gap to be described later as long as it is performed at least before start of printing). When the carriage 10*b* further continues movement, a left side plate 12*e* (side frame) of the printer apparatus 1 is located in a substantial terminal end portion of its movement. The left side plate 12*e* pushes the first projected portion 104, which is formed in the left end in the longitudinal direction of the switching lever 103 of the actuator portion 102 in FIG. 33B, as first pushing means. Thus, the actuator portion 102 is brought into the state which is described based upon FIGS. 29A to 29C and FIG. 31, that is, a state in which the second abutment portions 109 and 111 are retracted, and the first abutment portion 101 abuts the frame sliding surface 12*d* to change the gap to be small.

Subsequently, the carriage 10*b* is moved in a direction of arrow B, and characters can be printed on plain paper within the recordable (printable) range of L1. Note that the range of L2 including the recordable (printable) range L1 is a range of carriage return in the case of printing on plain paper and is located on the left side of a position for performing switching to increase a gap to be described later.

That is, when printing is performed on plain paper, it is necessary to move the carriage 10*b* in the range of L2 made by adding the acceleration and deceleration portions (ΔL) to both left and right sides of the recordable range L1 for plain paper, respectively. However, even when the carriage 10 moves to a right end position of L2, a gap is still kept small (the second projected portion 105 of the switching lever 103 does not abut against a right side plate 12*f*).

Therefore, a pushing operation by the right side plate 12*f* (side frame) serving as second pushing means for increasing a gap is performed in a position on a right side of the right end position of L2. A home position (capping position) 28 is located in substantially the same position as the position where pushing operation is performed. On the other hand, the flushing position is located at least on the left side of the left end position of the recordable range L1, and the pushing operation by the first pushing means for decreasing a gap is set to be performed in a position on the left side of the flushing position and on the left side of the left end position of L2. Thus, at least while the carriage 10*b* is reciprocatingly moving within the range of L2, printing on plain paper is performed with the gap kept small. In addition, during the printing, for example, when flushing is performed for every fixed time, a flushing operation is performed with the gap kept small as described above.

When printing is performed on a thick envelope, unless a gap is increased, the envelope moving on a sheet conveying path is brought into contact with the nozzle portions 15*a* to soil a surface of the envelope. Thus, as described above, the gap is changed and adjusted to be large. In this case, for example, if the previous print operation is printing on plain paper, when the carriage 10*b* is moved in the direction of arrow B in an attempt to retract the carriage 10 toward the home position (cap position) 28 after the printing ends, the second projected portion 105 formed at the right end of the switching lever 103 of the actuator portion 102 is pushed to the left direction in the figure by the right side plate 12*f* serving as the second pushing means.

Therefore, the actuator portion 102 changes to the state described based on FIGS. 30A to 30C and 32, that is, the state in which the second abutment portions 109 and 111 are projected. The second abutment portions 109 and 111 abut against the frame sliding surface 12*d* to be changed to the state in which a gap is large (state of printing on an envelope). Accordingly, the surface of the envelope does not rub against the nozzle portions 15*a* in printing, so that stains due to adhesion of unnecessary ink can be prevented.

That is, in the case of performing printing on an envelope, the recordable range L3 for the envelope is narrower than the recordable range L1 for plain paper and is set to be on the inner side of L1. When the carriage 10*b* is moved in the range of L4 made by adding the acceleration and deceleration portions (ΔL) to both left and right sides of L3, respectively, and the carriage 10*b* has moved to the left end position of L4, and, moreover, even when the carriage 10*b* has moved to the flushing position, the gap is still kept large (the first projected portion 104 of the switching lever 103 does not abut against the left side plate 12*e*).

Therefore, printing on the envelope is performed with the gap kept large at least while the carriage 10*b* reciprocatingly moves within the range of L4. In addition, during the printing, for example, even when flushing is performed for every fixed time, the flushing operation is performed with the gap kept large. Consequently, when the flushing is performed, it is unnecessary to idly move the carriage 10*b* to a position, where the first projected portion 104 of the actuator portion 102 abuts against the left side plate 12*e* to be switched, each time the flushing is performed, so that a printing operation on the envelope can be carried out promptly.

Note that, when the carriage 10 moves to the home position 28, for example, even in a state in which the gap is switched to be small, the switching lever 103 is pushed by the right side plate 12*f* serving as the second pushing means from a position before the home position. The gap dimension G1 is switched to be large at substantially the same position as the home position.

Fourth Embodiment Concerning the Gap Adjustment Mechanism

Figure 34A:
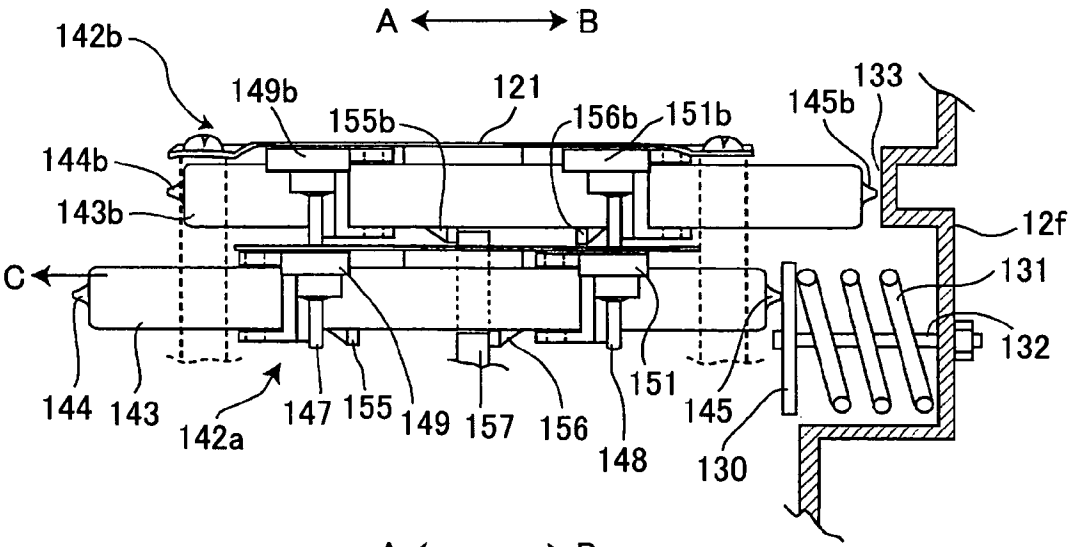
FIG. 34A is a view showing a gap adjustment mechanism according to a fourth embodiment and showing a structure capable of switching a gap between a recording head and a recording medium into three stages, i.e., large, medium, and small, and showing a state where the gap is switched between medium gap and small gap.
Figure 34B:
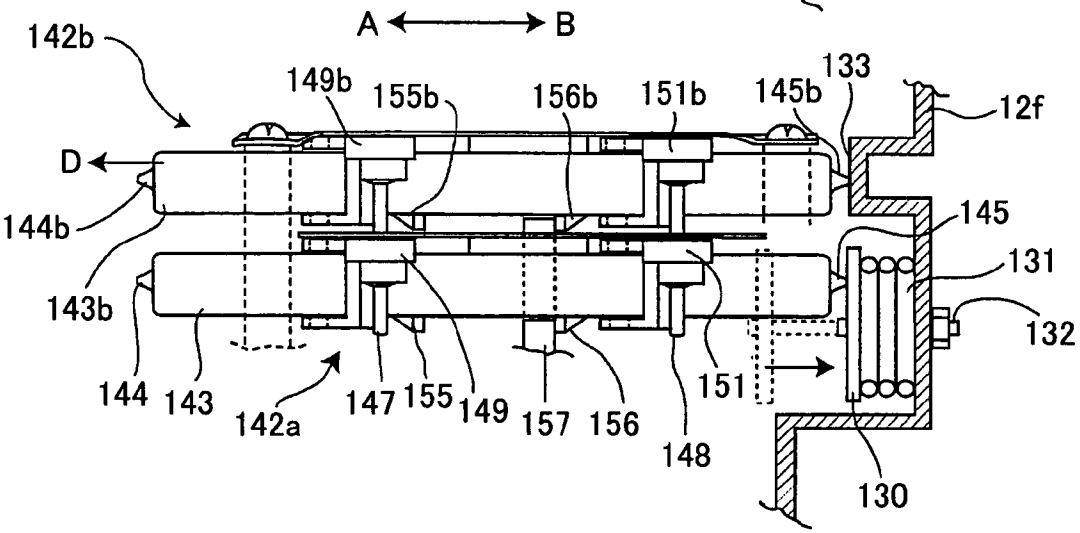
FIG. 34B is a view showing an operation and a state in which the gap having switched to medium is switched to large.

Next, a structure by which the gap dimension G1 of the third embodiment is switched to, for example, three types will be described. As shown in FIGS. 34A and 34B, the switching becomes possible by forming the above-mentioned actuator portion 102 in a vertically stacked structure viewed from its front. FIG. 34A is a view showing an operation and a state for, in a structure in which a gap between a recording head and a recording medium can be switched to large, medium, and small, switching the gap in two stages of medium and small. FIG. 34B is a view showing an operation and a state for switching the gap having switched to medium to large. In this structure, a first abutment portion (FIGS. 29B and 30B) having the height of T2, which is not shown, is adhered and fixed to the upper surface of the not-shown carriage 10*b*. A lower actuator portion 142*a* and an upper actuator portion 142*b* are stacked and fixed by being screwed to the upper surface of the not-shown carriage 10*b*. Since respective structures and components of the lower actuator portion 142*a* and the upper actuator portion 142*b* are the same as those of the actuator portion 102 (FIGS. 29C and 30C) of the above-mentioned second embodiment except parts to be described later, detailed descriptions of them will be omitted.

In addition, as illustrated, a pushing portion of the right side plate 12*f* for pushing the switching lever 143 of the lower actuator portion 142*a* is constituted by a pushing plate 130, a slide pin 132, and a compression coil sprint 131. The pushing plate 130 is made laterally movable on the figure with the slide pin 132 fixed to the right side plate 12*f* as a reciprocating slide shaft. Thus, when a force for pushing the pushing plate 130 from the left of the figure does not work, the compression coil spring 131 is in a state in which it is extended by an elastic force of the compression coil sprint 131 as shown in FIG.

34A. Moreover, a repulsive force of this compression coil spring 131 is set such that the compression coil spring 131 is hardly compressed and is capable of switching the switching lever 143 of the lower actuator portion 142*a* to a direction of C. In addition, a switching abutment portion 133 against which the second projected portion 145*b* of the upper actuator portion 142*b* abuts is provided on the right side plate 12*f*.

Now, a state is assumed in which the gap between the recording head and the recording medium is adjusted to small. That is, it is assumed that first abutment portions 149 and 151 of the lower actuator portion 142*a* are retracted, third abutment portions 149*b* and 151*b* of the upper actuator portion 142*b* are retracted, and the first abutment portion 101 (see FIG. 29B) is in contact with the frame sliding surface 12*d*. In this case, the switching levers 143 and 143*b* are in a state in which they have moved to the right side and have been switched, respectively, viewed from the front. In this state, it is assumed that a direction in which the not-shown carriage 10*b* moves toward the side plate 12*f* is B and the opposite direction is A. When the carriage 10*b* moves in the B direction, first, a second projected portion 145 of the lower actuator portion 142*a* abuts against the pushing plate 130. When the carriage 10*b* continues to further move in the B direction, the movement of the switching lever 143 is restricted by the elastic force of the compression spring 131, and the switching lever 143 is switched to a left direction (C direction in the figure) with respect to the carriage 10*b*. Then, the second abutment portions 149 and 151 having the height of T3 project, and the gap between the recording head and the recording medium is switched to medium. At this point, the second projected portion 145*b* of the upper actuator portion 142*b* is just before abutting the switching abutment portion 133. A state at this point is shown in FIG. 34A. In this state, when the movement of the carriage 10*b* is switched to the A direction to perform a print operation, printing becomes possible in a state in which the gap is switched to medium.

When the not-shown carriage 10*b* continues to move in the B direction from the above-mentioned state of FIG. 34A, the switching lever 143 of the lower actuator portion 142*a* is locked by a stopper 157 formed on the upper surface of the carriage through a second stop projected portion 156. Therefore, the carriage 10*b* does not move any farther in the C direction shown in the figure. Thus, the pushing plate is pushed to the right by the second projected portion 145 and the carriage 10*b* continues to move in the B direction. On the other hand, the second projected portion 145*b* of the upper actuator portion 142*b* abuts against the switching projected portion 133 of the right side plate 12*f*. At the same time, the switching lever 143*b* moves in a direction of D to be switched as the carriage 10*b* moves in the B direction. Simultaneously, Since the third abutment portions 149*b* and 151*b* of the upper actuator portion 142*b*, which has a height of T4 thicker than the thickness of T3, project and abut against the frame sliding surface 12*d* (see FIGS. 32 and 33B) at the upper end of the frame 12, the gap between the recording head and the recording medium is switched to large. FIG. 34B is a view showing the state at this time. In this way, the switching of the gap becomes possible in the three stages of large, medium, and small.

The multifunction facsimile and printer apparatus according to the present is not limited to the above-mentioned embodiments, and various modifications and improvements are possible within a scope defined in claims. For example, in the above-mentioned embodiments, when printing is performed on plain paper, the carriages 10 and 10*b* are moved in the range of L2 found by adding the acceleration and deceleration portions (ΔL) to both left and right sides of the recordable range L1 for plain paper, respectively. In addition, when printing is performed on an envelope, the carriage 10 is moved in the range of L4 made by adding the acceleration and deceleration portions (ΔL) to both left and right sides of the recordable range L3 for an envelope, respectively. Thus, there is an advantage that a speed of the carriage 10 in performing an ink discharge operation becomes substantially constant and timing control of ink discharge becomes easy.

However, the present invention is not limited to the above embodiments. For example, when discharge timing of ink is controlled so as to discharge ink even during the acceleration of a carriage, the second pushing piece 57 can be positioned at least on the outer side (right side in FIG. 3A) of the recordable range L1 for plain paper in the first embodiment. In addition, the first pushing piece 56 can be positioned at least on the outer side (left side in FIG. 3A) of the recordable range L3 for an envelope when it has a structure which allows the carriage 10 to move to the outer side even after completion of a pushing operation, and a structure to perform flushing in an arbitrary place on a platen in the same manner as the second pushing piece 57.

Likewise, when discharge timing of ink is controlled such that ink discharge is possible even during the acceleration of a carriage, a point where the switching lever 102 is switched to make a gap large can be positioned at least on the outer side (right side in FIG. 33B) of the recordable range L1 for plain paper in the third embodiment. In addition, a point where the switching lever 102 makes the gap small can be positioned at least on the outer side (left side in FIG. 33B) of the recordable range L3 for an envelope when the switching lever 102 has a structure which allows the carriage 10*b* to move to the outer side even after completion of a switching operation and a structure to perform flushing even in an arbitrary place on a platen.

In addition, in the gap adjustment mechanisms in the first and second embodiments, instead of arranging the frame 12 uprightly, the frame 12 may be extended substantially linearly to the opposite side of the nozzle portions 15*a* across the guide shaft 11. The switching bock member 13 may be provided pivotably on the lower surface side of the carriage 10 such that one of several abutment portions with different heights is selected and come into slide contact (abutment) with the slide contact portion 12*a* at an end of the frame 12. The present invention can be applied not only to the above-mentioned printer apparatus but also a copying machine and an image scanner of a carriage mount type.

In the third embodiment, the left side plate 12*e* and the right side plate 12*f* are utilized as the first and second pushing means, respectively. Depending upon a structure of the printer apparatus 1, it is also possible to provide an extension portion extending to a front side from both side edges of a vertical portion of the frame 12 or provide an extension portion extending downward from both side of a horizontal portion located above the frame 12, thereby using this extension portion as the first and second pushing means.

Further, in the series of procedures in the above-mentioned embodiments, timing at which the carriage 10 makes a complete change from deceleration to acceleration is set to be different at the left and right ends of the reciprocating movement portion in the case of the two-way printing. Such timing may be set to be different in the case of a one-way printing. In addition, the stop determination of 100 ms is also applied to the movement to the flushing position for preventing ink clogging periodically during page printing.

INDUSTRIAL APPLICABILITY

The present invention can be applied not only to the above-mentioned multifunction facsimile/printer apparatus but also to a copying machine, an image scanner of a carriage mounted type, an ink jet printer as a unit, and a serial printer of a dot impact system. The present invention is technically useful.

The invention claimed is:

1. An image forming apparatus comprising:

a frame extending in a direction crossing a conveying direction of a recording medium;

a guide shaft provided in parallel with the frame;

a carriage reciprocating along the guide shaft, the carriage being mounted with a recording head; and a gap adjustment mechanism adjusting a gap between the recording head and the recording medium, wherein the gap adjustment mechanism is provided with a plurality of abutment portions which come into slide contact with the frame to move in parallel with the frame together with the carriage, the plurality of abutment portions being rotatable about a rotation axis extending toward the frame, the plurality of abutment portions having different heights projecting in an axial direction of the rotation axis, the gap adjustment mechanism switches one of the plurality of abutment portions to another according to movement of the carriage to a predetermined position in one direction parallel with the frame and another movement of the carriage to another predetermined position in another direction to adjust the gap between the recording head and the recording medium.

2. The image forming apparatus according to claim 1, wherein:

the gap adjustment mechanism has a switching portion for selecting and switching to one of the abutment portions and pushing means for pushing and actuating the switching portion, the pushing means being provided independently from the carriage; and the pushing means push the switching portion at the time of movement of the carriage in one direction parallel with the frame and at the time of movement of the carriage in another direction, to select one of the plurality of abutment portions and adjust the gap between the recording head and the recording medium.

3. The image forming apparatus according to claim 2, wherein:

the pushing means include first pushing means for pushing the switching portion in one direction, and second pushing means for pushing the switching portion in another direction; and the first pushing means pushes the switching portion in one direction at the time of movement of the carriage in the direction parallel with the frame, and the second pushing means pushes the switching portion in another direction at the time of movement of the carriage in another direction, the pushing means then selects one of the abutment portions and adjust the gap between the recording head and the recording medium.

4. The image forming apparatus according to claim 3, wherein the pushing means are provided in the frame, the pushing means switches to the abutment portions during the movement of the carriage in one direction and the movement of the carriage in another direction, and the abutment portions with the different heights selectively come into slide contact with the frame, to adjust the gap between the recording head and the recording medium.

5. The image forming apparatus according to claim 4, wherein the pushing means are provided at ends of paths of the movements of the carriage in one direction and another direction, respectively.

6. The image forming apparatus according to claim 3, wherein the first pushing means changes the abutment portions with different heights so as to reduce the gap between the recording head and the recording medium, and the second pushing means changes the abutment portions with different heights so as to increase the gap between the recording head and the recording medium.

7. The image forming apparatus according to claim 3, wherein the recording head is an ink jet head for discharging ink to perform recording, and further comprising a cap mechanism for performing capping to the recording head in substantially the same position as or on an outer side of a position where the second pushing means completes an operation during the movement of the carriage.

8. The image forming apparatus according to claim 3, wherein the first pushing means is positioned on an outer side of a printable range for a print operation to reduce the gap between the recording head and the recording medium to print on the recording medium.

9. The image forming apparatus according to claim 3, wherein the first pushing means is positioned on an outer side of a printable range for a print operation to reduce the gap between the recording head and the recording medium to print on the recording medium, and the first pushing means is positioned in an outside position of an area required for accelerating or decelerating the carriage.

10. The image forming apparatus according to claim 3, wherein the recording head is an ink jet head for discharging ink to perform recording, further comprising a flushing mechanism for performing preliminary ink discharge in substantially the same position as or on an inner side of a position where the first pushing means completes an operation.

11. The image forming apparatus according to claim 3, wherein the second pushing means is positioned on an outer side of a printable range for a print operation to increase the gap between the recording head and the recording medium to perform a print operation.

12. The image forming apparatus according to claim 3, wherein the second pushing means is positioned on an outer side of a printable range for a print operation to increase the gap between the recording head and the recording medium to perform a print operation, and the second pushing means is positioned at an outside position at least of an area required for accelerating or decelerating the carriage.

13. The image forming apparatus according to claim 2, wherein the pushing means are positioned within the moving range of the carriage and outside a printable range.

14. The image forming apparatus according to claim 2, wherein switching of the abutment portions with different heights by the pushing means is executed before a print operation to the recording medium in response to an instruction from a host computer connected to the image forming apparatus.

15. The image forming apparatus according to claim 14, wherein the abutment portions with different heights are changed by the pushing means so as to increase the gap based upon an instruction from the host computer indicating that an envelope has been selected as the recording medium.

16. The image forming apparatus according to claim 14, wherein the abutment portions with different heights is changed by the pushing means so as to reduce the gap in response to an instruction from the host computer indicating that a plain paper has been selected as the recording medium.

17. The image forming apparatus according to claim 1, wherein:

the recording head constitutes a recording head unit and is detachably mounted to the carriage;

portions being pressed are provided so as to project on both left and right sides of the recording head unit;

an upward opening head retracting portion in the carriage for retracting the recording head unit, the upward opening head retracting portion having left and right side plates engaging with the portions being pressed; and the left and right side plates are provided with elastic pressing members for pressing the portions being pressed and locking portions for locking the elastic pressing members.

18. The image forming apparatus according to claim 17, wherein the head retracting portion of the carriage is provided with a bottom supporting portion and a back supporting portion which respectively support a bottom and a back other than a nozzle portion of the recording head unit, and the recording head unit is biased against the bottom supporting portion and the back supporting portion by the elastic pressing members.

19. The image forming apparatus according to claim 18, wherein the portions being pressed are pressed obliquely downward by the elastic pressing members such that a pressing force by the elastic pressing members to the back supporting portion becomes larger than a pressing force to the bottom supporting portion.

20. The image forming apparatus according to claim 17, wherein:

the elastic pressing members are constituted by wire springs; base ends of the wire springs are pivotably mounted on external surfaces of the left and right side plates of the carriage; and the locking portions include first locking portions provided on the external surfaces of the left and right side plates of the carriage for pressing and locking longitudinal middle portions of the wire springs obliquely downward, and second locking portions for locking free ends of the wire springs not to allow the free ends to be unlocked in an external direction of the side plates.

21. The image forming apparatus according to claim 17, wherein the recording head unit has an upward opening ink cartridge receiving portion for detachably receiving an ink cartridge, and the carriage is provided with a pressing lever for pressing the ink cartridge to the recording head unit.

22. The image forming apparatus according to claim 21, wherein a pressing force of the pressing lever is set such that the ink cartridge is directed toward a direction of a bottom of the recording head unit.

23. An image forming apparatus comprising:

a frame extending in a direction crossing a conveying direction of a recording medium, the frame being provided with a horizontal portion having a sliding surface;

a guide shaft positioned in parallel with the horizontal portion of the frame;

a carriage reciprocating along the guide shaft, the carriage being mounted with a recording head;

a switching block member provided in the carriage to change in a posture between at the movement of the carriage in one direction parallel with the horizontal portion of the frame and at the movement of the carriage in another direction, the switching block member being provided with a plurality of abutment portions with different heights which are in slidable contact with the sliding surface of the frame according to the posture change of the switching block member, the plurality of abutment portions being rotatable about a rotation axis extending toward the frame, and the heights of the plurality of abutment portions projecting in an axial direction of the rotation axis; and pushing means provided in the frame to switch the posture of the switching block member for the movement of the switching block member, characterized in that the abutment portions with different heights selectively come into slide contact with the frame to adjust a gap between the recording head and the recording medium.

24. The image forming apparatus according to claim 23, wherein the carriage is constituted pivotably around an axis of the guide shaft, and a portion at which the abutment portions of the switching block member abut against a slide contact portion of the frame is positioned on an opposite side of the recording head across the guide shaft.

25. The image forming apparatus according to claim 23, wherein:

the recording head is mounted on the carriage such that a print side thereof faces downward;

a portion close to one side of a lower end of the carriage is slidably supported by the guide shaft;

the frame has a vertical portion which extends in a vertical direction along a back of the carriage, the vertical portion being in a position higher than the guide shaft; and the switching block member is positioned so as to face the sliding surface of the vertical portion of the frame on the opposite side to the side facing the carriage, the switching block member is made pivotal with respect to the carriage through a horizontal axis perpendicular to a moving direction of the carriage and to the vertical portion of the frame.

26. The image forming apparatus according to claim 23, wherein biasing means for holding a posture changed when the switching block member crosses a dead center of pivoting is connected to the switching block member.

27. The image forming apparatus according to claim 23, wherein the pushing means is provided at positions where the pushing means abut against the block member during the movement of the carriage in one direction and during the movement of the carriage in another direction.

28. The image forming apparatus according to claim 23, wherein the pushing means include first pushing means, provided on one end of a moving range of the carriage, the first pushing means switching a plurality of abutment portions with different heights during the movement of the carriage to the one end, and second pushing means, provided on another end of the moving range of the carriage, the second pushing means switching the plurality of abutment portions with different heights during the movement of the carriage to another end.

29. An image forming apparatus comprising:

a frame extending in a direction crossing a conveying direction of a recording medium;

a guide shaft positioned in parallel with the frame;

a carriage reciprocating along the guide shaft and mounted with a recording head; and a gap adjustment mechanism adjusting a gap between the recording head and the recording medium, wherein the gap adjustment mechanism includes:

a first abutment portion adhered to the carriage, the first abutment portion being rotatable about a rotation axis extending toward the frame and having a height projecting in an axial direction of the rotation axis;

a second abutment portion which projects from and retracts in the carriage during the movement of the carriage in one direction parallel with the frame and during the movement of the carriage in another direction, the second abutment portion being rotatable about the rotation axis, and the second abutment portion having a height different from that of the first abutment portion and projecting in the axial directing of the rotation axis; and pushing means which perform switching between the projection and the retraction of the second abutment portion during the movement of the carriage in one direction and during the movement of the carriage in another direction, one of the first and second abutment portion selectively comes into slide contact with the frame to adjust the gap between the recording head and the recording medium.

30. The image forming apparatus according to claim 29, wherein the pushing means are constituted by left and right side plates of the frame.

31. The image forming apparatus according to claim 29, wherein the carriage is provided pivotably about an axis of the guide shaft, and a portion where the first and second abutment portions with different heights selectively come into slide contact with the frame is provided on a side of the recording head across the guide shaft.

32. The image forming apparatus according to claim 29, wherein:

the recording head is mounted on the carriage such that a print side thereof faces downward;

a portion close to one side of a lower end of the carriage is slidably supported by the guide shaft;

the frame has a vertical portion which extends in a vertical direction to above the carriage along a back of the carriage at a higher position than the guide shaft, and an upper part of the vertical portion is bent vertically downward, and a lower end of a bent portion is positioned to be adjacent to an upper surface of the carriage; and the first and second abutment portions are positioned so as to face and slide on a vertical surface of the bent portion of the frame, which is opposite to the side facing the carriage.

33. The image forming apparatus according to claim 29, wherein the second abutment portion comes into slide contact with the frame when the second abutment portion projects, and the first abutment portion comes into slide contact with the frame when the second abutment portion retracts.

34. An image forming apparatus comprising:

a frame extending in a direction crossing a conveying direction of a recording medium;

a guide shaft positioned in parallel with the frame;

a carriage reciprocating along the guide shaft, the carriage being mounted with a recording head;

a switching portion provided in the carriage; and pushing means having an abutment relationship with the switching portion in relation to movement of the carriage, wherein:

the switching portion includes a first abutment portion which is adhered to the carriage, the first abutment portion selectively coming into slide contact with the frame and a movable second abutment portion which projects higher than the first abutment portion, the second abutment portion retracting lower than the first abutment portion;

the pushing means include first pushing means which is positioned at one end of a moving range of the carriage in one direction, the first pushing means pushing the switching portion in one direction causes the second abutment portion to retract, and second pushing means which is positioned at the other end of the moving range of the carriage in another direction, the second pushing means pushing the switching portion in another direction causes the second abutment portion to project; and the first abutment portion comes into slide contact with the frame in parallel thereto by moving the carriage to the one end to retract the second abutment portion, and the second abutment portion comes into slide contact with the frame in parallel thereto by moving the carriage to the other end to cause the second abutment portion to project, thereby adjusting a gap between the recording head and the recording medium.

* * * * *